US008385787B2

(12) United States Patent
Yamaguchi et al.

(10) Patent No.: US 8,385,787 B2
(45) Date of Patent: Feb. 26, 2013

(54) IMAGE FORMING APPARATUS AND MEDIUM CONTAINER INSTALLED THEREIN

(75) Inventors: Daichi Yamaguchi, Sagamihara (JP); Tsukuru Kai, Fujisawa (JP); Yukimichi Someya, Saitama (JP); Makoto Komatsu, Yokohama (JP); Tadashi Hayakawa, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 228 days.

(21) Appl. No.: 12/881,518

(22) Filed: Sep. 14, 2010

(65) Prior Publication Data

US 2011/0064478 A1 Mar. 17, 2011

(30) Foreign Application Priority Data

Sep. 15, 2009 (JP) ..... 2009-213847
Aug. 6, 2010 (JP) ..... 2010-178192

(51) Int. Cl.
*G03G 15/08* (2006.01)

(52) U.S. Cl. ..... 399/258; 399/224; 399/262

(58) Field of Classification Search ..... 399/258, 399/224, 262, 106, 252
See application file for complete search history.

(56) References Cited

U.S. PATENT DOCUMENTS

| | | | | |
|---|---|---|---|---|
| 6,882,817 | B2 | 4/2005 | Kita | |
| 6,898,405 | B2 | 5/2005 | Matsumoto et al. | |
| 7,116,928 | B2 | 10/2006 | Muramatsu et al. | |
| 7,542,703 | B2 | 6/2009 | Kasahara et al. | |
| 7,720,416 | B2 | 5/2010 | Taguchi et al. | |
| 2002/0025196 | A1 | 2/2002 | Matsumoto et al. | |
| 2003/0235436 | A1 * | 12/2003 | Kasahara et al. | 399/258 |
| 2004/0071481 | A1 * | 4/2004 | Katsuyama | 399/258 |
| 2006/0104671 | A1 | 5/2006 | Murakami et al. | |
| 2007/0223971 | A1 | 9/2007 | Takagi | |
| 2008/0219683 | A1 | 9/2008 | Muramatsu | |
| 2009/0129825 | A1 | 5/2009 | Okino et al. | |

FOREIGN PATENT DOCUMENTS

| | | | |
|---|---|---|---|
| CN | 1773387 | A | 5/2006 |
| CN | 2906695 | Y | 5/2007 |
| CN | 101046672 | A | 10/2007 |
| CN | 100350330 | C | 11/2007 |
| CN | 101107576 | A | 1/2008 |
| JP | 6-161245 | | 6/1994 |

OTHER PUBLICATIONS

Office Action issued Apr. 12, 2012 in Chinese Application No. 201010284407.3.

* cited by examiner

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

An image forming apparatus in which a medium container is installed includes a main body, an image forming unit, a medium container a container body at least partially formed of a deformable material, a drawer to hold the medium container thereon and movable between a first position and a second position, a medium transport unit including a medium outlet port provided on a distal end of the medium container, and a medium receiving unit disposed at the second position of the drawer and connected to the medium transport unit provided on the medium container, and a medium transport facilitator mounted on the drawer to contact the medium container set in the drawer from below to move the medium contained in the medium container toward the medium transport unit at the second position.

19 Claims, 52 Drawing Sheets

IMAGE FORMING APPARATUS AND MEDIUM CONTAINER INSTALLED THEREIN

CROSS-REFERENCE TO RELATED APPLICATIONS

The present invention claims priority pursuant to 35 U.S.C. §119 from Japanese Patent Application No. 2009-213847, filed on Sep. 15, 2009 in the Japan Patent Office, and Japanese Patent Application No. 2010-178192, filed on Aug. 6, 2010 in the Japan Patent Office, which are hereby incorporated by reference herein in their entirety.

BACKGROUND OF THE INVENTION

1. Field of the Invention

Exemplary embodiments of the present invention relate to an image forming apparatus and a deformable medium container that can be installed in the image forming apparatus.

2. Discussion of the Related Art

Related-art image forming apparatuses are known to form an image with powder toner (hereinafter, simply "toner") which is a powder-type medium for image formation. For example, electrophotographic image forming apparatuses develop an electrostatic latent image into a visible toner image by using a developing unit. The image forming apparatuses include copiers, printers, facsimile machines, and multi-functional machines having a combination of these capabilities. Direct recording-type image forming apparatuses form an image by spraying liquid toner in dot shape from a toner jetting unit onto a recording medium and so forth. These image forming apparatuses include a medium supplying unit from which fresh toner is supplied to a developing unit and the toner jetting unit.

The new toner is contained in a medium container. Medium containers formed using a deformable material as proposed in Japanese Patent Application Publication No. 2004-198703 (JP-2004-198703-A1) are now increasingly used.

It is advantageous to form the medium container with deformable material because deformable material that includes a resin sheet material, such as nylon resin, or a paper sheet material, is light-weight and easy to fold, and therefore is easy to collect, transport, and recycle after use. However, such a medium container formed of deformable material has less rigidity and is difficult to set in an image forming apparatus properly. In particular, the very flexibility of material hinders the medium container from setting a medium supply opening thereof to a predetermined position in the toner supplying unit and to a correct position capable of transporting toner properly.

Further, it is also difficult to increase the size of the medium container for storing more toner therein. Generally, an image forming apparatus is assembled by a large number of units and components extending horizontally and its layout is designed accordingly. Assuming that the medium container is disposed vertically, it should avoid interference with these units and components. As a result, it may be unavoidable to dispose the medium container projecting outward from the body of the image forming apparatus, which is undesirable.

In addition, if a flexible medium container needs to supply toner to a developing unit provided in the image forming apparatus, it is not preferable that the flexible medium container includes a rigid member such as a toner transport screw. If it does, it is likely that the rigid member can cause damage to the flexible medium container by breaking through the walls of the flexible medium container and/or can be bulky when folding the flexible medium container.

One approach is to use the weight of toner itself so that the toner can fall due to gravity to the developing unit. However, placing the flexible medium container in any plane other than the horizontal can adversely affect the entire layout of the image forming apparatus.

SUMMARY OF THE INVENTION

The present invention provides a novel image forming apparatus that can set a medium container using a deformable material to a drawer and convey toner contained in the medium container toward a medium outlet port reliably.

The present invention further provides a novel medium container using a deformable material can be installed in the above-described image forming apparatus.

In one exemplary embodiment, an image forming apparatus includes a main body, an image forming unit, a medium container, a drawer, a medium transport unit, a medium receiving unit, and a medium transport facilitator. The image forming unit is disposed in the main body to form a visible image. The medium container includes a container body at least partially formed of a deformable material and contains a medium for image forming by the image forming unit. The drawer holds the medium container thereon and movable between a first position at which the drawer is pulled out fully to an outward side of the main body of the image forming apparatus and a second position at which the drawer is inserted and set to an inward side of the main body of the image forming apparatus. The medium transport unit includes a medium outlet port provided on a distal end of the medium container. The medium receiving unit is disposed at the second position of the drawer and connected to the medium transport unit provided on the medium container. The medium transport facilitator is mounted on the drawer to contact the medium container set in the drawer from below to move the medium contained in the medium container toward the medium transport unit at the second position.

The medium transport facilitator may cause the medium container to be disposed at a downward sloping angle to the medium outlet port.

The medium transport facilitator may lift a lower face of the medium container upward and inward toward the interior of the image forming apparatus and move toward the medium outlet port while repeatedly lifting the lower face of the medium container.

The medium transport facilitator may include a pressing member to lift a lower face of the medium container toward the interior of the image forming apparatus, and a moving unit to move the pressing member toward the medium outlet port while lifting the lower face of the medium container by the pressing member.

The medium transport facilitator may include multiple pressing members disposed in a longitudinal direction of the medium container to lift a lower face of the medium container toward the interior of the image forming apparatus, and a pressing mechanism to cause the multiple pressing members to contact and separate from a lower face of the medium container.

The medium transport facilitator may include a pressing member having a pressing surface formed in a curved shape to press the lower face of the medium container toward the interior of the image forming apparatus, and a moving unit to rotate the pressing member with the pressing surface of the pressing member contacting a lower face of the medium container.

The medium transport facilitator may include a pressing member having a pressing surface formed in a curved shape to press the lower face of the medium container toward the interior of the image forming apparatus, and a moving unit to move the pressing member in a direction of the medium transport direction with the pressing surface of the pressing member contacting a lower face of the medium container when the drawer is set in the second position.

The medium transport facilitator may include a screw-shaped pressing member on the surface thereof to lift a lower face of the medium container toward the interior of the image forming apparatus, and a moving unit to rotate the pressing member, when the drawer is set in the second position. The pressing member may be disposed at the distal medium outlet and rotatable around an axis extending in the medium transport direction.

The screw-shaped pressing member may be tapered with a reduced outer diameter from a trailing end of the medium container toward a leading end of the medium container.

The medium transport facilitator may include a push-up member, a biasing member, and a drawer push-up control mechanism. The push-up member may push up the container body disposed opposite the medium transport unit in synchronization with insertion of the drawer in the image forming apparatus toward the second position. The biasing member may apply a biasing force to the push-up member. The drawer push-up control mechanism may cause a push-up operation of the push-up member to remain stopped when the drawer moves from the first position to the second position and to push up the drawer in cooperation with cam rails disposed in the main body of the image forming apparatus when the drawer stays at the second position.

The above-described image forming apparatus may further include a compression part disposed above the drawer at the second position in the main body of the image forming apparatus to compress the container body, which is pushed up by the push-up member, by sandwiching the container body between the push-up member and the compression part.

The push-up member may push up the container body disposed opposite the medium transport unit to bend the container body in a vertical direction when the drawer is inserted to the second position.

The medium receiving unit may include an engaging unit projecting at an angle to a medium transport direction at a connection between the medium contacting portion and the medium transport unit.

The medium transport unit may communicate with the developing unit in the main body of the image forming apparatus and the medium receiving unit. The medium transport unit may further include a flexible tubular member having a slack portion whose length is greater than a distance through which the drawer is pulled out from the main body of the image forming apparatus, and a medium transport pump located at an intermediate position in the tubular member.

The above-described image forming apparatus may further include a tubular member storing unit to store the slack tubular member therein when the drawer is at the second position.

The above-described image forming apparatus may further include a joint portion, a restorative force application member, and a regulating member. The joint portion may be located at a side opposite the engaging unit of the medium receiving unit for connecting the tubular member and the engaging unit and rotatably supported with respect to the medium receiving unit. The restorative force application member may apply a restorative force to the joint portion to cause the tubular member to rotate in a tube storing direction. The regulating member may regulate rotation of the joint portion in a tube pulling-out direction when the drawer is at the first position.

In one exemplary embodiment, a medium container is stored in an image forming apparatus and containing medium for image forming therein and includes a container body, a medium transport unit, and a grip portion. The container body is at least partially formed of a deformable material. The medium transport unit connects to a medium receiving unit provided in a main body of the image forming apparatus. The grip portion is mounted on the container body.

The grip portion may be disposed at both ends thereof in a longitudinal direction of the container body.

The grip portion may be fixedly attached at both ends thereof in a longitudinal direction of the container body.

The grip portion may include a first grip portion disposed at one end of the container body in the longitudinal direction thereof and a second grip portion disposed on the container body from the other opposite end toward the one end along the longitudinal direction of the container body.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
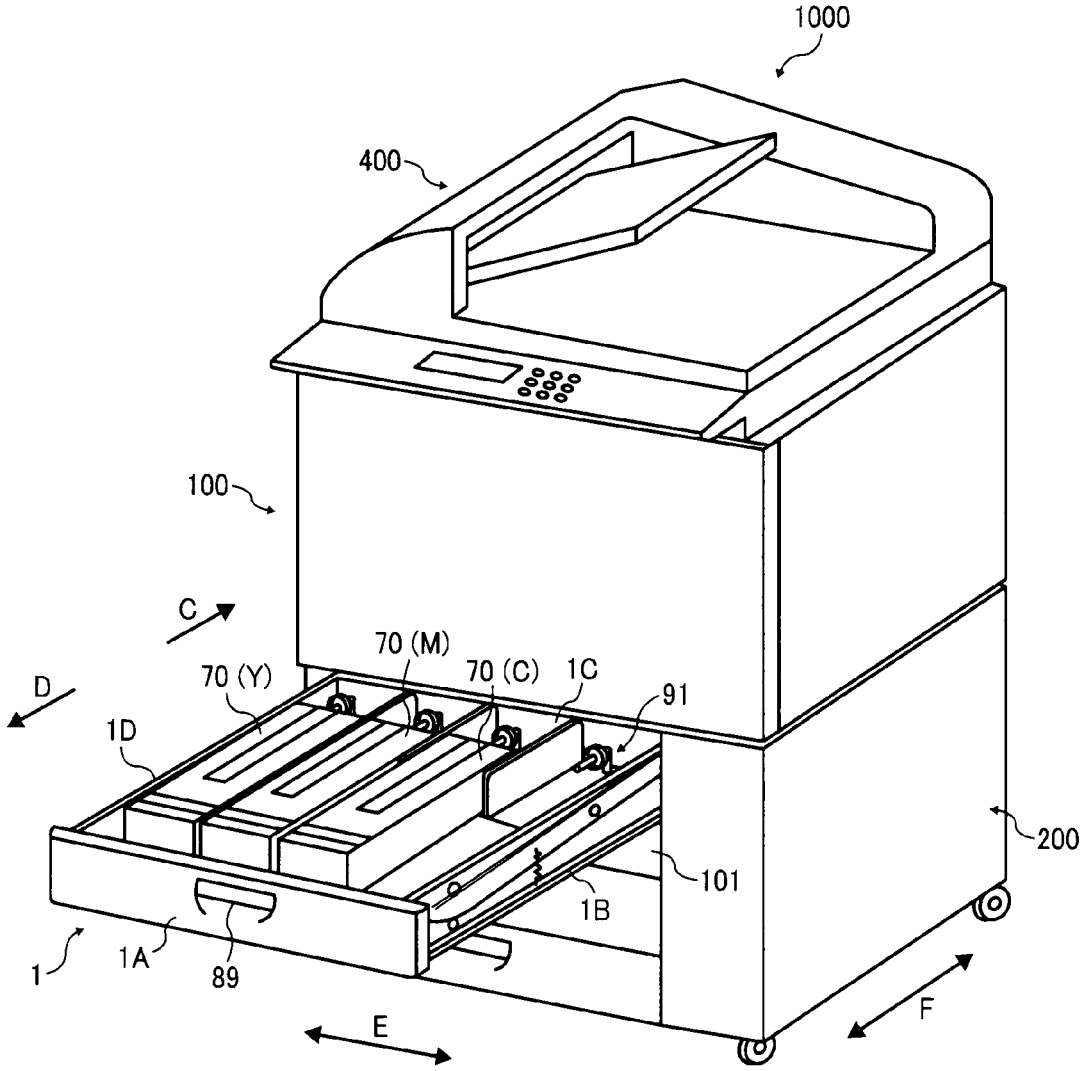
FIG. 1 is a perspective view of an image forming apparatus according to an exemplary embodiment of the present invention, when a tray for holding and setting medium containers therein is pulled out.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

First a description is given of the whole configuration of an image forming apparatus 1000 and each feature of components and unit provided therein.

Figure 2:
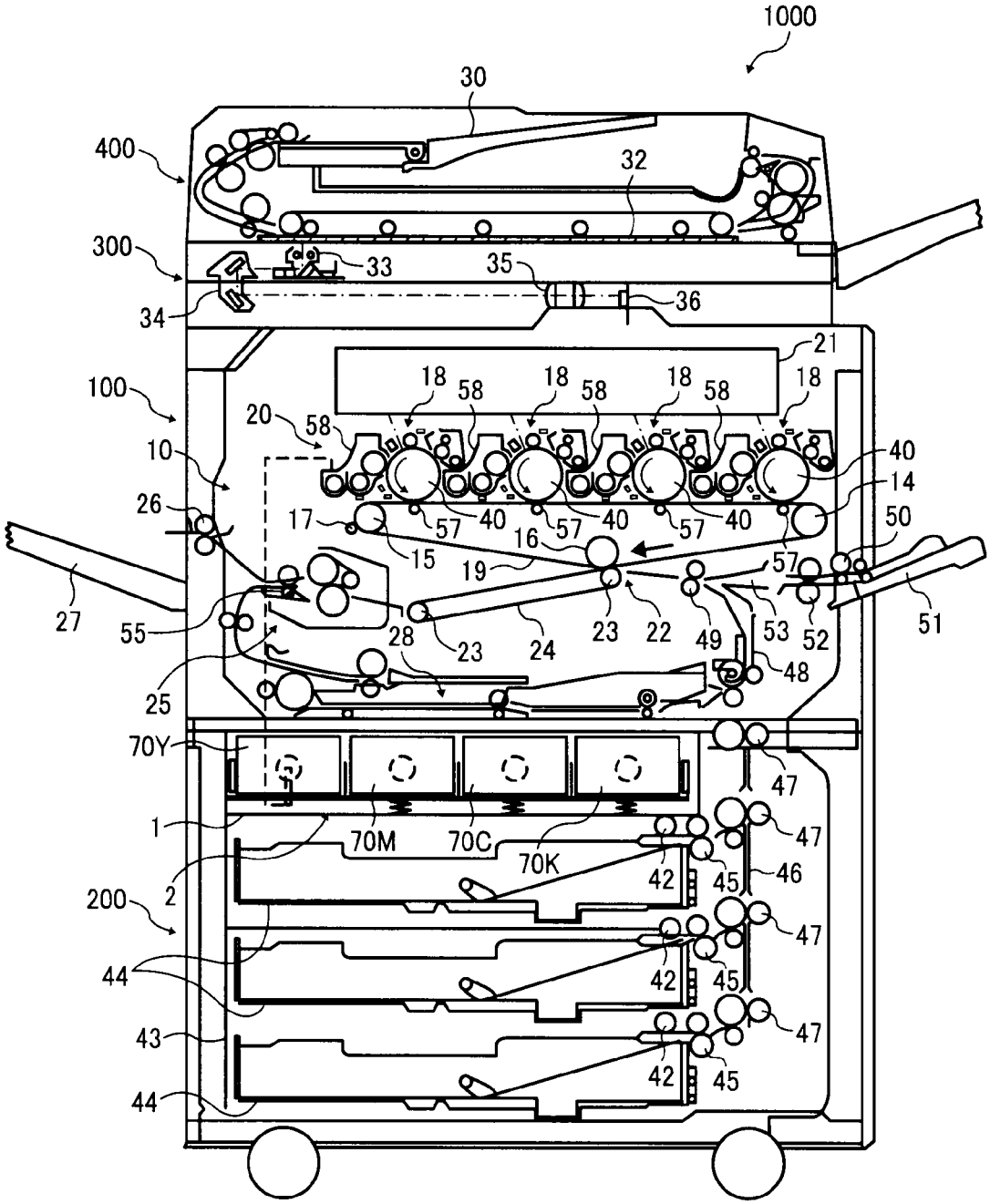
FIG. 2 is a schematic configuration of the image forming apparatus of FIG. 1.

FIGS. 1 and 2 illustrate schematic views of an image forming apparatus 1000 according to an exemplary embodiment of the present invention. The image forming apparatus 1000 is a color copier for forming color images and includes a main body 100 located at the center thereof, a sheet feeding mechanism 200 that is shaped as a table and is located below the main body 100, a scanner 300 that is located above the main body 100, and an automatic document feeder (ADF) 400 that is located above the scanner 300. The sheet feeding mechanism 200 is connected to the main body 100 and a most part thereof forms the main body 100. Even though the sheet feeding mechanism 200 is a table-shaped separate unit in this exemplary embodiment, it can also be incorporated in the main body 100.

The sheet feeding mechanism 200, which is formed as a part of the main body 100 in this exemplary embodiment, includes a tray 1 that serves as a drawer. The tray 1 holds at least one toner container 70 (70Y, 70M, 70C, and 70K) that serves as a medium container. Although the tray 1 of this exemplary embodiment is located in the sheet feeding mechanism 200, it can also be located in the main body 100. Details of the tray 1 are described below.

As illustrated in FIG. 2, the main body 100 includes multiple supporting rollers 14, 15, and 16, and an intermediate transfer belt 19 that serves as an image carrier. The intermediate transfer belt 19 includes a deformable material in an endless loop and is looped over the multiple supporting rollers 14, 15, and 16. The intermediate transfer belt 19 is rotated with one of the multiple supporting rollers 14, 15, and 16, which is driven by a driving unit that is not illustrated. As the one of the multiple supporting rollers 14, 15, and 16 rotates the intermediate transfer belt 19 in a clockwise direction as indicated by arrow in FIG. 2, the other are rotated with the one of the multiple supporting rollers 14, 15, and 16. Image forming units 18 of yellow (Y), magenta (M), cyan (C), and black (K) are located adjacent to each other in contact to the upper surface thereof along an upper surface of the intermediate transfer belt 19 that is rotated as above. Namely, four image forming units 18 having different colors from each other are disposed on the upper surface of the intermediate transfer belt 19 extended between the supporting roller 14 and the supporting roller 15, which forms a tandem-type image forming mechanism 20.

Each of the four image forming units 18 includes a photoconductor drum 40 that serves as an image carrier disposed in contact with the intermediate transfer belt 19. A charging unit, a developing unit 58, a cleaning unit, a discharging unit, and other image forming components and unit are disposed around the photoconductor drum 40. A transfer unit 57 is disposed on an inner surface of the intermediate transfer belt 19 at a position where the transfer unit 57 faces the photoconductor drum 40 with the intermediate transfer belt 19 interposed therebetween.

The four image forming units 18 are formed to have an identical configuration but include different colors of toners, which are yellow toner, magenta toner, cyan toner, and black toner. The toner serves as medium for image forming.

Further, as illustrated in FIG. 2, the main body 100 according to this exemplary embodiment further includes an optical writing unit 21 disposed above the image forming units 18. The optical writing unit 21 emits an optical-electrical modulated laser light beam to irradiate the surface of the photoconductor drum 40 between the charging unit and the developing unit 58. The optical writing unit 21 can be provided to each of the image forming units 18. Alternatively, the optical writing unit 21 can be a common unit to the image forming units 18 to reduce cost of the image forming apparatus 1000.

A secondary transfer unit 22 is provided below the intermediate transfer belt 19 on the opposite side of the tandem-type image forming mechanism 20. Namely, the secondary transfer unit 22 and the tandem-type image forming mechanism 20 are disposed with the intermediate transfer belt 19 interposed therebetween.

The secondary transfer unit 22 includes multiple rollers 23 and an endless, secondary transfer belt 24. The secondary transfer belt 24 is looped over the multiple rollers 23 to press contact the supporting roller 16 via the intermediate transfer belt 19.

Further, as illustrated in FIG. 2, a fixing unit 25 is disposed on the left side of the secondary transfer unit 22 so that a toner image transferred onto a sheet is fixed to the sheet by the fixing unit 25.

The secondary transfer unit 22 conveys the sheet with an unfixed toner image to the fixing unit 25. Alternatively, a non-contact charger can be employed as the secondary transfer unit 22. When the non-contact charger is used, a sheet conveyance unit is required to convey a sheet with an unfixed image to the fixing unit 25. In the configuration illustrated in FIG. 2, the main body 100 of the image forming apparatus 1000 further includes a sheet reverse unit 28 disposed below the secondary transfer unit 22 and the fixing unit 25 and parallel to the tandem-type image forming mechanism 20. The sheet reverse unit 28 reverses the sheet for forming another toner image on the other side of the sheet.

When printing copies by the above-described image forming apparatus 1000 that corresponds to a color copier, a user sets an original document on a document table 30 on the ADF 400 or opens the cover of the ADF 400 to place on a contact glass 32 and closes the cover to fix the position of the original document.

When the original document is set on the document table 30 on the ADF 400, when a start button, not illustrated, is pressed, the original document is conveyed to the contact glass 32 and then the scanner 300 is started to move a first moving member 33 and a second moving member 34. The first moving member 33 emits a light beam from a light source and further reflects the light reflected on the surface of the original document to the second moving member 34. The mirror of the second moving member 34 reflects the light toward an image forming lens 35. The reflected light passes through the image forming lens 35 to reach an image data reading sensor 36. Thus, the image data of the original document is read.

By pressing the start button, a signal is transmitted to start rotating the intermediate transfer belt 19. At the same time, each of the image forming units 18 rotates the photoconductor drum 40 to form respective single toner images of yellow, magenta, cyan, and black on the surfaces of the photoconductor drums 40. As the intermediate transfer belt 19 rotates, the respective single toner images are transferred onto the surface of the intermediate transfer belt 19 to form a composite color toner image.

Further, by pressing the start button, another signal is transmitted to the sheet feeding mechanism 200 to start its operations. Specifically, according to the signal, one of sheet feeding rollers 42 is selectively rotated to feed a sheet from a sheet stack accommodated in one of sheet cassettes 44 provided to a paper bank 43. A pick-up roller 45 picks up sheets one by one from the sheet stack to be conveyed to a sheet feeding path 46. The sheet picked up by the pick-up roller 45 is further conveyed to a sheet conveyance path 48 in the main body 100 by a sheet conveying roller 47 until the sheet abuts against a pair of registration rollers 49 and stops there. When the user selects a manual sheet feeder 51, a sheet feeding roller 50 is rotated to feed sheets from the manual sheet feeder 51. A sheet from a sheet stack placed on the manual sheet feeder 51 is picked up one by one by a pick-up roller 52 and conveyed to a manual sheet feeding path 53 and further to the pair of registration rollers 49 to contact and stop there.

In synchronization with movement of the intermediate transfer belt 19 having the composite color toner image on the surface thereof, the pair of registration rollers 49 rotates to convey the sheet to a secondary transfer nip formed between the intermediate transfer belt 19 and the secondary transfer unit 22, so that the composite color toner image can be transferred onto the sheet to form a full-color toner image on the sheet. The sheet with the full-color toner image thereon is conveyed by the secondary transfer unit 22 to the fixing unit 25. After the fixing unit 25 fixes the transferred image onto the sheet by application of heat and pressure, a switching claw 55 guides the sheet to a sheet direction via a pair of sheet discharging rollers 26 to a sheet discharging tray 27 where the sheet is discharged and stacked.

When further printing the back side of the sheet, the switching claw 55 switches a direction of the sheet to the sheet reverse unit 28. In the sheet reverse unit 28, the sheet is reversed and conveyed to the transfer nip where another composite color toner image is formed on the back side of the sheet, and the sheet is then discharged by the pair of sheet discharging rollers 26 to the sheet discharging tray 27.

After the toner image is transferred onto the sheet, an intermediate transfer belt cleaning unit 17 removes residual toner remaining on the surface of the intermediate transfer belt 19 for preparing for a subsequent printing operation.

Further, the image forming apparatus 1000 includes a toner supplying device 10 that serves as a medium supplying unit.

Figure 3:
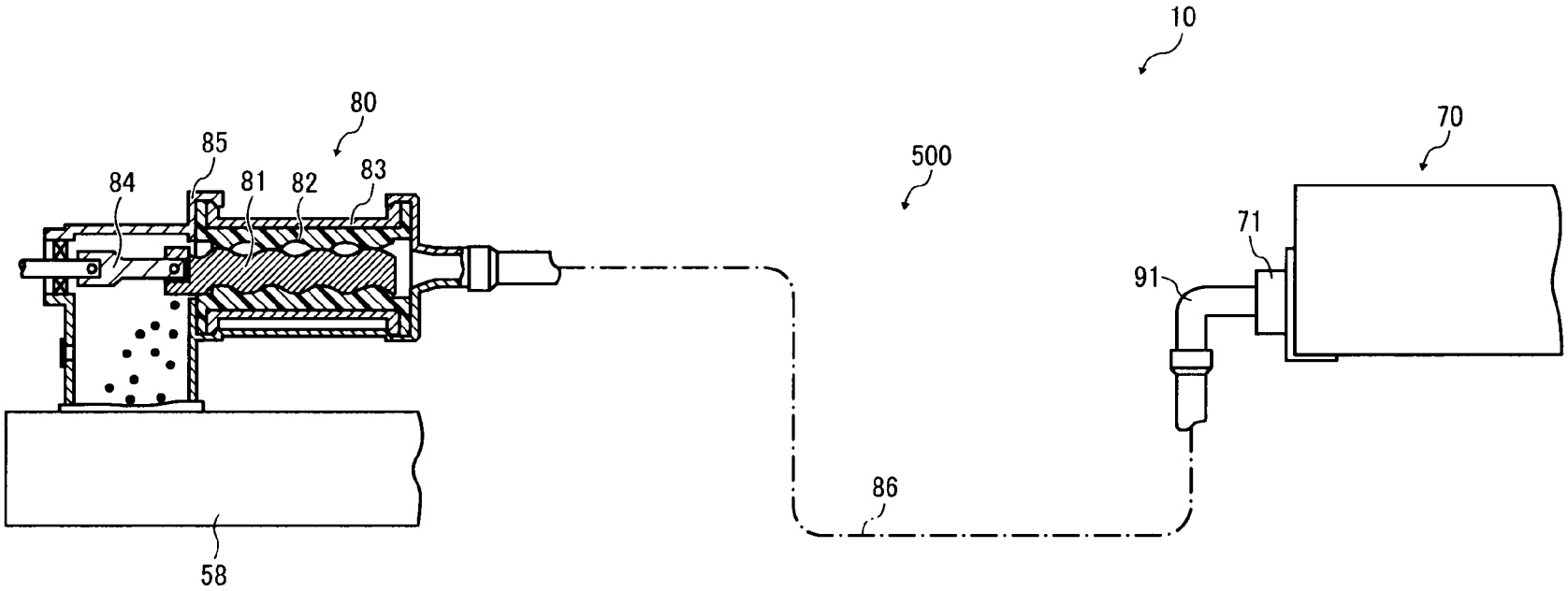
FIG. 3 is an enlarged view of a schematic configuration of a medium transfer unit.

FIG. 3 illustrates a schematic configuration of the toner supplying device 10 according to an exemplary embodiment of the present invention.

As illustrated in FIG. 3, the toner supplying device 10 includes the developing unit 58, a single-shaft eccentric screw pump 80, a toner tube 86, and the toner container 70. One end of the toner tube 86 is connected to the single-shaft eccentric screw pump 80 and the other end is connected to the toner container 70.

The developing unit 58 accommodates a two-component developer in which toner (toner particles) and magnetic carrier (carrier particles) are mixed therein. The toner in the developing unit 58 serves as medium to be consumed for image forming, and therefore needs to be supplied accordingly. Various methods have been proposed to control toner supplying operations. For example, a sensor is used to detect a mix ratio of toner and carrier and/or density of pattern images formed on the surface of the photoconductor drum 40 and, a signal for supplying toner is transmitted based on detection results.

The single-shaft eccentric screw pump 80 (hereinafter, a powder pump 80) is disposed above the developing unit 58. The powder pump 80 is one of various types of medium transport pumps and serves as a toner receiving unit to receive toner from the toner container 58.

The powder pump 80 includes an external thread type rotor 81, an internal thread type stator 82, a holder 83, a drive shaft 84, and a case 85. The stator 82 has a double-pitch spiral groove formed by an elastic material such as a rubber material. The rotor 81 is formed by a material such as metal, resin, and so forth and is rotatably fit into the stator 82. The rotor 81 is connected to the drive shaft 84 by a spring pin and the like and rotates as the drive shaft 84 rotates. The stator 82 is covered by the holder 83 that is fixed to the case 85. A space is formed between an inner circumference of the holder 83 and an outer circumference of the stator 82.

The toner supplied to the developing unit 58 is contained in the toner container 70, and communicates between the powder pump 80 and the toner container 70 via a toner tube 86 that serves as a tubular member defining a toner supplying path between the powder pump 80 and the toner container 70. The powder pump 80 and the toner tube 86 form a medium transport unit 500.

The toner tube 86 can be any pipe-shaped member having a length of slack that is greater than a distance in which the tray 1 is pulled out from the main body of the image forming apparatus 1000. It is more preferable that the toner tube 86 is an elastic member, i.e., a flexible tube, so that the positional relation between the toner container 70 and the developing unit 58 is less regulated, and therefore the flexibility in design of layout of the image forming apparatus 1000 increases significantly.

Preferable examples of the flexible tube for the toner tube 86 are rubber materials that can provide good toner resistance such as polyurethane rubber, nitrile rubber, and EPDM.

The toner container 70 is connected to one end of the toner tube 86 as described above, and includes a cap fitting 71 and a medium receiving nozzle 91. The cap fitting 71 serves as a medium transport unit and is fitted to the medium receiving nozzle 91 that serves as a medium receiving unit.

The powder pump 80 of FIG. 3 is mounted on the developing unit 58 but is not limited thereto. For example, the powder pump 80 can be located at any position in the middle of the toner tube 86, that is, close to the medium receiving nozzle 91 and the tray 1. In other words, the middle of the toner tube 86 includes the developing unit 58 and the tray 1.

In the toner supplying device 10 having the configuration as described above, as the toner contained in the developing unit 58 is consumed, the powder pump 80 rotates to generate a suction pressure. The suction pressure is transmitted via the toner tube 86 to the toner container 70, so that the toner can pass through the toner tube 86, the medium receiving nozzle 91, and the toner tube 86, and enters the powder pump 80 to be supplied to the developing unit 58. At this time, if a toner conveyance path from the powder pump 80 to the toner container 70 is substantially sealed hermetically, the suction pressure can be transmitted to the toner without being leaked to outside the toner conveyance path.

In this exemplary embodiment illustrated in FIG. 3, the toner supplying device 10 is explained in singular. However, in reality, more than one toner supplying device 10 is provided in the image forming apparatus 1000 and each of the toner supplying devices 10 is disposed between the medium container 70, i.e., medium containers 70Y, 70M, 70C, and 70K, and the developing unit 58 of each toner color. The toner supplying devices 10 have a configuration identical to each other and the toner containers 70 also have a configuration identical to each other. Therefore, the suffixes indicating the toner colors, which are "Y" for yellow toner, "M" for magenta toner, "C" for cyan toner, and "K" for black toner, are omitted. In FIG. 2, only the toner supplying device 10 for the yellow toner is illustrated and the others are omitted to make the figure simpler.

According to the configuration of the toner supplying device 10 illustrated in FIG. 3, the powder pump 80 and the toner tube 86 enable the toner to be transported from the toner container 70 even if the toner container 70 is located away from the developing unit 58. This configuration can flexibly locate the toner container 70 in the image forming apparatus 1000, thereby avoiding an inconvenient layout for the toner container 70 to reduce a load to a user when replacing the toner container 70 and to set a large toner container 70 to the tray 1.

Further, since the toner tube 86 has some slack in the length, the cap fitting 71 and the medium receiving nozzle 91 that is mounted on the tray 1 can remain connected to each other even when the tray 1 is pulled out and pushed into the main body of the image forming apparatus 1000. This configuration can prevent the toner leakage.

As a medium transport pump, a known diaphragm pump may be employed instead of a single-shaft eccentric screw pump.

Figure 11:
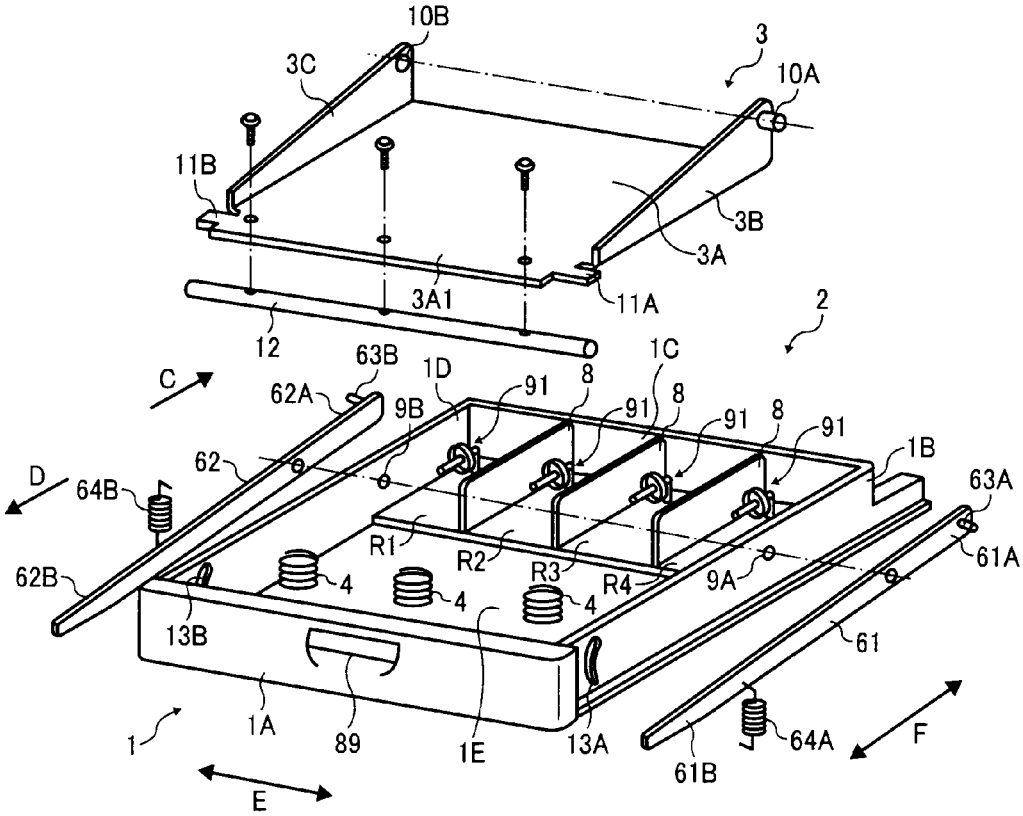
FIG. 11 is an exploded perspective view of a schematic configuration of the tray for holding and setting the medium containers and a medium transport facilitator.

Next, a description is given of a detailed configuration of the image forming apparatus 1000 according to an exemplary embodiment of the present invention, with reference to FIG. 11.

The image forming apparatus 1000 according to an exemplary embodiment of the present invention is a color copier as described above, and includes the tray 1, the medium receiving nozzle 91, and a medium transport facilitator 2 (see FIG. 2).

The tray 1 is movable between a tray open position in which the tray 1 is pulled out from the main body 100 and a tray set position in which the tray 1 is pushed into the main body 100. The tray 1 can store the medium containers 70Y, 70M, 70C, and 70K with yellow toner, magenta toner, cyan toner, and black toner contained therein, respectively.

The medium receiving nozzle 91 is disposed on the inward side, which is the tray set position side, of the tray 1, and is fitted to the cap fitting 71 that is mounted on each of the medium containers 70Y, 70M, 70C, and 70K.

The medium transport facilitator 2 contacts the medium containers 70Y, 70M, 70C, and 70K held on the tray 1 from the bottom side to move the toner contained in each of the medium containers 70Y, 70M, 70C, and 70K toward the cap fitting 71.

The medium receiving nozzle 91 and the medium transport facilitator 2 are mounted on the tray 1.

Figure 5:
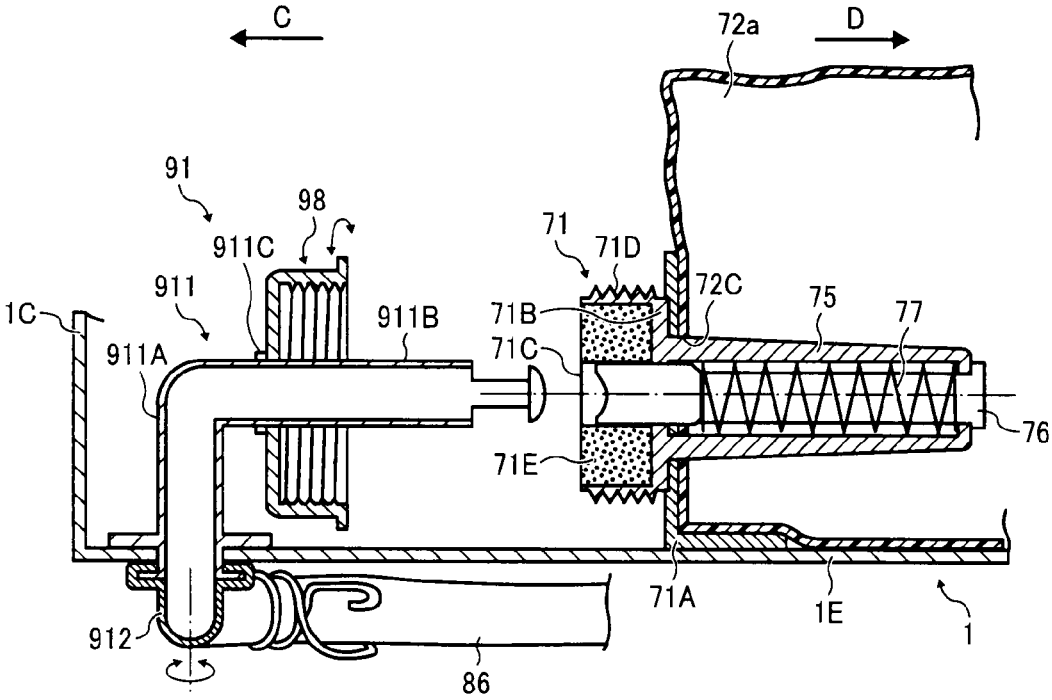
FIG. 5 is an enlarged view of a part of a configuration of the medium container and a medium receiving unit.

The tray 1 is surrounded on all four sides by side walls 1A, 1B, 10, and 1D as illustrated in FIG. 1 and is supported by a bottom plate 1E (as illustrated in FIG. 5). As illustrated in FIG. 1, only the upper part of the tray 1 is open. The tray 1 is removably provided to the main body 100 and can be inserted horizontally with respect to a tray storage space 101 that extends horizontally in the main body 100. Arrow "C" indicates a tray closing direction to close the tray 1 by inserting it into the tray storage space 101 to the tray set position, arrow "D" indicates a tray opening direction to open the tray 1 by pulling it out from the tray storage space 101, and arrow "F" indicates a tray moving direction of the tray 1. A recessed drawer pull 89 where an operator M puts his/her hand to pull out the tray 1 is arranged on the side wall 1A disposed in the tray opening direction D (i.e., the front of the tray 1). According to this exemplary embodiment, a side having the side wall 1A where the recessed drawer pull 89 is formed is defined as a "tray outward side" and another opposite side where the side wall 10 stands is defined as a "tray inward side". Further, a direction that runs between the side wall 1B and the side wall 1D is defined as a tray width direction "E" that extends perpendicular to the tray opening direction D on a plane view.

The interior of the tray 1 is illustrated in FIG. 11. As illustrated in FIG. 11, the tray 1 is divided into four sections, R1, R2, R3, and R4, by partitions 8 on the tray inward side. The sections R1, R2, R3, and R4 hold the leading ends of the medium containers 70Y, 70M, 70C, and 70K, respectively, and include the medium receiving nozzles 91 for each one of the medium containers 70. The medium receiving nozzles 91 are disposed at respective positions where the operator M facing the front side of the main body 100 can see the toner receiving muzzles 91 from above (where the toner receiving nuzzles 91 are exposed from below the main body 100) when the tray 1 is pulled out of the main body 100.

Since the image forming apparatus 1000 according to this exemplary embodiment can produce a full-color image, the four medium containers 70Y, 70M, 70C, and 70K are stored in the tray 1. However, when a monochrome image forming apparatus is employed, only the toner container 70K that contains black toner is stored or set in the tray 1, which can reduce the size of the tray 1 in the tray width direction E. Therefore, when the monochrome image forming apparatus is employed, the medium container 70K can be stored in a surplus space of the tray 1 that accommodates a small-size sheet as a shared tray. Since the configurations of the medium containers 70Y, 70M, 70C, and 70K are identical, the suffixes indicating the toner colors, which are "Y" for yellow toner, "M" for magenta toner, "C" for cyan toner, and "K" for black toner, are omitted.

Figure 4:
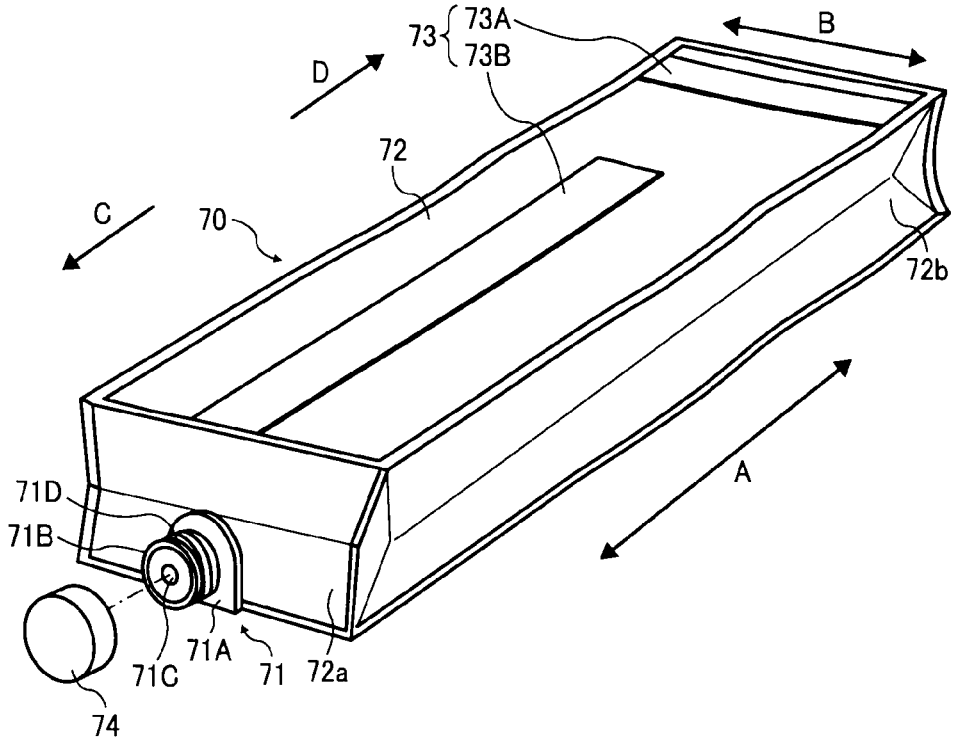
FIG. 4 is a perspective view of a medium container according to an exemplary embodiment of the present invention.

As illustrated in FIG. 4, the toner container 70 includes the cap fitting 71, a container body 72, a strap 73, and a cap 74.

At least a part of the container body 72 includes a bag-like deformable material so that the container body 72 assume to be a rectangular-shaped member when full of toner is contained.

The cap fitting 71 is connected to the medium receiving nozzle 91 disposed on the tray inward side in the vicinity of the side wall 10 of the tray 1 of the main body 100.

Figure 6:
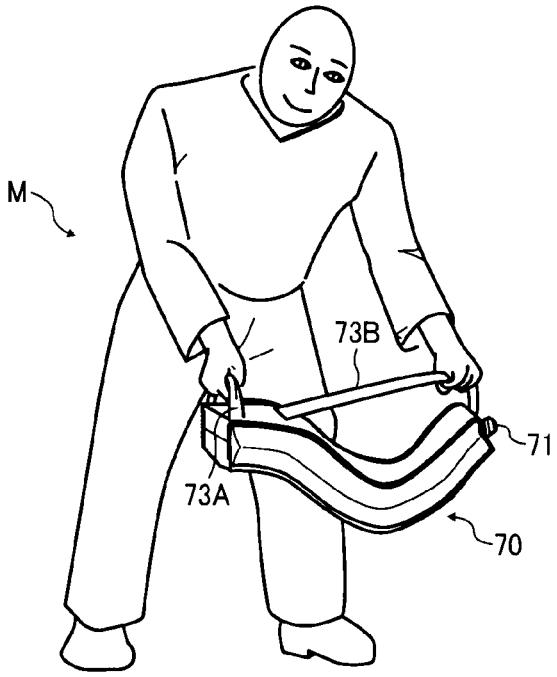
FIG. 6 is a view for explaining an example of how to carry a medium container with straps.
Figure 7:
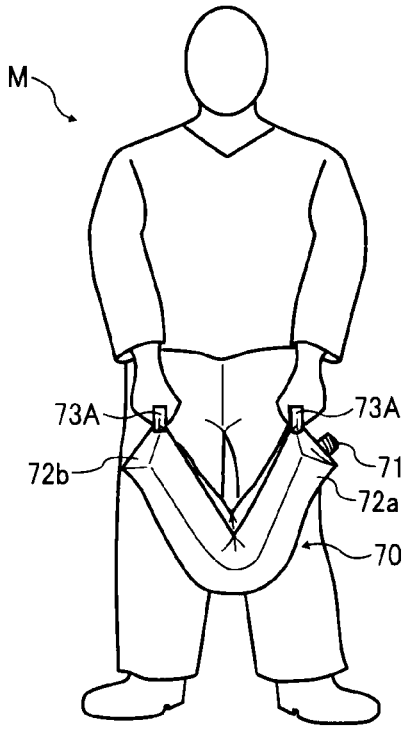
FIG. 7 is a view for explaining another example of how to carry a medium container with straps different from the medium container of FIG. 6.
Figure 8:
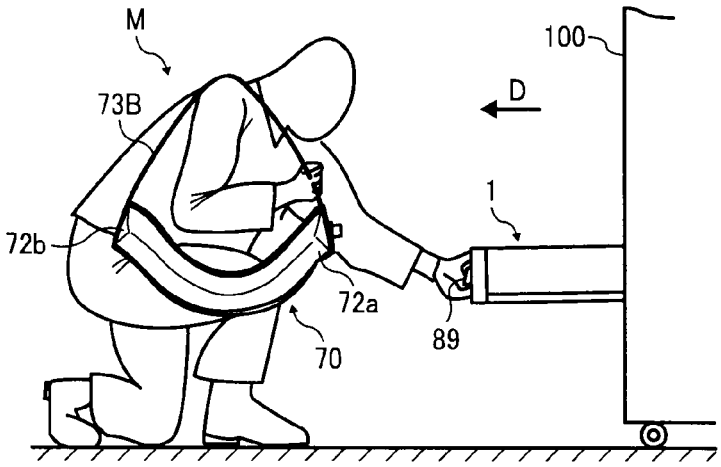
FIG. 8 is a view for explaining yet another example of how to carry a medium container with straps different from the medium containers of FIGS. 6 and 7.

The strap 73 serves as a grip portion that is mounted on the container body 72 and held or slung over the shoulder by the operator M as illustrated in FIG. 6 through FIG. 8.

The cap 74 prevents toner scattering by being fixedly attached to the cap fitting 71 when the toner container 70 is not fitted to the toner receiving nozzle 91. The cap 74 is removed when the toner container 70 is installed in the tray 1. As described above, arrow "A" in FIG. 4 indicates a longitudinal direction of the toner container 70 and arrow "B" in FIG. 4 indicates a width direction of the toner container 70 in FIG. 4.

As shown in FIG. 4, the cap fitting 71 is mounted on a leading end 72*a* that is one end portion of the container body 72 (i.e., the leading end of the medium container 70). The cap fitting 71 includes a base portion 71A that is L-shaped in cross-section, a cylindrical portion 71B formed on the base portion 71A, a toner outlet port 71C formed in the top center of the cylindrical portion 71B, and external threads 71D formed around an outer surface of the cylindrical portion 71B. The external threads 71D engage internal threads formed in an inner surface of the cap 74.

As shown in FIG. 5, the leading end 72*a* of the container body 72 is a side face of the medium container 70 to be positioned on the tray 1 in the tray closing direction C when the medium container 70 is set in the tray 1. The leading end 72*a* of the container body 72 includes an opening 72C therein. The cap fitting 71 is fixedly mounted on the leading end 72*a* so that the toner outlet port 71C is aligned with the opening 72C.

A valve case 75 is included in the cap fitting 71 and is inserted into the toner outlet port 71D. The valve case 75 includes two rails that extend from a bottom part of the cylindrical portion 71B and rings, each of which fits the bottom part of each rail and a free end that is opposite the bottom part. Inside the valve case 75, a valve 76 is inserted to open and close the toner outlet port 71C. More specifically, the valve 76 is disposed in the toner outlet port 71C and includes a cylindrical plug having a diameter greater than the diameter of the toner outlet port 71C by 0.5 mm to 1.0 mm, a cylinder having a diameter smaller than the diameter of the plug, a rod that is supported by inserting an end opposite the plug into the ring, and a rod end located at the leading end of the rod having a flange greater than the diameter of the ring. The valve 76 is supported for reciprocal (back and forth) motion and inserted into the rod. The valve 76 is biased by a compression coil spring 77 to a direction to close the opening 72C that compresses the valve 76 between the plug and the ring.

When the medium receiving nozzle 91 is inserted from the toner outlet port 71C, the valve 75 is pressed by the leading end of the medium receiving nozzle 91 into the container body 72 to open the opening 72C. Then, the toner supplying device 10 is operated under this condition to suction and transport the toner contained in the container body 72.

As illustrated in FIG. 5, a sealing member 71E that includes a foam material such as a sponge is provided to the cap fitting 71 to avoid any gap or space between the cap fitting 71 and the medium receiving nozzle 91 when the medium receiving nozzle 91 is inserted thereto and to hermetically close the medium container 70 by the plug of the valve 76 before the medium container 70 is set in the tray 1.

The straps 73 illustrated in FIG. 4 include a first strap 73A and a second belt 73B. The first strap 73A is attached to a trailing end 72*b* of the container body 72 of the toner container 70, which is opposite the leading end 72*a* in the toner container longitudinal direction A. The second belt 73B is attached to the container body 72 from the leading end 72*a* toward the trailing end 72*b* along the longitudinal direction A of the toner container 70.

The first strap 73A is a short strap that extends in the width direction B of the toner container 70, and both ends of the first strap 73A are fixed to the container body 72. The second belt 73B is a long strap that extends in the longitudinal direction A of the toner container 70, and one end thereof is fixed to the leading end 72*a* of the container body 72 and the other end thereof is fixed to the trailing end 72*b* thereof.

The cap fitting 71 includes resin material such as polystyrene, high-impact polystyrene, polypropylene, PET, and ABS or metallic material. If the cap fitting 71 includes a same material as that used for the bag part of the container body 72, both the cap fitting 71 and the container body 72 can easily adhere to each other and reuse through material recycling.

As example materials of the container body 72, the first strap 73A and the second belt 73B, a resin sheet that includes polyester resin, polyethylene resin, polyurethane resin, polypropylene resin, or nylon, and a paper sheet can be used.

Example of the toner container 70 can include a single-layer material or a material having multiple layers of different types of materials. Further, the toner container 70 can include a resin-coated paper such as a milk carton. When the toner container 70 includes a multi-layer material, one layer can be an aluminum layer to effectively achieve moisture-proof packing, and therefore prevent moisture from the toner in the toner container 70.

When the toner container 70 employs a two-layer resin material, it is preferable that the resin material is unbreakable due to mechanical stress applied from outside, and, for example, that the inner part of the toner container 70 is formed by a deformable material such as polyethylene resin and the outside is formed by a rigid material such as nylon resin.

Further, an aluminum sputtering process can be performed to a deformable material or an antistatic agent is included in the deformable material so as to prevent the buildup of electrostatic charge. The aluminum sputtering process can also be used to prevent moisture of the toner as described above. The thickness of the deformable material is not limited. However, if the deformable material is too thick, it becomes less flexible. By contrast, if the deformable material is too thin, the portion where toner is contained becomes slack and the toner cannot be transported smoothly. Accordingly, the thickness of the deformable material is preferably in a range of from approximately 20 μm to approximately 200 μm, and more preferably a range of from approximately 80 μm to approximately 150 μm.

The container body 72 can be with seam or without seam. The container body 72 with seam is formed by adhering multiple deformable materials through a heat sealing process to form a predetermined shape of the toner container 70. When the deformable material includes plastic resin, the seamless container body 72 can be formed in a predetermined shape by casting through a tube extrusion process. As previously described, the container body 72 can be formed by a deformable material entirely or can partly include a rigid material.

The toner container 70 having the above-described deformability has good recycling efficiency but low rigidity. Therefore, the shape of the toner container 70 is not fixed, and it is difficult for the operator M to carry the toner container 70 when placing and setting the toner container 70. However, the toner container 70 according to an exemplary embodiment includes a grip portion such as the straps 73, and therefore the operator M can carry the deformed toner container 70 and set the toner container 70 to the tray 1 easily.

Namely, when handling the toner container 70, the operator M can carry the toner container 70 by grabbing the first strap 73A and the second belt 73B attached to both ends along the longitudinal direction A of the toner container 70 in a half-crouching position, as illustrated in FIG. 6. Therefore, the operator M can carry the toner container 70 even though a large capacity of toner of substantially 2 litters, for example, is contained in the toner container 70.

From a view of toner transportation, an appropriate amount of air needs to be contained to increase the toner flowability and decrease the density. However, the capacity of the toner container 70 may further increase in size. Consequently, it becomes difficult for the operator M to carry the toner container 70 with a flabby, unfixed shape.

To address this disadvantage, the first strap 73A and the second belt 73B are provided on the container body 72 of the toner container 70 so any user such as the operator M can carry the toner container 70 easily. Specially, the operator M can achieve both good conveying performance and good setting performance of the toner container 70 by shifting a position of grabbing the first strap 73A that is a long strap when carrying the toner container 70 and setting the cap fitting 71 to the medium toner receiving nozzle 91 in the tray 1. That is, when setting the toner container 70 in the tray 1, the operator M may hold the toner outlet port 71C of the cap fitting 71.

The location of the strap 73 is not limited to the arrangement and combination of the long belt 73A and the short belt 73B, as illustrated in FIG. 6. For example, as illustrated in FIG. 7, two short belts 73A are provided in the vicinity of the leading end 72*a* and the trailing end 72*b* of the toner container 70. Specifically, the strap 73 of FIG. 7 includes one short belt 73A at the leading end 72*a* and the other belt 73A at the trailing end 72*b* in the longitudinal direction A of the container body 72 of the toner container 70. Even though the toner container 70 having deformable material is good in recycling efficiency and difficult in carrying due to the unfixed shape, the operator M can easily carry the toner container 70 with deformation and increase in capacity by providing the belts 73A at both ends of the toner container 70. Accordingly, the operator M can set the toner container 70 to the tray 1 in the image forming apparatus 1000 easily. Further, the operator M can use the deformability of the toner container 70 to carry the toner container 70 easily by buckling the toner container 70 extending in the longitudinal direction thereof in the middle to about shoulder-width apart and with the elbow in full extension.

As another example of the strap 73, the toner container 70 can have one long strap, which corresponds to the belt 73B, as illustrated in FIG. 8. In this case, one end of the belt 73B is fixed to the leading end 72*a* of the container body 72 and the other end of the belt 73B is fixed to the trailing end 72*b* of the container body 72.

Figure 15A:
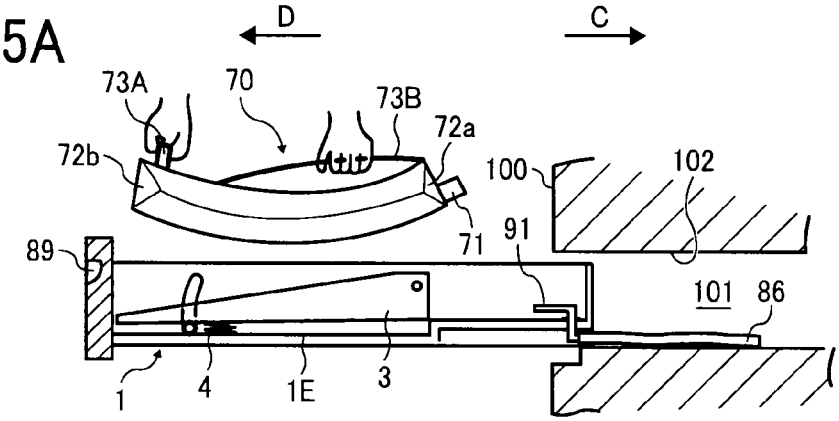
FIG. 15A is a view for explaining a state in which the tray is pulled to a tray open position to set the medium container into the tray.
Figure 15B:
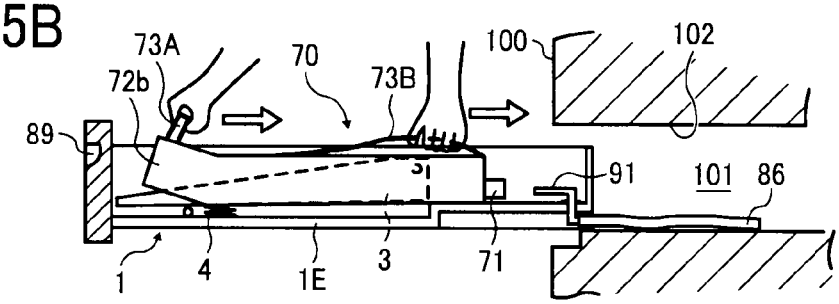
FIG. 15B is a view for explaining a state in which the medium container is mounted in the tray.

The toner container 70 having the above-described structure is good in recycling efficiency, has low rigidity, and is difficult in carrying due to the unfixed shape. However, by fixing both ends of the belt 73B to the both ends in the longitudinal direction of the toner container 70, the operator M can easily carry the toner container 70 on his or her shoulder even if the toner container 70 is deformable or has a large capacity or heavy weight. In addition, since the operator M can use one hand that does not hold the toner container 70 freely, the operator M does not have to put the toner container 70 down on the floor when pulling out the tray 1 from the main body 100, and therefore can put the toner container 70 in the tray 1 easily. Further, when setting the toner container 70 in the tray 1, the operator M can grab the belt 73B at both ends thereof to shift the toner container 70 while putting up the trailing end 72*b* thereof in the tray 1 and position the cap fitting 71 on the leading end 72*a* of the container body 72 to the medium receiving nozzle 91, as illustrated in FIGS. 15A and 15B. The operator M also can carry the toner container 70 illustrated in FIG. 6 with the belt 73B on the shoulder. If necessary, the belt 73B can be separated in two to have a buckle part to adjust the length of the belt 73B like a waist belt and multiple holes through which a pin of the buckle to thread, so that the length of the belt 73B can be adjusted between when the operator M puts the belt 73B on the shoulder and when the operator M sets the toner container 70 in the tray 1.

Next, a description is given of a structure of the medium receiving nozzle 91.

As illustrated in FIG. 11, the four medium receiving nozzles 91 are disposed on the tray inward side in the tray closing direction C of the tray 1 so that each of the medium receiving nozzles 91 can be fitted to the toner container 70 of each toner color. Since the structures of the medium receiving nozzles 91 are identical, a description is given of the structure of only one medium receiving nozzle 91, with reference to FIG. 5.

As illustrated in FIG. 5, the medium receiving nozzle 91 includes a nozzle body 911 and a joint portion 912. The nozzle body 911 is located on the connecting side where the nozzle body 911 projects from the bottom plate 1E serving as a container loading face of the tray 1 to be engaged with the cap fitting 71. The joint portion 912 is located outside the bottom plate 1E, which is the opposite side of the nozzle body 911 with the bottom plate 1E interposed therebetween, and is rotatably supported with respect to the nozzle body 911.

The nozzle body 911 is fixed to the bottom plate 1E and includes a basal portion 911A and the inserting portion 911B. The basal portion 911A is a pipe-shaped member and stands substantially vertically to the bottom plate 1E. The inserting portion 911B is bent at a substantially right angle to the basal portion 911A and supported in a horizontal direction.

The joint portion 912 is a so-called nip, to which an end portion of the toner tube 86 is inserted and retained by a rubber band or the like.

The inserting portion 911B is disposed facing the tray opening direction D. A cap 98 is disposed as a fitting portion to fit to the cap fitting 71. The inserting portion 911B is formed to pass through the cap 98. The cap 98 is rotatably fixed circumferentially around the inserting portion 911B. Stoppers 911C are disposed sandwiching the cap 98 to regulate the position of the cap 98 in the tray closing direction C. The cap 98 has a diameter of the same size as the diameter of the cap 74 attached to the toner container 70 before being set in the tray 1 and includes an internal thread formed on the inner circumference thereof.

With this configuration, the toner container 70 can be fixedly set in the tray 1 by placing the toner container 70 in the tray 1, sliding it in the tray closing direction C, connecting the inserting portion 911B to the toner outlet port 71C of the cap fitting 71, and screwing the cap 98 to the external thread 71D.

According to the above-described structure of the medium receiving nozzle 91, even if the toner container 70 comes off the medium receiving nozzle 91 when the toner is pressed in the medium receiving nozzle 91 by a push-up member 3, which is described later, the cap fitting 71 remains connected with the cap 98 in the tray 1. Therefore, toner scattering caused by disconnection of the toner container 70 from the medium receiving nozzle 91 can be prevented.

Further, since the joint portion 912 is rotatably supported, when the tray 1 is pushed to the tray set position, the slack toner tube 86 is not pulled and tensioned by the joint portion 912. Therefore, the tray 1 can be slid smoothly with good operability.

Figure 9:
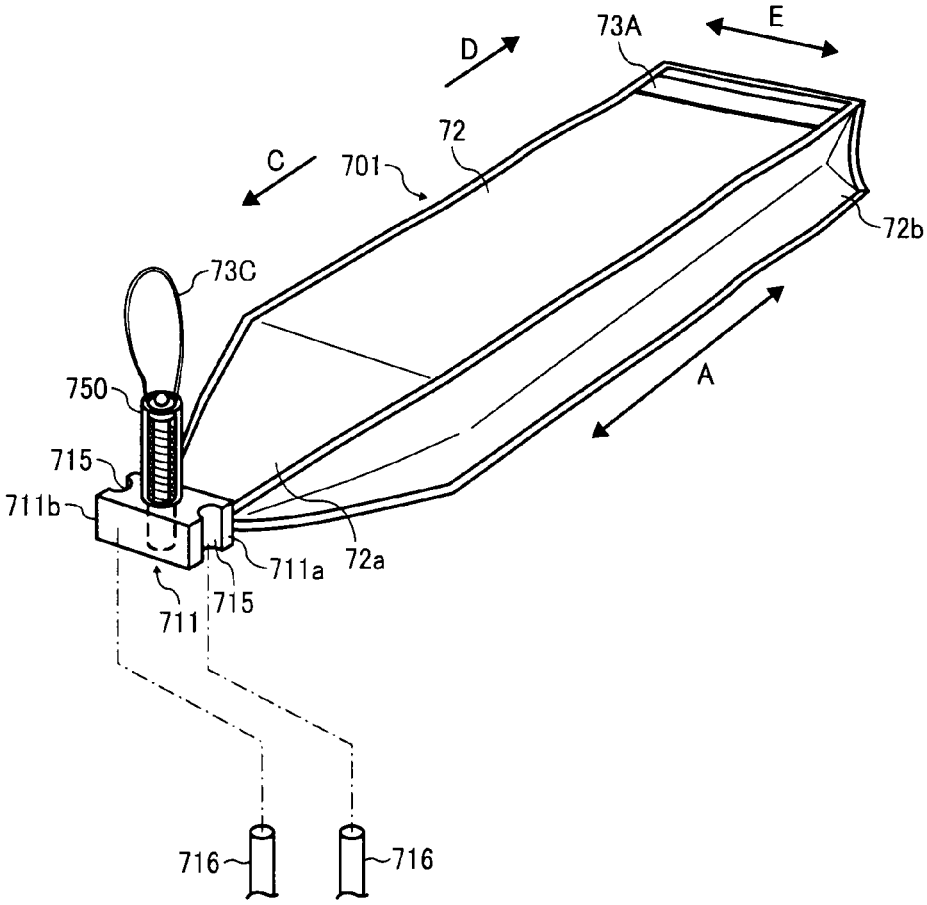
FIG. 9 is a perspective view of another medium container.
Figure 10:
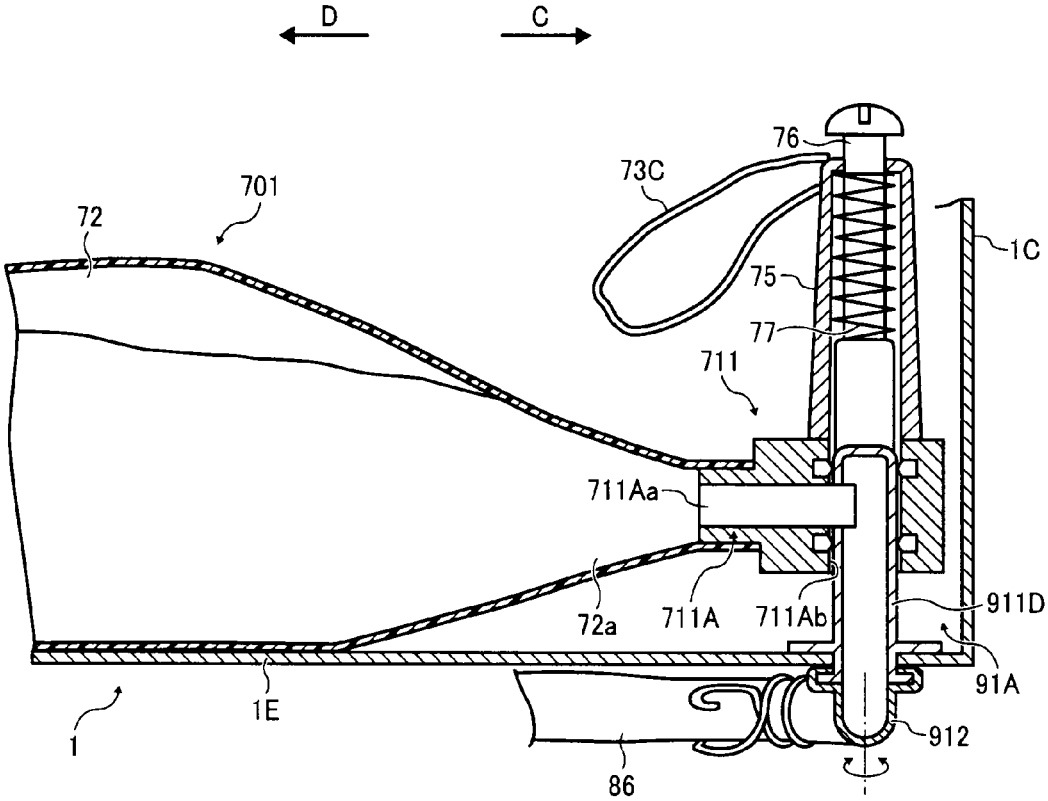
FIG. 10 is an enlarged view of a part of the configuration of the medium container of FIG. 9 and a medium receiving unit for the medium container.

Referring to FIGS. 9 and 10, a description is given of a structure of a toner container 701.

The structure of the toner container 701 is similar to that of the toner container 70, except a valve case 750 included in the toner container 701 is different in shape from the valve case 75 of the toner container 70.

The toner container 701 includes a cap fitting 711 including a toner outlet port 711A. As illustrated in FIG. 10, the outlet port 711A of the cap fitting 711 is L-shaped in cross-section and communicates with the container body 72. The valve 76 is located in a direction perpendicular to the tray closing direction C in FIG. 10 to open and close the toner outlet port 711A.

The toner outlet port 711A includes a toner guide portion 711Aa and a toner drop portion 711Ab. The toner guide portion 711Aa communicates with the container body 72, and the toner drop portion 711Ab communicates with the toner guide portion 711Aa.

In this exemplary embodiment, the toner guide portion 711Aa is oriented in a substantially horizontal direction when the tray 1 is set, and the toner drop portion 711Ab is oriented in a substantially vertical direction.

A valve case 750 is disposed above the toner drop portion 711Ab to be connected to the toner drop portion 711Ab. As noted above, the function and structure of the valve case 750 are basically identical to those of the valve case 75 illustrated in FIG. 5, except that the shape of the valve case 750 is different from the shape of the valve case 75. Specifically, while the valve case 75 extends in the longitudinal direction A of the container body 72 of the toner container 70, the valve case 750 stands in a direction perpendicular to the longitudinal direction A of the container body 72 of the toner container 70. The toner drop portion 711Ab includes the valve 76, which is same as that disposed in the container body 72 of the toner container 70 illustrated in FIG. 5. The shaft-shaped valve 76 is supported by the toner drop portion 711Ab to move vertically and is biased by the compression coil spring 77 inserted into the valve case 750 in a direction in which the toner guide portion 711Aa and the toner drop portion 711Ab are closed. An amount of stroke of the valve 76 is determined to be sufficient for communication between the toner guide portion 711Aa and a medium receiving nozzle 91A when the valve 76 is pressed by the medium receiving nozzle 91A to move upward in FIG. 10.

The toner container 701 having the above-described cap fitting 711 is accepted by the medium receiving nozzle 91A illustrated in FIG. 10. As illustrated in FIG. 10, the medium receiving nozzle 91A does not include the inserting portion 911B illustrated in FIG. 5 but includes a pipe-shaped nozzle body 911D. The nozzle body 911D is a pipe-shaped member projecting upwardly from the bottom plate 1E of the tray 1 and has an opening.

With this structure, when setting the toner container 701 to the tray 1, the nozzle body 911D is aligned with the toner drop portion 711Ab, and then the toner container 701 is mounted on the tray 1 from above. Consequently, the nozzle body 911D moves into the toner drop portion 711Ab to push up the valve 76 so that the toner guide portion 711Aa and the opening of the nozzle body 911D can communicate with each other. In this exemplary embodiment, the nozzle 911D serves as a connecting unit that projects at an angle to a medium transport direction at the connection between the container body 72 and the cap fitting 711.

When a push-up member 3, which will be described later, pushes toner inside the medium receiving nozzle 91A, the toner container 701 may be disconnected from the medium receiving nozzle 91A. When the medium receiving nozzle 91A and the cap fitting 711 are provided as described above, the cap fitting 711 and the nozzle body 911D are connected by inserting the cap fitting 711 to the nozzle body 911D and retained on the tray 1, and toner scattering caused by the disconnection of the toner container 701 from the nozzle body 911D can be prevented.

Similar to the nozzle body 911 illustrated in FIG. 5, the nozzle body 911D illustrated in FIG. 10 can include the joint portion 912 that is rotatably supported to the nozzle body 911D on the lower side of the bottom plate 1E, which is the opposite side on which the nozzle body 911D is mounted.

The toner container 701 illustrated in FIG. 10 can have the first strap 73A attached to the trailing end 72*b* of the container body 72 of the toner container 70 and a third strap 73C attached to the valve case 750. In this case, the nozzle body 911D that stands in the tray 1 can be set from above to the cap fitting 711 easily.

The cap fitting 711 further includes opposed side faces 711*a* and 711*b* and semi-circular grooves 715 formed in the side faces 711*a* and 711*b*. The side faces 711*a* and 711*b* are located along the width direction E of the tray 1 illustrated in FIG. 9. Further, the tray 1 may include positioning pins 716 that can be inserted into the grooves 715. The toner container 701 can also be positioned in the tray 1 by inserting the positioning pins 716 on the tray 1 into the grooves 715 of the cap fitting 711.

Next, with reference to FIG. 11 through FIG. 14, a description is given of a structure of the medium transport facilitator 2.

The medium transport facilitator 2 includes a push-up member 3, a compression coil spring 4, and a tray push-up control mechanism to be described in detail later, all mounted on the tray 1.

The push-up member 3 presses the container body 72 of the toner container 70 upward at the outward side of the tray 1 located opposite to the medium receiving nozzle 91 in synchronization with insertion of the tray 1 to the tray set position.

The compression coil spring 4 is an elastic member to apply a push-up force to the push-up member 3.

The tray push-up control mechanism controls movements of the push-up member 3. Namely, the tray push-up control mechanism causes a push-up operation of the push-up member 3 to remain stopped when the tray 1 moves from a maximum tray open position to the tray set position and to push up the tray 1 in cooperation with cam rails 103 disposed on the main body 100 when the tray 1 stays at the tray set position.

The push-up member 3 is disposed between a partition wall 8 at the inward side of the tray 1 and the side wall 1A at the outward side of the tray 1, and includes a base plate 3A and a pair of side plates 33 and 3C disposed along the width direction E of the base plate 3A. The toner containers 70 (i.e., the toner containers 70Y, 70M, 70C, and 70K) are mounted on the base plate 3A. The push-up member 3 may include metallic material and/or resin material and is sufficiently rigid to prevent deformation thereof due to a pressing force generated by the compression coil spring 4.

The push-up member 3 includes pins 10A and 10B formed on a common axis on the upper parts of the side plates 3B and 3C at the inward side of the tray 1. The pins 10A and 10B are rotatably inserted into support holes 9A and 9B formed on the side wall 1B and the side wall 1D of the tray 1. By inserting the pins 10A and 10B into the support holes 9A and 9B of the tray 1, the push-up member 3 can be rotated about the pins 10A and 10B, and therefore is rotatably supported on the tray 1.

The push-up member 3 further includes projections 11A and 11B formed at a trailing end 3A1 of the base plate 3A on the outward side of the tray 1. The projections 11A and 11B project in the width direction of the tray 1.

A bar 12 that extends in the width direction E of the tray 1 is fixedly attached to the base plate 3A from below the projections 11A and 11B. The bar 12 is located on the back side of the projections 11A and 11B to maintain the planarity of the base plate 3A. If the base plate 3A is sufficiently rigid without causing torsion and can support the surface on which the toner containers 70 are mounted in a planar shape only by the base plate 3A, the bar 12 can be omitted.

The projections 11A and 11B and both ends of the bar 12 are inserted into arc-shaped elongated holes 13A and 13B formed on the side walls 1B and 1D of the tray 1, respectively, to regulate a range of rotation of the push-up member 3.

Figure 13:
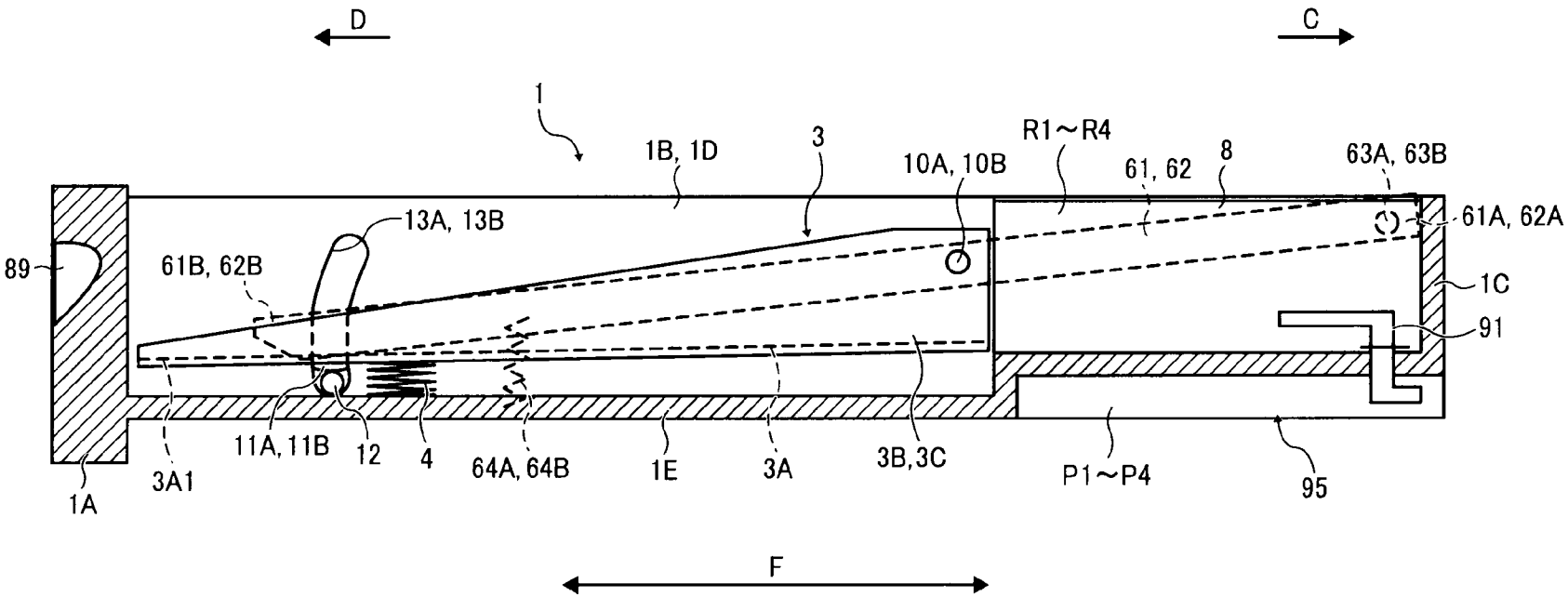
FIG. 13 is a side view illustrating a schematic configuration of the medium transport facilitator of FIG. 11 and FIG. 12, with a push-up member located at a lower position.
Figure 14:
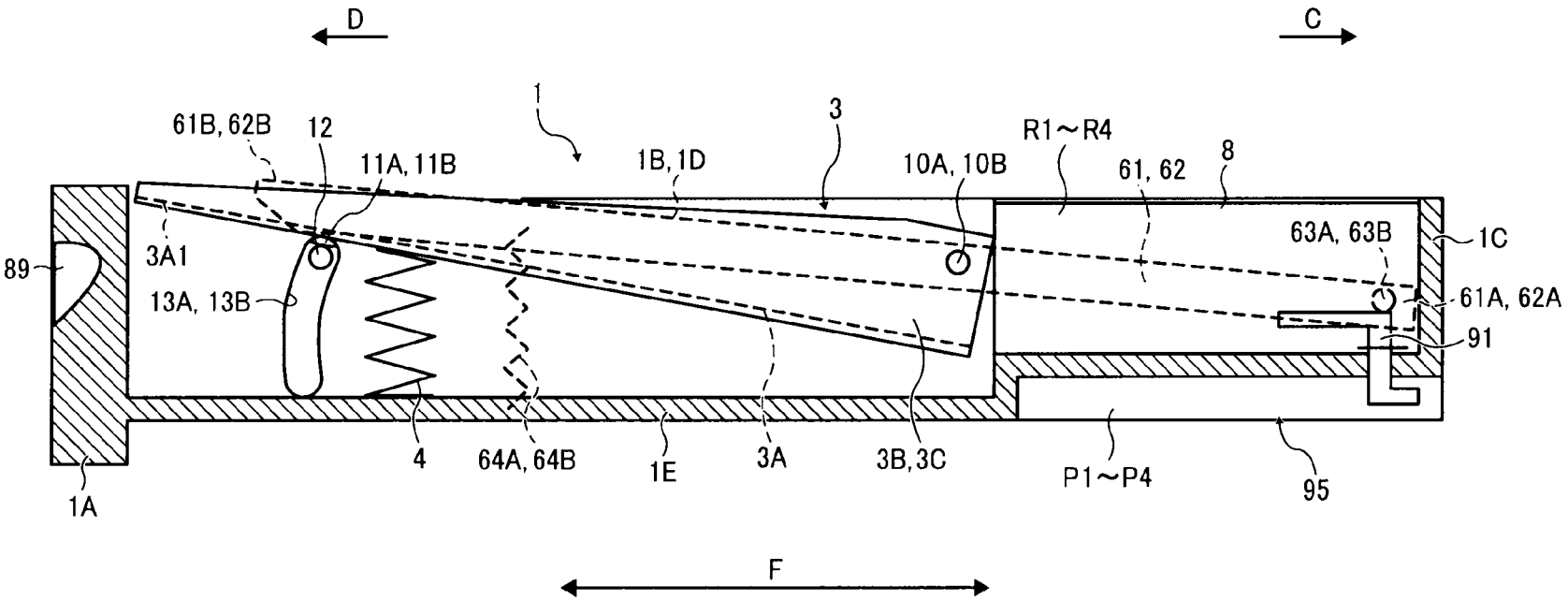
FIG. 14 is a side view illustrating a schematic configuration of the medium transport facilitator of FIG. 11 and FIG. 12, with the push-up member located at an upper position.

As illustrated in FIGS. 13 and 14, one end of the compression coil spring 4 is fixed to the bottom plate 1E of the tray 1 and the other end thereof is fixed to the base plate 3A of the push-up member 3 so that the trailing end 3A1 of the base plate 3A of the push-up member 3 rotates upward about the pins 10A and 10B.

The medium transport facilitator 2 according to this exemplary embodiment includes three compression coil springs 4 arranged in a straight line along the width direction E of the tray 1. By so doing, even if toner is fully packed in the toner container 70 (i.e., when the toner container 70 is packed with new toner) and the weight of the toner container 70 is heavy, a sufficient force generated by the compression coil springs 4 can be exerted to pull up the toner container 70, as illustrated in FIG. 15D, so that the container body 72 can contact a ceiling surface 102 that is an upper portion of the tray storage space 101 when the tray 1 is at the tray set position. If this sufficient force can be securely obtained, the number and position of the compression coil springs 4 are not limited. Namely, the medium transport facilitator 2 can apply a sufficient force by the compression coil springs 4 to push up the push-up member 3 even when the toner containers 70 set on the push-up member 3 are fully packed with toner. Therefore, as the amount of toner gradually decreases due to performance of a toner supplying operation, the container bodies 72 of the toner containers 70 can be pushed up further toward the ceiling surface 102 located above the tray 1 at the upper part of the main body 100 (refer to FIG. 15D). The ceiling surface 102 is formed on the upper part of the main body 100, which can be above the tray 1 when the tray 1 is at the tray set position, and serves as a compression part to compress the container body 72 between the push-up member 3 and the ceiling surface 102.

Figure 12:
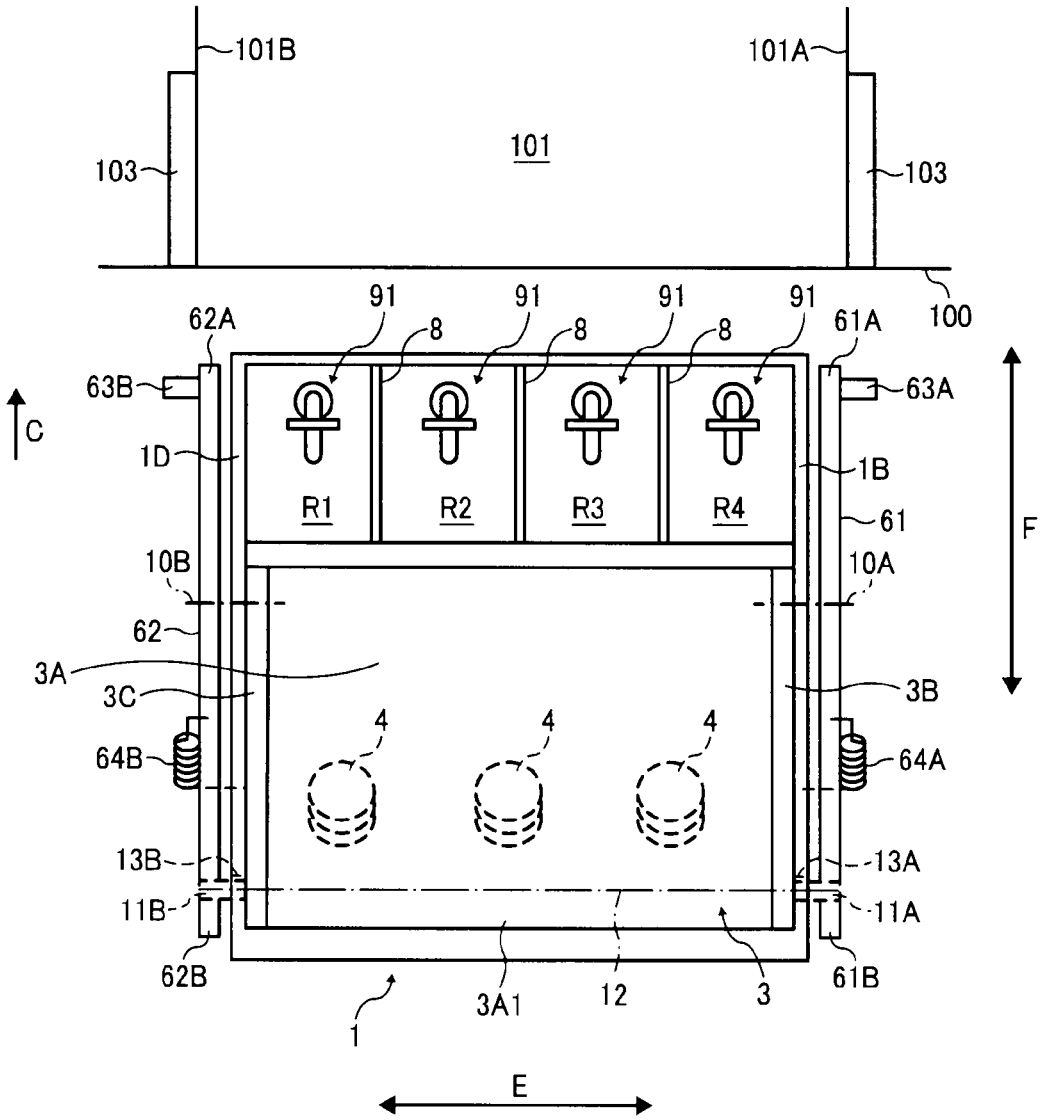
FIG. 12 is a plane view of a schematic configuration of the tray for holding and setting the medium containers and a medium transport facilitator of FIG. 11.

As illustrated in FIGS. 11 and 12, the medium transport facilitator 2 further includes a pair of levers 61 and 62 extending between the tray inward side (i.e., the side wall 10) and the tray outward side (i.e., the side wall 1A) in the tray depth direction F. The lever 61 is disposed in the vicinity of the side wall 1B of the tray 1 and the lever 62 is disposed in the vicinity of the side wall 1D of the tray 1. The levers 61 and 62 include guide pins 63A and 63B that contact the cam rails 103 disposed at the leading ends 61A and 62A on the inward side of the tray 1 to project in the width direction of the tray 1. The levers 61 and 62 are rotatably supported by the pins 10A and 10B of the push-up member 3 that is rotatably disposed on the side walls 1B and 1D, respectively. The trailing end 61B at the tray outward side of the lever 61 is disposed above the projection 11A that projects from an elongated hole 13A in the tray width direction E to contact the projection 11A. Similarly, the trailing end 62B at the tray outward side of the lever 62 is disposed above the projection 11B that projects from an elongated hole 13B in the tray width direction E to contact the projection 11B. The levers 61 and 62 receive respective biasing forces generated by tension coil springs 64A and 64B to bias the levers 61 and 62 toward a direction to press down the projections 11A and 11B at trailing ends 61B and 62B, respectively, against the forces generated by the compression coil springs 4. The tension coil springs 64A and 64B serves as a biasing member to exert the biasing force on the levers 61 and 62. One end of each of the tension coil springs 64A and 64B is engaged between the trailing ends 61B and 62B and respective rotational centers of the levers 61 and 62 and the other end of which is engaged to the tray 1.

As illustrated in FIG. 13, according to the levers 61 and 62 and the biasing forces applied to the levers 61 and 62, the trailing end 3A1 of the push-up member 3 is held to be positioned at the side of the base plate 1E when the tray 1 is pulled out from the main body 100 of the image forming apparatus 1000. As illustrated in FIG. 14, as the cam rails 103 push up the guide pins 63A and 63B disposed at the leading ends 61A and 62A, respectively, on the inward side of the tray 1, the levers 61 and 62 rotate in a reverse direction against the biasing forces generated by the tension coil springs 64A and 64B, and consequently, the projections 11A and 11B are moved up by the forces generated by the compression coil springs 4. This movement lasts until the trailing end 72*b* of the container body 72 of the toner container 70 is held between the ceiling surface 102 and the push-up member 3 to stop the rise of the push-up member 3. According to this action, the internal pressure of the container body 72 increases and the toner container 70 inclines to slope down toward the toner outlet port 71C, thereby transporting toner smoothly. By adjusting the heights of the cam rails 103, the trailing end 61B of the lever 61 and the trailing end 62B of the lever 62 are raised to a position that is higher than where the projections 11A and 11B stop rising in response to that the container body 72 is sandwiched and pressed by the ceiling surface 102 and the push-up member 3. Consequently, the action in which the trailing ends 61B and 62B of the lever 61 and 62 push up the projections 11A and 11B is released, and the volume of the container body 72 decreases due to consumption of toner during image forming operations. In response to the above-described actions, as the trailing end 3A1 of the push-up member 3 is pressed upward from the bottom plate 1E due to the force generated by the compression coil springs 4, the push-up member 3 further inclines at a steeper angle. That is, the more the residual amount of toner decreases, the greater the push-up member 3 inclines. Therefore, the toner can be transported consecutively to the cap fitting 71, thereby maintaining good transportability of toner until the toner in the toner container 70 is completely transported.

As illustrated in FIG. 12, the cam rails 103 are mounted on side surfaces 101A and 101B of the tray storage space 101, facing the side wall 1B and the side wall 1D, respectively. The time the cam rails 103 start raising the push-up member 3, that is, the position of the inclined cam surface of the cam rails 103 to push down the guide pins 63A and 63B, is preferably set to begin at or immediately before the tray set position of the tray 1 where the cap fitting 72 of the toner container 70 is connected to the medium receiving nozzle 91. The above-described setting is made because, if the push-up member 3 starts rising with the tray 1 not located at the tray set position, the tray 1 moves a longer distance while pressing the toner container 70 against the ceiling surface 102, which can cause damage to the toner container 70 due to sliding.

In this exemplary embodiment, the tray push-up control mechanism includes the projections 11A and 11B, the bar 12, the levers 61 and 62, and the tension coil springs 64A and 64B.

Figure 16A:
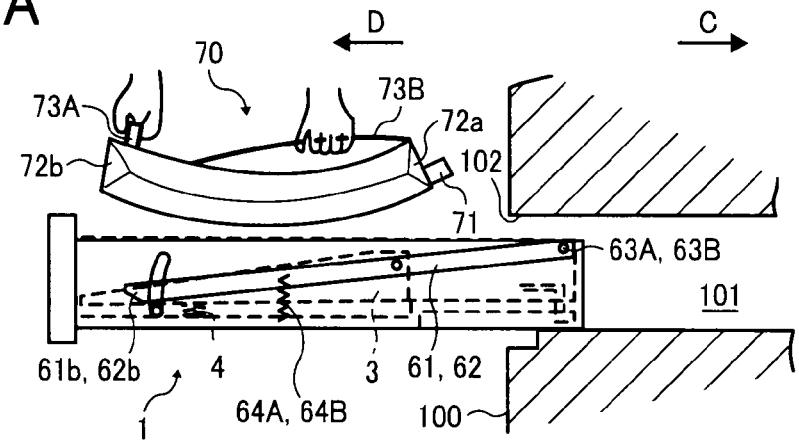
FIG. 16A is a view for explaining a state of a medium transport facilitator when the tray is pulled out.

The operator M can move the toner container 70 set in the tray 1 with this structure to the maximum tray open position by pulling in the tray opening position D with the recessed drawer pull 89 of the tray 1, as illustrated in FIG. 15A. The maximum tray open position is a position at which the side wall 10 of the tray 1 remains in the tray storage space 101 and which the tray 1 can be supported without any support from the operator M. When the tray 1 is located at the maximum tray open position, the medium receiving nozzle 91 is exposed out of the tray storage space 101 and the operator M can see the inside of the tray 1. This can enhance the visibility of the tray 1 from above significantly when the operator M connects the medium receiving nozzle 91 and the cap fitting 71 of the toner container 70 by viewing the tray 1 from above. Further, as illustrated in FIG. 16A, the guide pins 63A and 63B are not in contact with the cam surface 103A of the cam rail 103.

As described above, the deformable toner container 70 can be slack or deform easily, which makes it difficult to fit the cap fitting 71 to the medium receiving nozzle 91. However, as illustrated in FIG. 15A, the operator M can carry the toner container 70 easily by grabbing the second belt 73B (the long strap) attached thereto in substantially parallel to the longitudinal direction A of the toner container 70 and the first strap 73A (the short strap) attached to the opposite end of the cap fitting 71. Further, the tray 1 is located at which the operator M can look down. With the first strap 73A and the second belt 73B disposed as described above, the operator M can grab the toner container 70 from above the toner container 70 effortlessly and set the toner container 70 in the tray 1 easily. As illustrated in FIG. 15B, the operator M can hold the trailing end 72*b* of the toner container 70 up above the tray 1 and slide the toner container 70 toward the medium receiving nozzle 91 to connect and fasten the cap fitting 71 to the leading end of the medium receiving nozzle 91. The operator M can conduct the above operation more easily by sliding the toner container 70 toward the medium receiving nozzle 91 while grabbing the second belt 73B (the long strap) at the vicinity of the toner outlet port 71C.

The leading end 72*a* of the container body 72 of the toner container 70 set in the tray 1 is directly placed on the bottom plate 1E in the sections R1 through R4 divided by the partition wall 8 as illustrated in FIG. 11. However, as illustrated in FIG. 13, the trailing end 72*b* thereof is set on the push-up member 3 that is pressed down by the levers 61 and 62. Accordingly, the toner container 70 can be properly set to the tray 1 without being slack and slid toward the medium receiving nozzle 91 smoothly, as illustrated in FIG. 15B, thereby providing good setting performance.

Figure 15C:
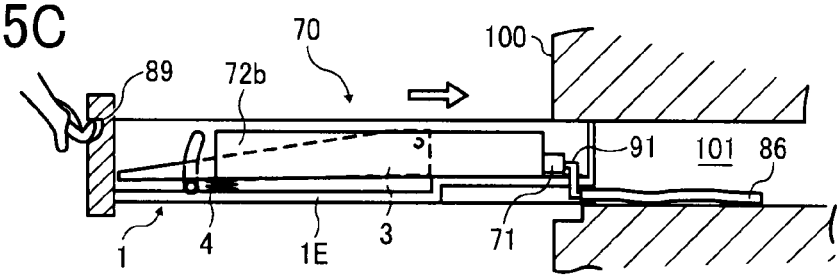
FIG. 15C is a view for explaining a state in which the medium container and a medium receiving unit are connected.
Figure 15D:
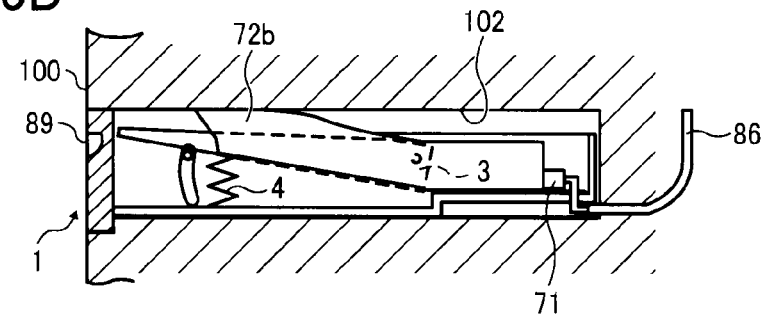
FIG. 15D is a view for explaining a state in which the tray is set at a tray set position.
Figure 16B:
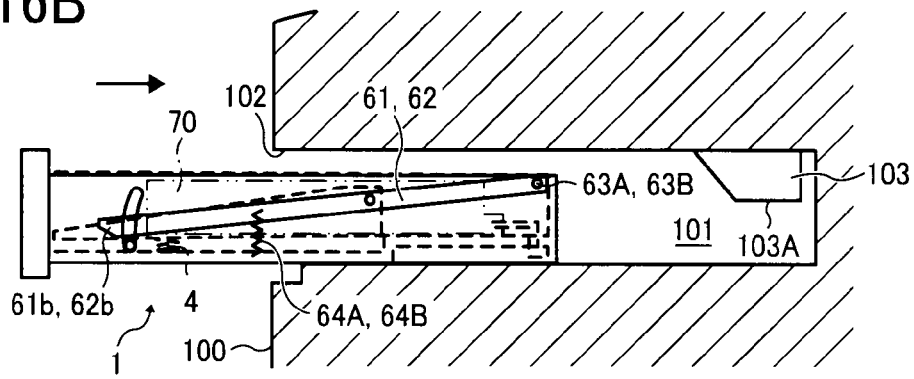
FIG. 16B is a view for explaining a state of the medium transport facilitator when the tray is pushed to a main body of the image forming apparatus.

Then, when the tray 1 with the toner container 70 placed thereon is pushed to the tray closing direction C, as illustrated in FIG. 15C, the tray 1 moves in the tray storage space 101. At this time, the push-up member 3 remains pressed down until the guide pins 63A and 63B attached to the leading ends 61A and 62A of the levers 61 and 62 contact the cam rails 103, as illustrated in FIG. 16B. Therefore, the tray 1 can move to the tray set position smoothly without the toner container 70 being caught at anywhere on the ceiling surface 102.

Figure 16C:
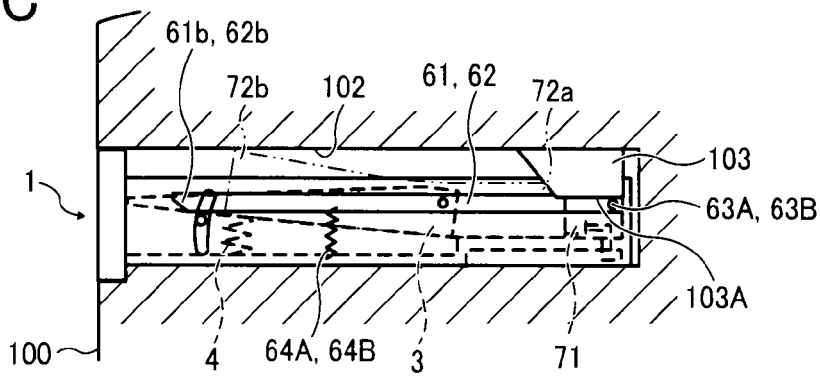
FIG. 16C is a view for explaining a state of the medium transport facilitator when the tray is set at the tray set position.

As the tray 1 proceeds toward the tray set position, the guide pins 63A and 63B are fitted to the cam rails 103 and are pressed down by the cam surface 103A of the cam rail 103, as illustrated in FIG. 16C. In response to this action, the levers 61 and 62 rotate in a direction to push up the trailing ends 61B and 62B. Therefore, as illustrated in FIG. 15C, the push-up member 3 in which the movement in the upward direction has been regulated by the trailing ends 61B and 62B is pressed up due to the biasing force generated by the compression coil springs 4. Consequently, the second half of the container body 72 of the toner container 70 are pushed up. With this action, as the toner flows out from the toner container 70, the push-up member 3 is pushed upward by the compression coil springs 4. Even when the inclination of the toner container 70 becomes steeper toward the cap fitting 71 and the toner left in the toner container 70 further decreases, the toner transferability of the toner container 70 can be maintained.

Namely, when the tray 1 is pushed to the tray set position, the push-up member 3 pushes up the container body 72 that is located opposite the cap fitting 71 serving as a medium transport portion to deform the container body 72 by bending it in a vertical direction. With this deformed shape, the toner contained in the toner container 70 falls due to the weight thereof. Therefore, the toner can be transported to the cap fitting 71 without using any additional toner transport unit such as a screw, thereby enhancing the toner transportability of the deformable toner container 70.

Further, as the push-up member 3 is raised, the container body 72 of the toner container 70 is sandwiched and pressed between the push-up member 3 and the ceiling surface 102. By pressing the container body 72 of the deformable toner container 70, the internal pressure of the toner container 70 increases, thereby further enhancing the toner transportability of the deformable toner container 70.

On the other hand, even if the push-up member 3 is pushed up, the first half of the toner containers 70 are set in the sections R1 through R4 on the bottom plate 1E, and can remain in a substantially horizontal direction. Therefore, when the toner containers 70 are fully packed with new toner, the toner does not move toward the cap fitting 71, thus does not coagulate in there, and therefore poor toner suction performance due to coagulation can be prevented.

Figure 17A:
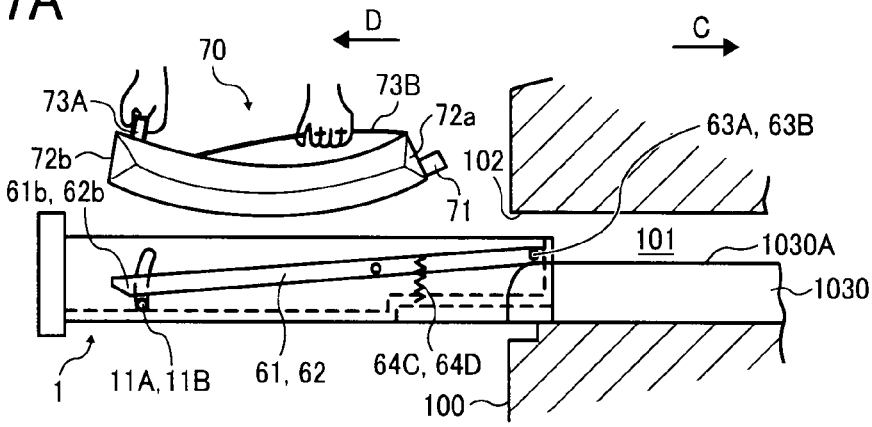
FIG. 17A is another view for explaining a state of the medium transport facilitator when the tray is pulled out.
Figure 17B:
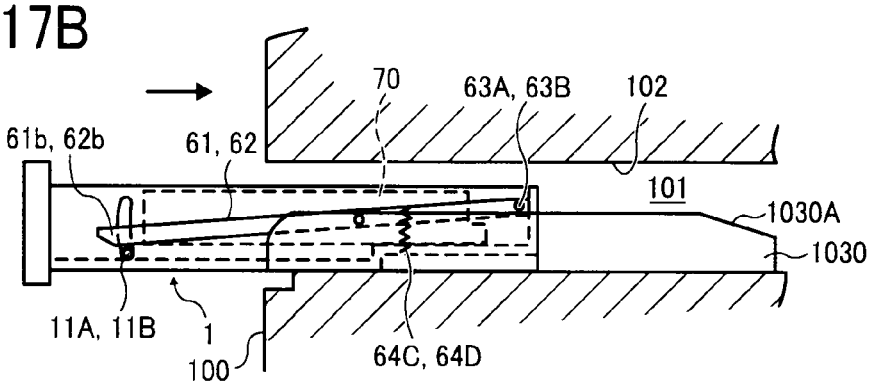
FIG. 17B is another view for explaining a state of the medium transport facilitator when the tray is pushed to the main body of the image forming apparatus.
Figure 17C:
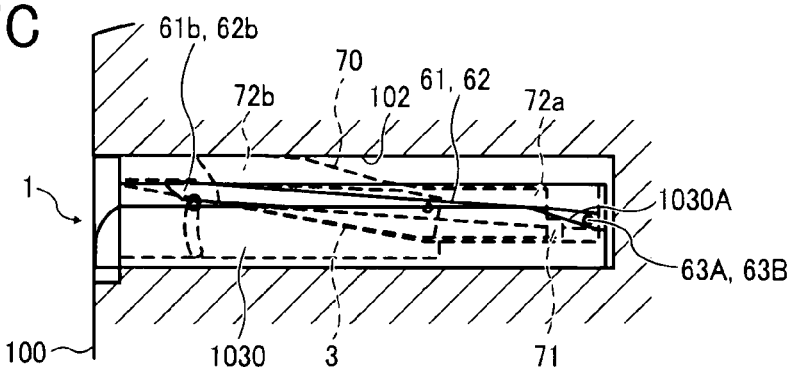
FIG. 17C is another view for explaining a state of the medium transport facilitator when the tray is set at the tray set position.

In the medium transport facilitator 2 illustrated in FIG. 11 through FIG. 14, the first ends the tension coil springs 64A and 64B that generate the biasing force to the levers 61 and 62 are attached between the trailing ends 61B and 62B and the respective rotational centers of the levers 61 and 62, respectively, and the second ends thereof are attached to the tray 1. However, the positions of tension coil springs are not limited thereto. For example, as illustrated in FIG. 17A through FIG. 17C, tension coil springs 64C and 64D that generate the biasing force to the levers 61 and 62 like the tension coil springs 64A and 64B can be disposed between the leading ends 61A and 62A and the respective rotational centers of the levers 61 and 62, respectively, to be engaged to the tray 1. Specifically, one end of the tension coil spring 64C may be attached to the rotational center of the leading end 61A of the lever 61 and the other end of the tension coil spring 64C may be attached to the tray 1. Similarly, one end of the tension coil spring 64D may be attached to the rotational center of the leading end 62A of the lever 62 and the other end of the tension coil spring 64D may be attached to the tray 1. In this case, respective cam surfaces 1030A of cam rails 1030 are disposed upside down (on the top face of the main body 100) from the cam rails 103 (disposed on the ceiling surface 102) illustrated in FIG. 16, so that the cam surfaces 1030A of the cam rails 1030 slope down immediately before the tray set position of the tray 1.

With this structure, as illustrated in FIG. 17A, when the tray 1 is pulled out to the tray open position, the guide pins 63A and 63B are on the cam rails 1030 and the levers 61A and 61B are pressed down, resulting that the push-up member 3 on which the toner container 70 is placed is maintained horizontal. Thus, the toner container 70 can be set to the tray 1 easily.

As illustrated in FIG. 17B, when the tray 1 is inserted into the toner storage space 101 with the toner container 70 set in the tray 1, as soon as the guide pins 63A and 63B contact the slope of the cam surface 1030A of the cam rail 1030 immediately before the tray set position, the trailing ends 61B and 62B of the levers 61 and 62 are raised by an upward force transmitted from the tension coil springs 64A and 64B and the compression coil springs 4 disposed below the push-up member 3 via the projections 11A and 11B disposed at both ends of the push-up member 3. Therefore, as illustrated in FIG. 17C, when the tray 1 reaches the tray set position, the second half of the container body 72 is sandwiched between the ceiling surface 102 and the push-up member 3 to stop the push-up member 3 from rising. Under this condition, the internal pressure of the container body 72 increases and the toner container 70 slopes down toward the toner outlet portion 71C. As a result, the toner in the container body 72 of the toner container 70 can be transported smoothly.

As the toner is consumed for image forming, the volume of the toner container 70 that is sandwiched between the ceiling surface 102 and the push-up member 3 is decreased. Consequently, the push-up member 3 further pushes up the container body 72 of the toner container 70 due to the action of the compression coil spring 4. At this time, the tension coil springs 64A and 64B have brought the trailing ends 61B and 62B of the levers 61 and 62 to a higher position so as not to interfere a further rise of the projections 11A and 11B provided on both sides of the push-up member 3 by applying a push-up force generated by the tension coil springs 64C and 64D. Therefore, the levers 61 and 62 do not disturb application of the push-up force by interfering the projections 11A and 11B of the push-up members 3. Accordingly, as the residual amount of toner is consumed, the toner can be transported to the cap fitting 71 successfully, thereby maintaining good transportability of toner until the toner in the toner container 70 is completely transported.

Next, a description is given of a structure of a rear part of the tray 1.

Figure 18:
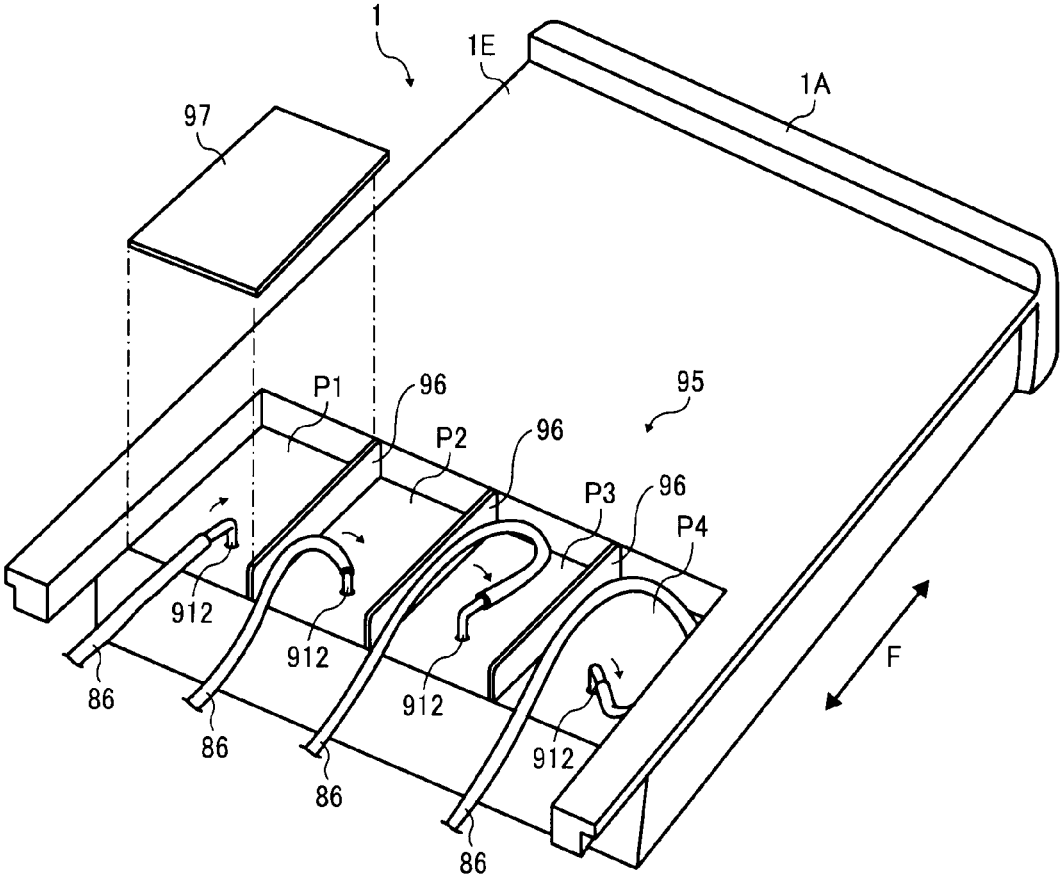
FIG. 18 is an enlarged perspective view for explaining a configuration of a tubular member storing unit mounted on a back side of the tray and a storing operation of the tubular member.

As illustrated in FIG. 18, the medium receiving nozzle 91 is mounted on the bottom plate 1E of the tray 1. The tray 1 further includes tubular member storing unit 95 to store the slack toner tube 86 when the tray 1 is located at the tray set position. The tubular member storing unit 95 is mounted on the opposite side where the medium receiving nozzle 91 is attached to the sections R1 through R4. The tubular member storing unit 95 includes four storage spaces P1 through P4 divided by three guide plates 96. The storage spaces P1 through P4 are formed long in the tray depth position F. When the tray 1 is reversed, the upper portions of the storage spaces P1 through P4 are covered by covers 97. Therefore, joint portions 912 are rotatably supported to the respective nozzle bodies 911 of the medium receiving nozzle 91 in the storage spaces P1 through P4 where the tray inward side is open.

When the tubular member storing unit 95 is formed on the back side of the tray 1 as described above, as the tray 1 is moved from the tray open position to the tray set position, the joint portion 912 connected to the toner tube 86 rotates to take up and store the slack toner tube 86 in the storage spaces P1 through P4 of the tubular member storing unit 95. Accordingly, the toner tube 86 is less caught along the way, thereby opening and closing the tray 1 smoothly.

FIG. 18 illustrates steps of taking up the toner tube 86 in the storage spaces P1 through P4, starting from left to right, as a matter of convenience. In reality, the four toner tubes 86 are taken up and stored at the same time, in synchronization with the setting operation of the tray 1. The toner tube 86 in the storage space P1 shows a state in which the tray 1 is pulled out from the toner storage space 101, and the toner tube 86 is stretched, without being slack. The toner tube 86 in the storage space P2 shows a state in which the tray 1 is pushed a little to the tray closing direction C. The toner tube 86 in the storage space P3 shows a state in which the tray 1 is further pushed to the tray closing direction C. The toner tube 86 in the storage space P4 shows a state in which the tray 1 has reached the tray set position.

Since the toner tube 86 is pulled out and taken up in the storage spaces P1 through P4 repeatedly associated with opening and closing of the tray 1, it is desirable in view of durability that the toner tube 86 becomes slack without being buckled before being taken up and stored in the storage spaces P1 through P4. It is also preferable that the toner tube 86 is taken up in a same direction constantly so that the toner tube 86 becomes twisted. By so doing, the toner tube 86 can turn to the width direction B automatically, which can reduce a chance of being buckled when the tray 1 is moved to the tray closing direction C.

Figure 19:
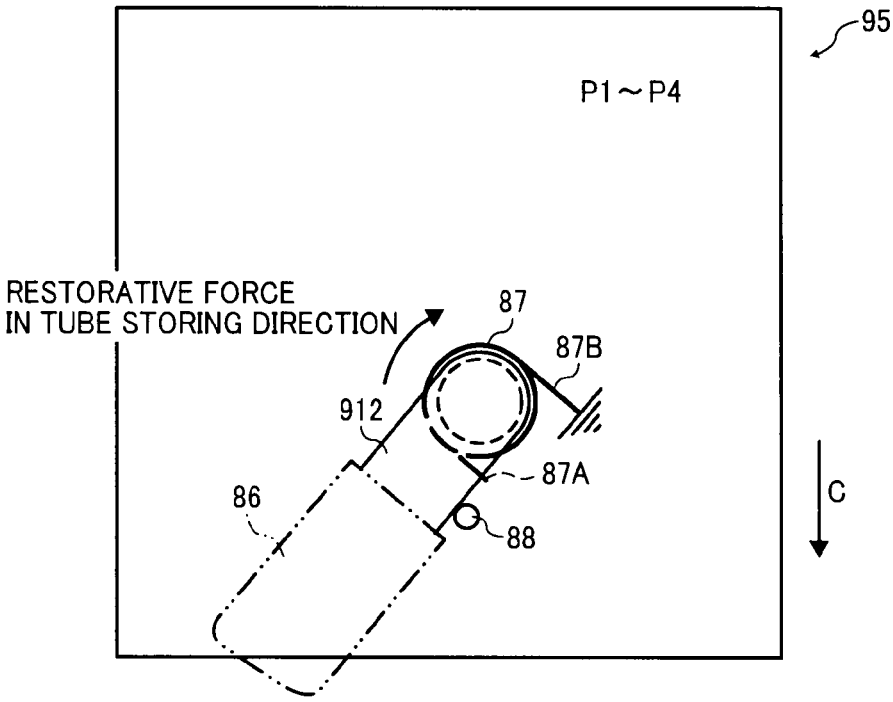
FIG. 19 is a plan view for explaining a configuration and operation of a joint portion, a restorative force application member, and a regulating member mounted on the tubular member storing unit of FIG. 18.

Further, as illustrated in FIG. 19, the tubular member storing unit 95 may include a torsion coil spring 87 and a stopper 88.

The torsion coil spring 87 serves as a restorative force application member to apply a restorative force to the joint portion 912 to cause the toner tube 86 to rotate to a tube storing direction.

The stopper 88 serves as a regulating member to regulate rotation of the joint portion 912 if the joint portion 912 rotates in a tube pull-out direction against the restorative force generated by the torsion coil spring 87 when the tray 1 is pulled out. The stopper 88 is fixedly attached to each of the storage spaces P1 through P4 so that the joint portion 912 can stop in a 7 o'clock direction in FIG. 19, for example. The torsion coil spring 87 is wound around the joint portion 912. One end 87A of the torsion coil spring 87 is latched together with the joint portion 912 and the other end 87B thereof is fixedly attached to each of the storage spaces P1 through P4.

With this configuration, when the tray 1 is pulled out from the tray set position, the toner tube 86 stored in each of the storage spaces P1 through P4 is unreeled and taken out from the storage spaces P1 through P4. Since the torsion coil spring 87 applies the restorative force to the toner tube 86 to be taken up in the tube storing direction, the toner tube 86 can be pulled out without being slack and the tray 1 can be pulled out without being caught in the way. Further, when the tray 1 is at the maximum tray open position, the joint portion 912 contacts the stopper 88 to be retained at the 7 o'clock direction. When the tray 1 is inserted into the tray storage space 101 with this condition, the joint portion 912 that remains in the 7 o'clock direction rotates in a clockwise direction in FIG. 19 by the force generated by the torsion coil spring 87 regardless of position of the toner tube 86. Therefore, when the tray 1 is inserted into the main body 100, the toner tube 86 is taken up with tension according to the amount of movement of the tray 1 to be stored in the storage spaces P1 through P4. Accordingly, when the tray 1 is returned to the main body 100, the toner tube 86 can be taken up without being slack and the tray 1 can be moved without being caught in the way, thereby moving the tray 1 smoothly.

Figure 20:
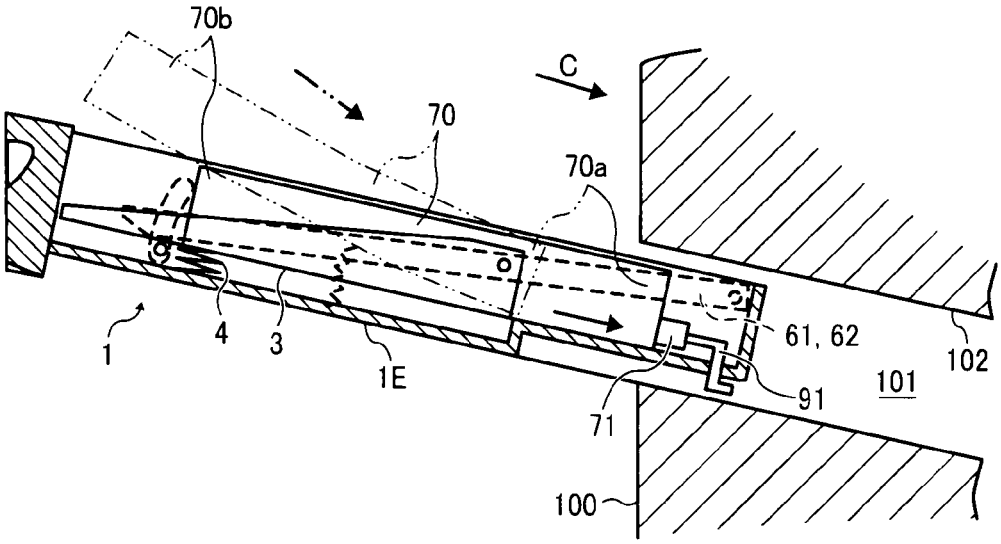
FIG. 20 is a schematic view illustrating a state of the tray sloped at an angle to the main body of the image forming apparatus and the medium container set in the tray.

In the above-described exemplary embodiment, the tray 1 is detachably attached and horizontally movable to the tray storage space 101 that is formed horizontally with respect to the main body 100. However, the configuration for storing the tray 1 is not limited thereto. For example, as illustrated in FIG. 20, the leading end of the tray 1 on the tray inward side in the main body 100 can be stored with the leading edge sloped down. In this case, the tray storage space 101 can be formed to slope down toward the tray inward side.

Figure 21:
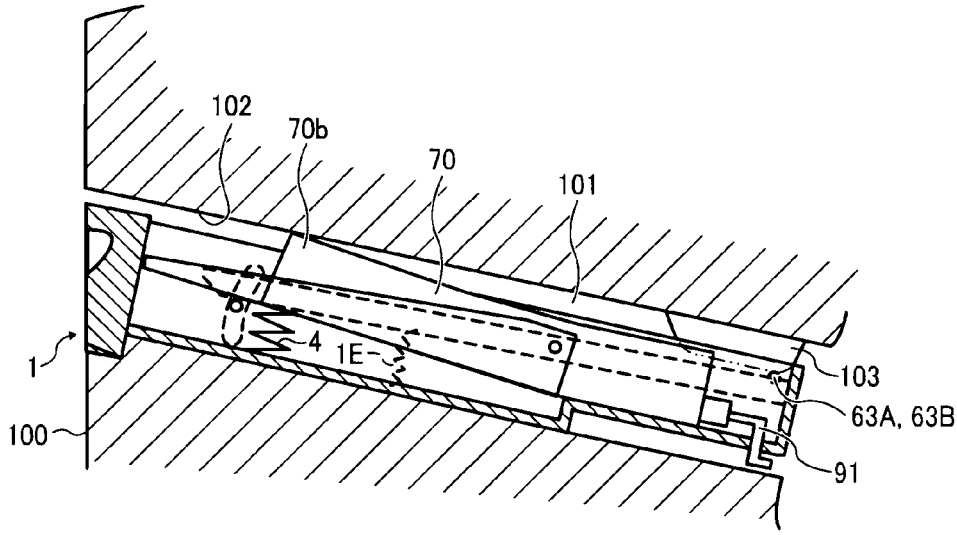
FIG. 21 is a schematic configuration diagram illustrating the state of the medium container when the tray of FIG. 20 is located at the tray set position.

With this structure, the base plate 1E of the tray 1 includes an inclined surface. By moving the toner container 70 along the inclined base plate 1E, the toner container 70 can be set to the tray 1 easily. At the same time, the toner in the toner container 70 moves to the cap fitting 71 due to the weight thereof, and therefore, even the deformable toner container 70 is used, the transportability of toner can be enhanced. In this case, by disposing the cam rails 103 at an angle as shown in FIG. 16, when the tray 1 is located at the tray set position, only the training end 72*b* of the container body 72 of the toner container 70 is pushed up by the push-up member 3 disposed in the medium transport facilitator 2, as illustrated in FIG. 21. Accordingly, the toner transportability of the deformable toner container 70 can be enhanced without using an additional toner transport member such as a screw.

Figure 22:
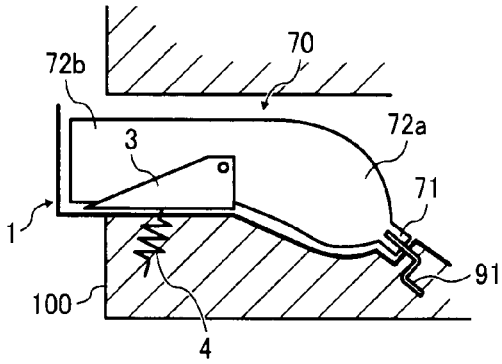
FIG. 22 is a schematic view illustrating the state of the tray, which has a slope partly and moves horizontally, and the medium container set in the tray.

Alternatively, as illustrated in FIG. 22, the bottom plate 1E can be formed such that the height of the leading end of the tray 1 is lower than the height of the trailing end thereof. This structure of the tray 1 can reduce a load given to an operator when he or she pulls out the tray 1, which can enhance the operability of replacement of the toner container 70.

Figure 23:
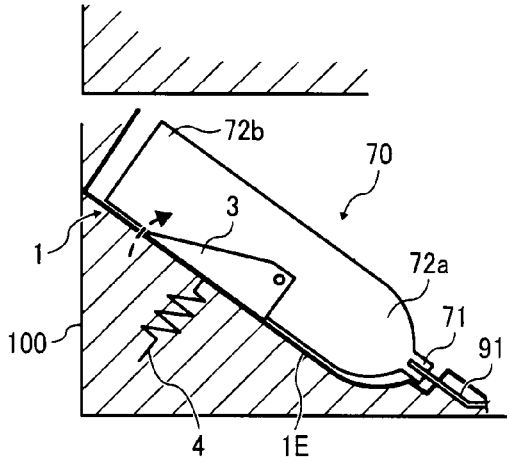
FIG. 23 is a schematic configuration diagram illustrating a state of the medium container when the tray of FIG. 22 is located at the tray set position.

Further, as illustrated in FIG. 23, when the tray 1 is located at the tray set position, only the trailing end 72*b* of the toner container 70 is pushed up by the push-up member 3. Therefore, even the deformable toner container 70 can increase the toner transportability without using any additional toner transport member such as a screw.

The toner container 70 serving as a medium container and the image forming apparatus 1000 of FIG. 1 through FIG. 23 have been explained on the assumption that the medium used for image forming includes powder toner. However, the present invention is not limited to be applied thereto and can achieve the same toner transportability of the toner container 70 with liquid toner or ink. In such cases, the image forming apparatus 1000 that works as an electrophotographic image forming apparatus in the descriptions of FIG. 1 through FIG. 23 can be replaced to an inkjet printer with the same configuration except the tray configuration. Further, in the inkjet printer, the medium receiving nozzle 91 or 91A may include a needle-like member having a smaller diameter, and the toner outlet port 71C of the toner container 70 or 701 may be replaced to a rubber plug (a self-closing valve that is openable by a needle and is closable by a compressive force when the needle is pulled out) which is usually used for inkjet printers.

Next, a description is given of a configuration of a coagulation inhibitor 150, with reference to FIG. 24 through FIG. 30.

Figure 24:
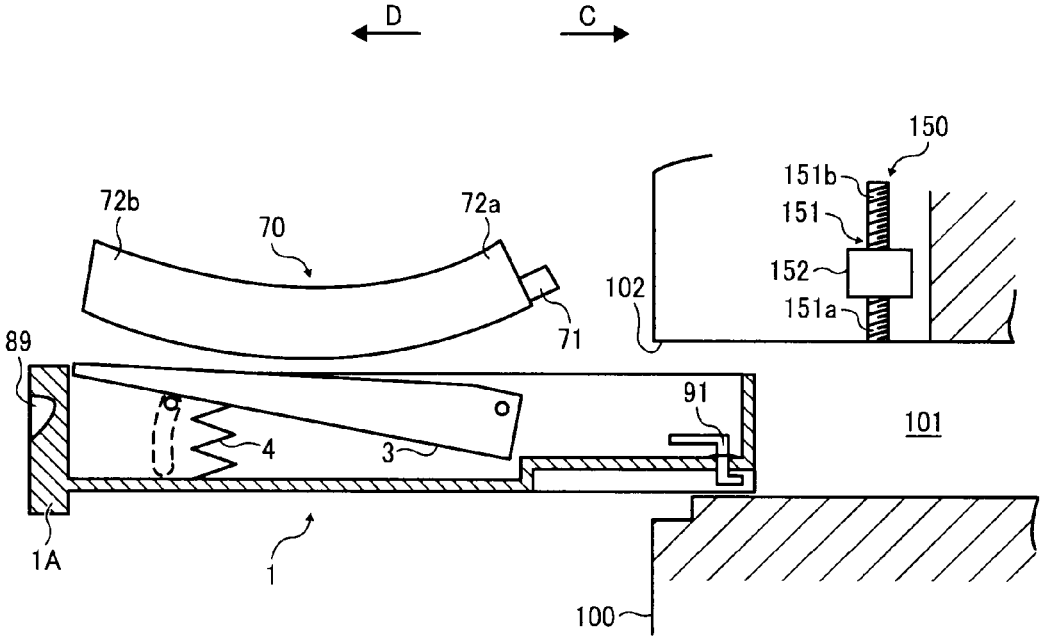
FIG. 24 is a side view for illustrating a structure of a coagulation inhibitor that vibrates the medium container and the tray to hold the medium container therein.

As illustrated in FIG. 24, the image forming apparatus 1000 further includes a coagulation inhibitor 150 to vibrate a medium container corresponding to the toner container 70 or the toner container 701 illustrated in FIG. 9.

The coagulation inhibitor 150 vibrates the toner container 70 stored in the tray 1 when the tray 1 is located at the tray set position, so as to move the toner contained in the toner container 70 to the cap fitting 71 provided at the leading end 72*a* of the toner container 70.

The coagulation inhibitor 150 includes a movable member 151 and a driving motor 152. The movable member 151 contacts the trailing end 72*b* of the toner container 70 from above when the tray 1 that is pulled out of the main body 100 of FIG. 24 is moved to the tray set position of FIGS. 25A and 25B and the trailing end 72*b* is located near the side wall 1A disposed in the tray opening direction D of the toner container 70.

The driving motor 152 serves as a drive unit that moves the movable member 151 vertically.

The tray 1 includes the push-up member 3 that pushes up the toner container 70 by using the compression coil springs 4, and the compression coil spring 4 serves as a biasing member to urge the toner container 70 toward the movable member 151 from an opposite side where the movable member 151 is located.

The movable member 151 is a threaded rod to apply torsion to an upper face 72*c* of the toner container 70 by rotating and pressing the toner container 70. Detailed operations of the movable member 151 are described below.

The movable member 151 is disposed above the toner container 70 to move vertically and includes a first end 151*a* and a second end 151*b* opposite the first end 151*a*. The first end 151*a* of the movable member 151 contacts the trailing end 72*b* of the upper face 72*c* of the toner container 70 when the tray 1 is located at the tray set position. The second end 151*b* of the movable member 151 is screwed to the driving motor 152. The movable member 151 moves up and down according to the rotational direction controlled by the driving motor 152.

The driving motor 152 rotates both in a forward direction and a backward direction and, for example, is fixedly mounted on the ceiling surface 102 formed on the tray storage space 101. If the movable member 151 is located in the tray storage space 101 with the tray 1 being pulled out, when the tray 1 is moved to the tray set position, the movable member 151 may interfere with the toner container 70. Therefore, the movable member 151 is preferably retreated to where it does not interfere with at least the upper face 72*c* of the toner container 70 until the tray 1 reaches the tray set position.

A position detector 153 is disposed inside the tray storage space 101 to detect whether or not the tray 1 is located at the tray set position. When the position detector 153 detects that the tray 1 is located at the tray set position, the driving motor 152 moves the movable member 151 down until the first end 151*a* of the movable member 151 contacts the upper face 72*c* of the toner container 70. The amount of movement of the movable member 151 can be determined in advance. In this exemplary embodiment, when the tray 1 is located at the tray set position, the compression coil spring 4 causes the push-up member 3 to move the trailing end 72*b* of the toner container 70 upward. Consequently, the trailing end 72*b* of the toner container 70 presses against the first end 151*a* of the movable member 151, and the position of the trailing end 72*b* of the toner container 70 is fixed.

Figure 26A:
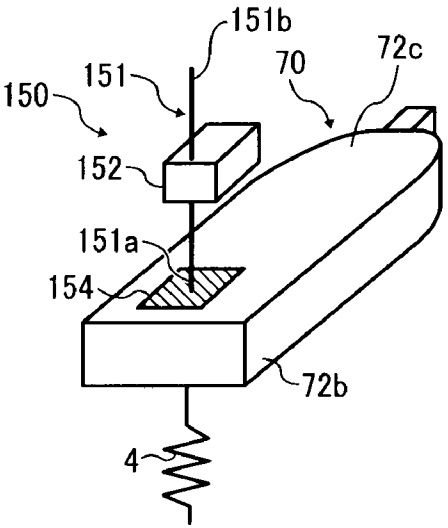
FIG. 26A is a view for explaining a structure and operation of another coagulation inhibitor when the tray is located at the tray set position.
Figure 26B:
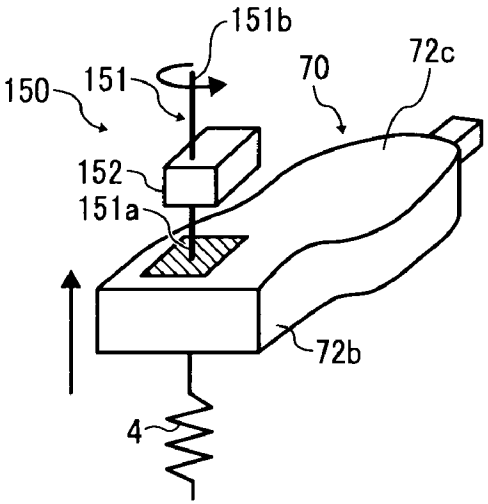
FIG. 26B is a view for explaining the structure and operation of the coagulation inhibitor of FIG. 26A when the trailing end of the medium container is pushed up.
Figure 26C:
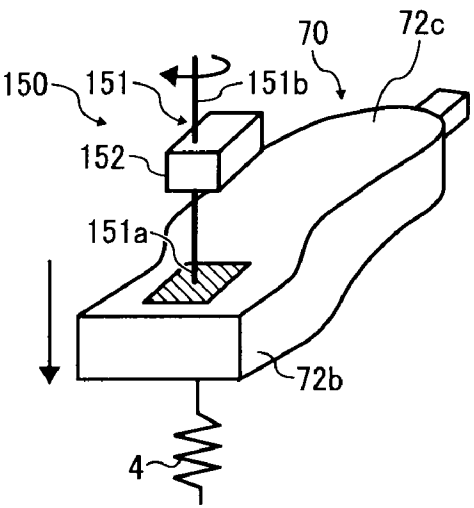
FIG. 26C is a view for explaining the structure and operation of another coagulation inhibitor when the trailing end of the medium container is pressed down.

Further, as illustrated in FIGS. 26A through 26C, a correcting member 154 is disposed at a predetermined area on the upper face 72*c* of the toner container 70 where the first end 151*a* of the movable member 151 contacts.

Next, a description is given of operations of the coagulation inhibitor 150 with the above-described configuration.

Figure 25A:
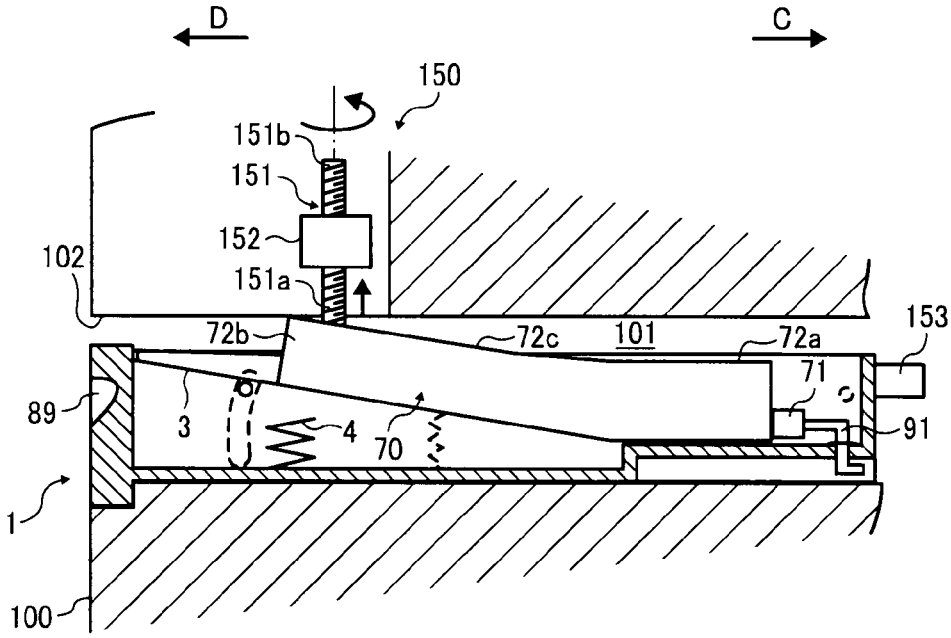
FIG. 25A is a side view for explaining the structure and operation of the coagulation inhibitor of FIG. 24 with the medium container lifted when the tray is located at the tray set position.

First, the toner container 70 is set in the tray 1 at the tray open position. After the medium receiving nozzle 91 is fitted to the cap fitting 71, the tray 1 is moved in the tray closing direction C. Then, as illustrated in FIG. 25A and FIG. 26A, with the tray 1 at the tray set position, the driving motor 152 moves down the movable member 151 by a given distance. At the same time, the trailing end 72*b* of the toner container 70 is moved up by the action of the compression coil spring 4 and the push-up member 3 toward the movable member 151. Consequently, the trailing end 72*b* of the toner container 70 is elastically sandwiched and fixedly located between the first end 151*a* of the movable member 151 and the push-up member 3 vertically.

When the driving motor 152 rotates in a forward direction, for example, with this condition, the movable member 151 moves upward as illustrated in FIG. 26B to stay away from the contact position. However, since the trailing end 72*b* of the toner container 70 is pushed upward due to the force generated by the compression coil spring 4, the movable member 151 as a threaded rod can remain in contact with the toner container 70. The torsion in the forward direction is applied from outside to the toner container 70, resulting in spiral-pattern crease formed on the upper face 72*c* of the toner container 70 about the contact portion of the movable member 151. This action of forming a crease in the upper face 72*c* of the toner container 70 is transmitted inside the toner container 70, and therefore the toner contained in the toner container 70 moves to be crumbled.

Figure 25B:
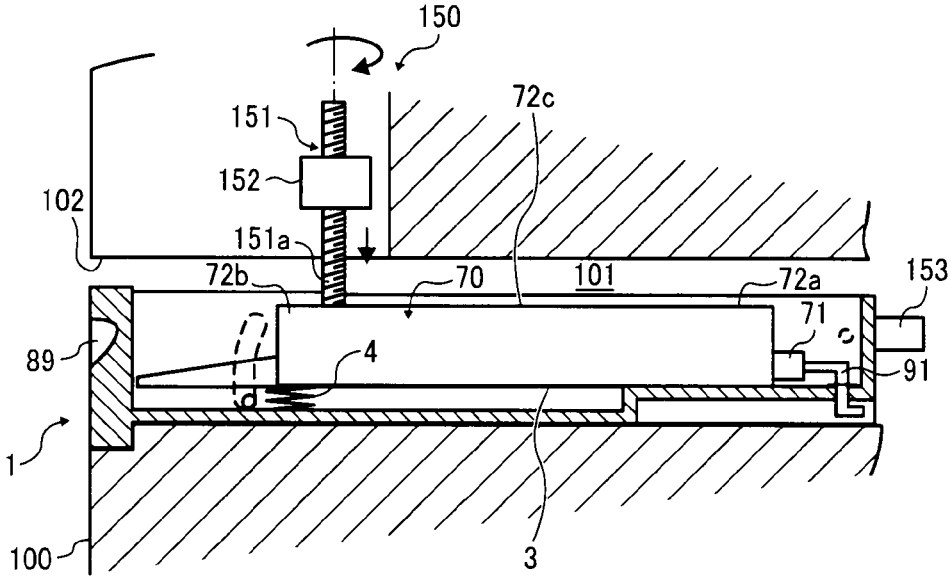
FIG. 25B is a side view for explaining the structure and operation of the coagulation inhibitor of FIG. 24 with the trailing end of the medium container pressed down when the tray is located at the tray set position.

When the driving motor 152 rotates in a backward direction, the movable member 151 moves down, as illustrated in FIG. 25B and FIG. 26C, so that the trailing end 72*b* of the toner container 70 can be pressed down by the movable member 151. In this case, spiral-pattern crease that rotates in an opposite direction is generated on the upper face 72*c* of the toner container 70, this action is transmitted inside the toner container 70, and therefore the toner contained in the toner container 70 moves to be crumbled.

When the driving motor 152 is rotated as described above, the torsion is generated to the trailing end 72*b* of the toner container 70, the toner adhered to an inner face of the toner container 70 is removed therefrom, the toner flowability increases because air enters between toner particles to reduce the density, and the toner becomes more like a liquid. As a result, as the push-up member 3 inclines, toner can be easily transported to the cap fitting 71 disposed on the medium transporting side or the inward side of the toner container 70 such that a liquid flows into the cap fitting 71, the toner transportability of the toner container 70 can increase so that the toner can be conveyed reliably.

Figure 27A:
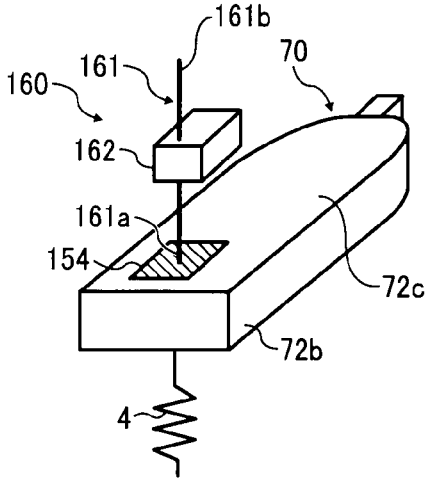
FIG. 27A is a view for explaining the structure and operation of a coagulation inhibitor that vibrates the medium container horizontally when the tray is located at the tray set position.
Figure 27B:
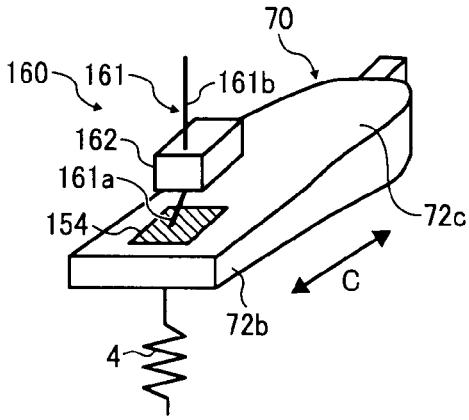
FIG. 27B is a view for explaining the structure and operation of the coagulation inhibitor of FIG. 27A to vibrate the medium container in a longitudinal direction thereof.

FIG. 27A and FIG. 27B illustrate a configuration of another coagulation inhibitor, which is a coagulation inhibitor 160.

As illustrated in FIG. 27A, the coagulation inhibitor 160 vibrates the toner container 70 horizontally on the same plane. The coagulation inhibitor 160 includes a movable member 161 and a driving motor 162.

The movable member 161 contacts the trailing end 72*b* of the toner container 70 from above when the tray 1 is moved to the tray open position.

The driving motor 162 serves as a drive unit that moves the movable member 161 to vibrate the toner container 70 horizontally on the same plane.

The movable member 161 is disposed above the toner container 70 to move the toner container 70 horizontally and includes a first end 161*a* and a second end 161*b*. The first end 161*a* of the movable member 161 contacts the trailing end 72*b* of the upper face 72*c* of the toner container 70 when the tray 1 is located at the tray set position. The second end 161*b* of the movable member 161 is engaged with the driving motor 162. According to the rotational direction controlled by the driving motor 162, the movable member 161 moves horizontally on the same plane to stretch the upper face 72*c* thereof so as to vibrate the toner container 70.

The driving motor 162 is fixedly mounted on the ceiling surface 102 formed above the tray storage space 101, for example. If the movable member 161 is located in the tray storage space 101 with the tray 1 being pulled out and open, when the tray 1 is moved to the tray set position, the movable member 161 may interfere with the toner container 70. Therefore, the movable member 161 is preferably retreated to where it does not interfere with at least the upper face 72*c* of the toner container 70 until the tray 1 reaches the tray set position. Further, the moving member 161 moves up and down associated with opening and closing of the tray 1 performed by a mechanism operating the push-up member 3.

With the coagulation inhibitor 160 having the above-described configuration, when the driving motor 162 is driven with the tray 1 having the toner container 70 thereon located at the tray set position, the movable member 161 rotates to move in the direction stretching the toner container 70, vibrating the trailing end 72*b* of the toner container 70 horizontally on the same plane.

When the driving motor 162 is rotated as described above, the vibration in the horizontal direction is provided to the trailing end 72*b* of the toner container 70, and tension is provided to the toner container 70. Therefore, the toner adhered to the inner face of the toner container 70 is more effectively removed from the inner face thereof and the toner flowability further increases because air enters between toner particles to reduce the density, and the toner becomes like liquid. As a result, as the push-up member 3 inclines, the toner can be easily transported to the cap fitting 71 disposed on the medium transporting side or the inward side of the toner container 70 such that a liquid flows into the cap fitting 71, and the toner transportability of the toner container 70 can increase so that the toner can be conveyed reliably.

Figure 28A:
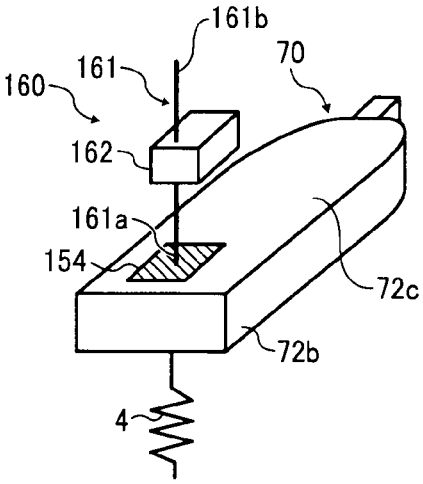
FIG. 28A is a view for explaining the structure and operation of the coagulation inhibitor that vibrates the medium container horizontally when the tray is located at the tray set position.

As illustrated in FIG. 27, the coagulation inhibitor 160 vibrates the toner container 70 horizontally by moving in a direction to stretch the toner container 70. However, as illustrated in FIG. 28, the coagulation inhibitor 160 can vibrate the trailing end 72*b* of the toner container 70 horizontally by moving in the tray width direction E to stretch the trailing end 72*b* of the toner container 70.

Figure 62:
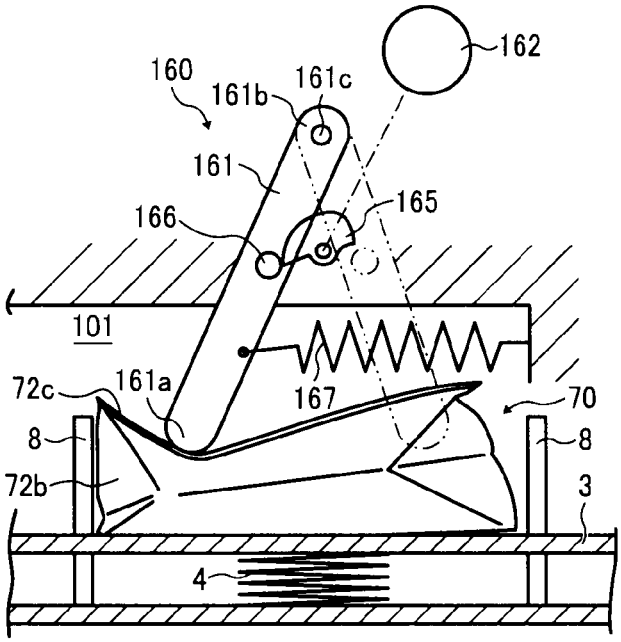
FIG. 62 is an enlarged view illustrating a structure of a coagulation inhibitor.

A description is given of a detailed configuration of the coagulation inhibitor 160, with reference to FIG. 62.

As illustrated in FIG. 62, the coagulation inhibitor 160 further includes a shaft 161*c*, a cam 165, a pin 166, and a return spring 167.

The movable member 161 of the coagulation inhibitor 160 is an arm-shaped member and the second end 161*b* thereof is supported to be rotatable about the shaft 161*c*. The pin 166 is attached to the center of the movable member 161 to contact with the cam 165.

In this exemplary embodiment, the leading end 161*a* of the movable member 161 that serves as the arm-shaped member contacts the upper face 72*c* of the container body 72 of the toner container 70.

Figure 28B:
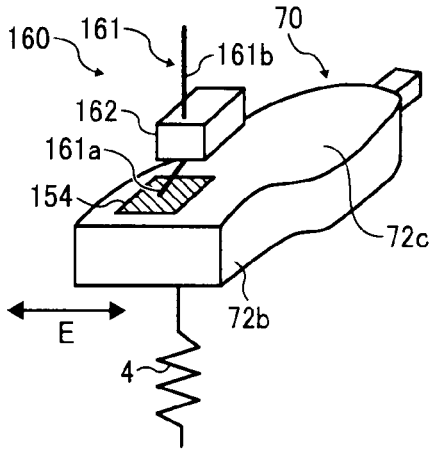
FIG. 28B is a view illustrating a state in which the medium container vibrates in a width direction thereof.

The cam 165 is rotated by the driving motor 162 to press the pin 166 so that the movable member 161 moves in the left-hand direction as illustrated in FIG. 28B. The return spring 167 serves as a biasing member to urge the movable member 161 to a direction opposite the direction to which the cam 165 presses the pin 166. One end of the return spring 167 is attached to the movable member 161 and the other end thereof is fixedly attached to the tray storage space 101, as illustrated in FIG. 62.

When the driving motor 162 rotates with this condition, the cam 165 is rotated to move the movable member 161 via the pin 166 to the left-hand side in FIG. 62. When the cam 165 is rotated and disengaged from the pin 166, the movable member 161 moves to the right-hand side in FIG. 62 by the action of the return spring 167. According to the rotational movement of the movable member 161, the upper face 72*c* of the container body 72 is slidably pressed by the movable member 161.

The movable member 161 illustrated in FIG. 62 moves in the width direction B, but the direction of movement of the movable member 161 is not limited thereto. For example, if the movable member 161 is disposed to rotatably move in the longitudinal direction A, the movable member 161 can vibrate the toner container 70 by moving on the upper face 72*c* thereof in the longitudinal direction A.

FIG. 29A through FIG. 29D illustrate a configuration of yet another coagulation inhibitor, which is a coagulation inhibitor 170.

Figure 29A:
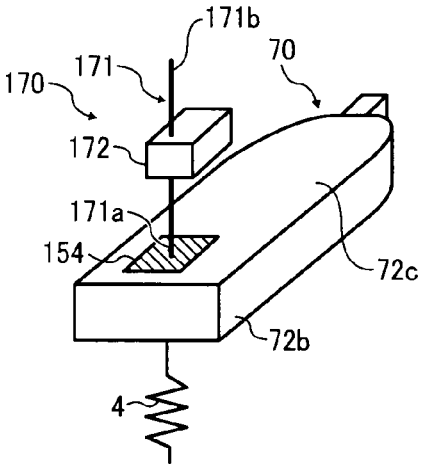
FIG. 29A is a view for explaining a structure and operation of the coagulation inhibitor that horizontally rotates to vibrate the medium container when the tray is located at the tray set position.
Figure 29B:
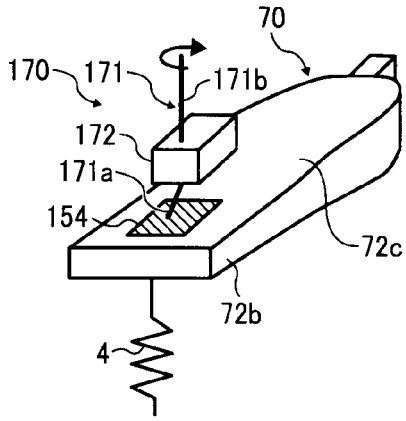
FIG. 29B is a view illustrating a state in which the trailing end of the medium container is rotated horizontally and pressed.
Figure 29C:
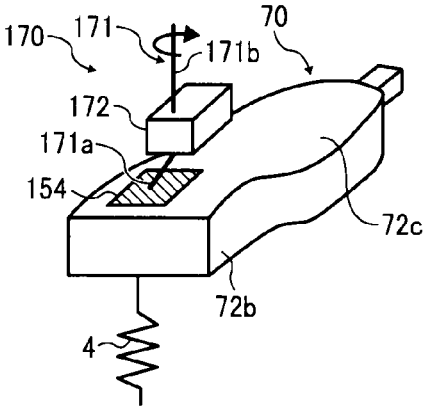
FIG. 29C is a view illustrating a state in which the end of the medium container is rotated horizontally and stretched.
Figure 29D:
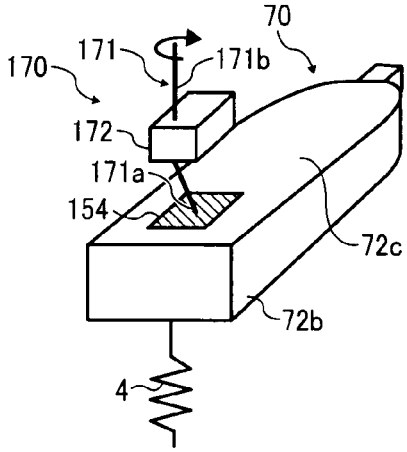
FIG. 29D is a view illustrating a state in which the end of the medium container is rotated horizontally and further stretched.

As illustrated in FIG. 29A, the coagulation inhibitor 170 vibrates the toner container 70 horizontally on the same plane. The coagulation inhibitor 170 includes a movable member 171 and a driving motor 172.

The movable member 171 contacts the trailing end 72*b* of the toner container 70 from above when the tray 1 is moved to the tray set position.

The driving motor 172 serves as a drive unit that moves the movable member 171 to vibrate the toner container 70 horizontally on the same plane.

The movable member 171 is disposed above the toner container 70 and includes a first end 171*a* and a second end 171*b*. The first end 171*a* of the movable member 171 contacts the trailing end 72*b* of the upper face 72*c* of the toner container 70 when the tray 1 is located at the tray set position. The second end 171*b* of the movable member 171 is screwed to the driving motor 172. The movable member 171 is rotated by the driving motor 172 to move horizontally on the same plane by stretching the upper face 72*c* of the toner container so as to vibrate the toner container 70.

The driving motor 172 rotates both in a forward direction and a backward direction and, for example, is fixedly mounted on the ceiling surface 102 formed on the tray storage space 101. If the movable member 171 is located in the tray storage space 101 with the tray 1 being pulled out and open, when the tray 1 is moved to the tray set position, the movable member 171 may interfere with the toner container 70. Therefore, the movable member 171 is preferably retreated to where it does not interfere with at least the upper face 72*c* of the toner container 70 until the tray 1 reaches the tray set position. Further, when the position detector 153 detects that the tray 1 is located at the tray set position, the driving motor 172 moves down the movable member 171 until the first end 171*a* of the movable member 171 contacts the upper face 72*c* of the toner container 70.

When the driving motor 172 is rotated as described above, the movable member 171 slidably moves on the upper face 72*c* on the toner container 70 to vibrate the trailing end 72*b* of the toner container 70, as illustrated in FIG. 29A through FIG. 29D, so as to move the toner vigorously. Accordingly, the toner flowability further increases because air enters between toner particles to reduce the density, and the toner becomes like liquid. As a result, as the push-up member 3 inclines, toner can be easily transported to the cap fitting 71 disposed on the medium transporting side or the inward side of the toner container 70 such that a liquid flows into the cap fitting 71, and the toner transportability of the toner container 70 can increase so that the toner can be conveyed reliably.

Figure 63:
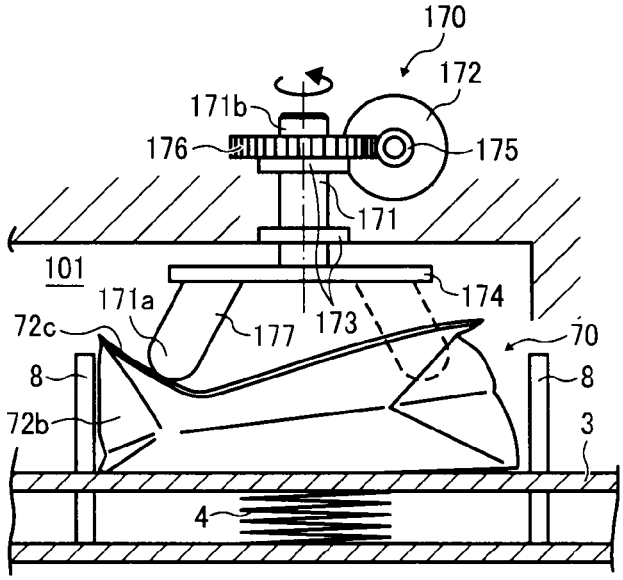
FIG. 63 is an enlarged view of another structure of the coagulation inhibitor.

Next, a description is given of a detailed structure of the coagulation inhibitor 170 with reference to FIG. 63.

As illustrated in FIG. 63, the coagulation inhibitor 170 further includes bearings 173, a disk 174, a pinion gear 175, a transmission gear 176, and a projection 177.

The movable member 171 of the coagulation inhibitor 170 includes a shaft-shaped member rotatably supported by the bearings 173. The transmission gear 176 is fixedly attached to the second end 171*b* of the movable member 171 and meshed with the pinion gear 175 that is rotated by the driving motor 172. The disk 174 that serves as a base member is fixedly attached to the movable member 171 and disposed in the tray storage space 101. The projection 177 is attached to the disk 174 to extend toward the upper face 72*c* of the container body 72 to contact the toner container 70. The projection 177 includes the leading end 171*a* of the movable member 171. Specifically, the projection 177 is disposed in an eccentric manner to the rotational center of the movable member 171 and disposed at an angle to the disk 174 so as to press the upper face 72*c* from obliquely upward. In this exemplary embodiment, only one projection 177 is attached to the disk 174. However, two or more projections 177 can be disposed in view of amount of vibration of the coagulation inhibitor 170 to the trailing end 72*b* of the toner container 70.

With this structure, the leading end 171*a* of the movable member 171 rotates to move on the same plane of the upper face 72*c* on the toner container 70 to vibrate the trailing end 72*b* of the toner container 70 so as to move the toner in the toner container 70 vigorously. As a result, the toner in the toner container 70 can be easily transported to the cap fitting 71, and the toner transportability of the toner container 70 can increase so that the toner can be conveyed reliably.

Figure 30A:
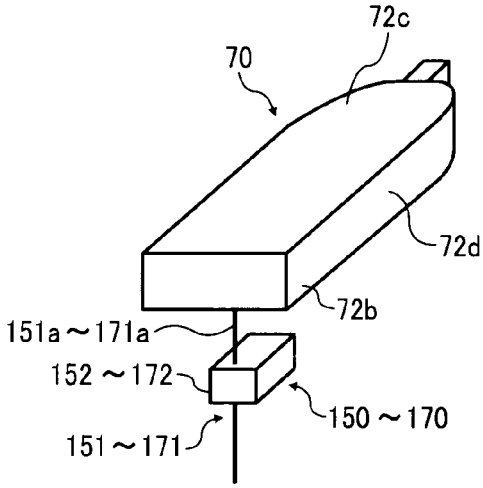
FIG. 30A is a view illustrating a state in which the coagulation inhibitor is located below the medium container when the tray is located at the tray set position.

In each of the above-described coagulation inhibitors 150, 160, and 170, the toner container 70 stored in the tray 1 is biased by the push-up member 3 and the compression coil springs 4 provided to the medium transport facilitator 2 to the movable members 151, 161, and 171, respectively, disposed above the toner container 70. However, the structures of the coagulation inhibitors 150, 160, and 170 are not limited thereto. For example, as illustrated in FIG. 30A, the movable member (i.e., the movable member 151, 161, or 171) and the driving motor (i.e., the driving motor 152, 162, or 172) of the coagulation inhibitor (i.e., the coagulation inhibitor 150, 160, or 170) are disposed below the toner container 70. With the first end (i.e., the first ends 151*a*, 161*a*, or 171*a*) of the movable member (i.e., the movable member 151, 161, or 171) contacting the trailing end 72*b* on a lower face 72*d* of the toner container 70, the driving motor (i.e., the driving motors 152, 162, or 172) can be rotated.

Figure 30B:
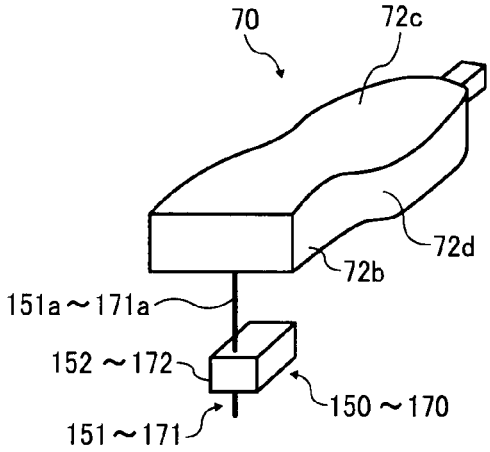
FIG. 30B is a view illustrating a state in which the trailing end of the medium container is vibrated.

With this structure, when the driving motor (152, 162, or 172) is rotated, the movable member (151, 161, or 171) slidably moves on the upper face 72*c* on the toner container 70 to vibrate the trailing end 72*b* of the toner container 70, as illustrated in FIG. 30B. Accordingly, the toner flowability further increases because air enters between toner particles to reduce the density, and the toner becomes like liquid. As a result, as the push-up member 3 inclines, toner can be easily transported to the cap fitting 71 disposed on the medium transporting side or the inward side of the toner container 70 such that a liquid flows into the cap fitting 71, and the toner transportability of the toner container 70 can increase so that the toner can be conveyed reliably.

In addition, this structure of the coagulation inhibitor (150, 160, or 170) does not require the compression coil spring 4, thereby achieving a reduction in cost.

Figure 31:
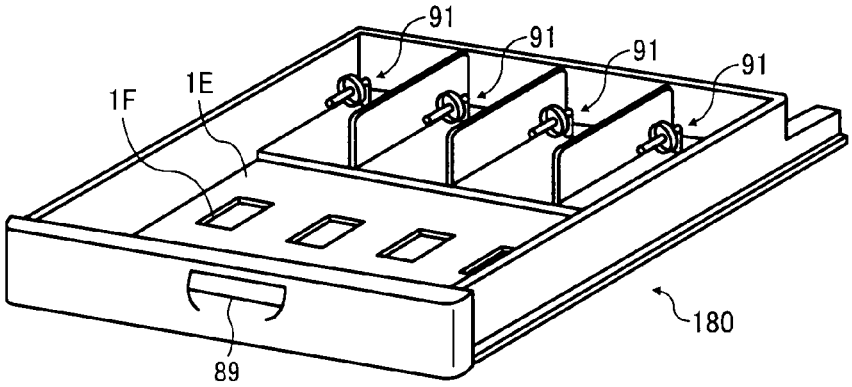
FIG. 31 is a perspective view illustrating another configuration of the tray that stores the medium containers.

Further, when the first end (151*a*, 161*a*, or 171*a*) of the movable member (151, 161, or 171) contacts the trailing end 72*b* on the lower face 72*d* of the toner container 70, the push-up member 3 is not needed. Therefore, illustrated in FIG. 31, a tray 180 without the medium transport facilitator 2 can be effectively used.

The tray 180 serving as a drawer includes openings 1F to cause the first end (151*a*, 161*a*, or 171*a*) of the movable member (151, 161, or 171) to contact the lower face 72*d* of the container body 72 of the toner container 70. The coagulation inhibitor (150, 160, or 170) disposed below the tray 180 can be connected either to the bottom plate 1E of the tray 180 directly or to the main body 100. If the coagulation inhibitor (150, 160, or 170) is connected to the main body 100, a lifting mechanism to cause the first end (151*a*, 161*a*, or 171*a*) of the movable member (151, 161, or 171) to move downward to a retreated position when the tray 180 is pulled out from the main body 100 and to move upward to contact the tray 180 when the tray 180 is inserted into the main body 100.

With the above-described structures of the coagulation inhibitors 150, 160, and 170, when the tray 1 is located at the tray set position, the driving motors 152, 162, and 172 are rotated to vibrate the trailing end 72*b* of the toner container 70. However, the coagulation inhibitors 150, 160, and 170 are not necessary to operate continuously. For example, the driving motors 152, 162, and 172 of the coagulation inhibitors 150, 160, and 170 can be rotated only during the image forming operation. By so doing, the toner contained in the toner container 70 is not excessively facilitated to move to the cap fitting 71, and therefore occurrence of toner clogging and/or toner accumulation in the vicinity of the cap fitting 71 can be reduced.

Next, a description is given of the toner container 70 that includes various types of binding members as illustrated in FIG. 32 through FIG. 43.

Referring to FIG. 32 through FIG. 35, a description is given of a medium container 610 having a binding member 603 according to a first exemplary embodiment of the present invention.

Figure 32:
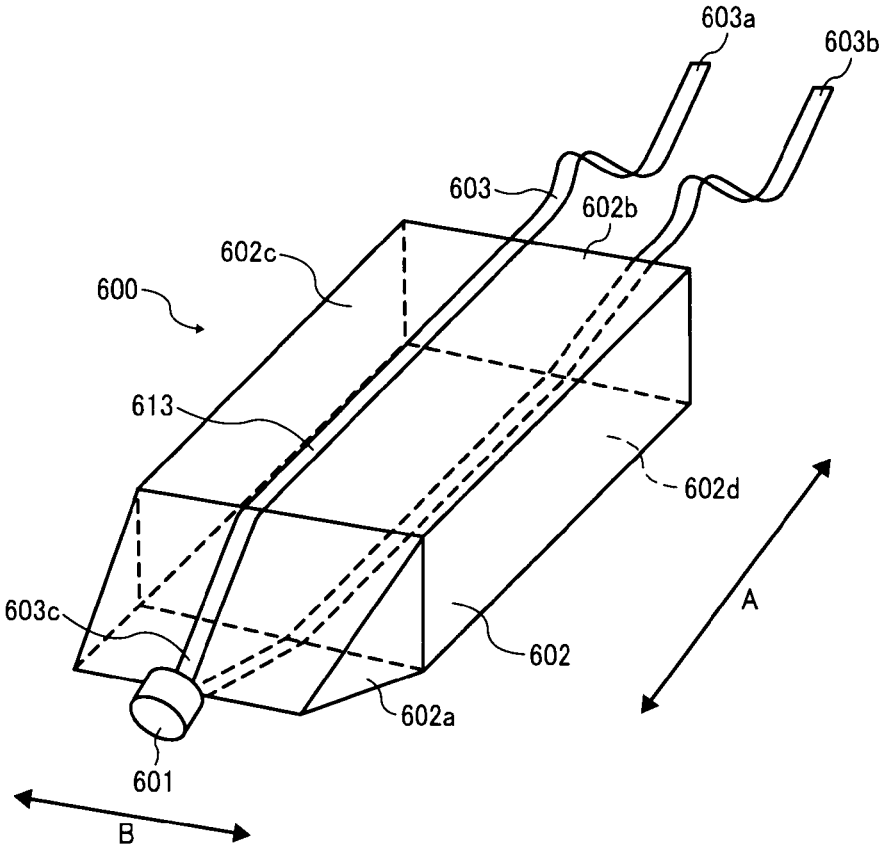
FIG. 32 is a perspective view illustrating a structure of the medium container with binding members.

As illustrated in FIG. 32, the toner container 600 is removably installable to the main body 100 of the image forming apparatus 1000 illustrated in FIG. 1. Specifically, similar to the toner containers 70 and 701, the toner container 600 can be stored in and removed from the tray 1 or the tray 180.

The toner container 600 includes a cap fitting 601, a container body 602, and the binding member 603.

The cap fitting 601 serves as a medium transport unit that is fitted to the medium receiving nozzle 91 or 91A mounted on the tray 1 or the tray 180 so as to convey the toner in the toner container 600. At least part of the container body 602 includes deformable material. The binding member 603 is mounted on the container body 602 to bind the container body 602 of the toner container 600 to compress the trailing end to the leading end of the toner container 600. Structures and materials for the cap fitting 601 and the container body 602 are same as the valve case, valve and so forth of the toner containers 70 and 701 and the cap fittings 71 and 711.

The container body 602 is a long box-shaped portion extending in the longitudinal direction A of the toner container 600. A front end 602*a* of the container body 602, which is located on a side of the toner container 600 where the toner receiving nozzle 91 or 91A is connected, is tapered vertically toward the cap fitting 601. Specifically, as illustrated in FIG. 32, the height of the front end 602*a* of the container body 602 gradually becomes smaller in a vertical direction. The cap fitting 601 is disposed at the front end 602*a* of the toner container 600.

The binding member 603 includes one string extending in the longitudinal direction A of the toner container 600. A midportion 603*c* of the binding member 603 is wound about the cap fitting 601 to be mounted on the containing portion 602. Since the length of the binding member 603 is sufficiently long, even when the binding member 603 is wound around the cap fitting 601, the remaining parts at both ends, which are a first end 603*a* and a second end 603*b*, of the binding member 603 can hang out from the trailing end 602*b* of the container body 602. In the first exemplary embodiment, one string is wound around the cap fitting 601 and engaged thereto and a part other than the wound part of the string is not fixed. For example, the container body 602 includes a top face 602*c* and a bottom face 602*d* disposed facing each other to movably attach additional part of the string to the top face 602*c* and the bottom face 602*d*.

Figure 33:
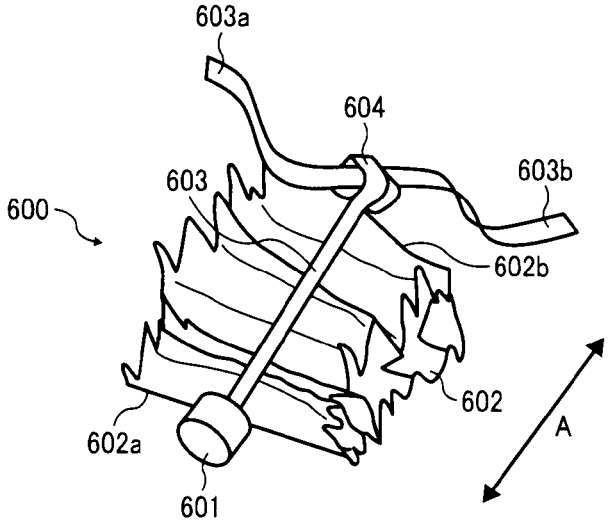
FIG. 33 is a perspective view illustrating the medium container when the medium container is bound by the binding members illustrated in FIG. 32.

When the toner in the toner container 600 having the above-described binding member 603 runs out of toner to the empty state and the toner container 600 is collected from the tray 1 or 180 or is discarded, an operator (i.e., the operator M) crosses the first end 603*a* and the second end 603*b* of the binding member 603 at the trailing end 602*b* and pulls from side to side by hands. Consequently, the container body 602 of the deformable toner container 600 is squeezed and deformed in the longitudinal direction A, decreasing in bulk, as illustrated in FIG. 33. Namely, the container body 602 is compressed from outside toward an inner direction and bound by the binding member 603, and the volume of the toner container 600 is decreased. While the volume of the squeezed toner container 600 remains decreased, the operator M can tie a knot 604 in the binding member 603 at the trailing end 602*b* of the toner container 600 to cause the squeezed toner container 600 to remain compressed and compact.

Figure 34:
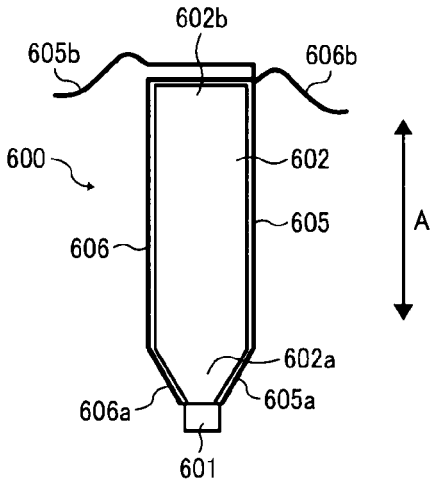
FIG. 34 is a conceptual view illustrating a state in which the medium container is bound by the binding members.

FIG. 34 illustrates a structure of binding members 605 and 606 to bind the toner container 600. As illustrated in FIG. 34, a first end 605*a* of the binding member 605 and a first end 606*a* of the binding member 606 are fixed to the front end 602*a* of the toner container 600 in the vicinity of the cap fitting 601 and located along the surface of the container body 602. With this condition, the operator M crosses the second ends 605*b* and 606*b* of the binding members 605 and 606 so that the remaining parts at the second ends 605*b* and 606*b* of the binding members 605 and 606 can hang out from the opposite side of each other.

With this structure, the operator M crosses the second ends 605*b* and 606*b* of the binding members 605 and 606 at the trailing end 602*b* and pulls from side to side by hands. Consequently, the container body 602 of the deformable toner container 600 is squeezed and deformed in the longitudinal direction A, decreasing in bulk, as illustrated in FIG. 33.

Figure 35:
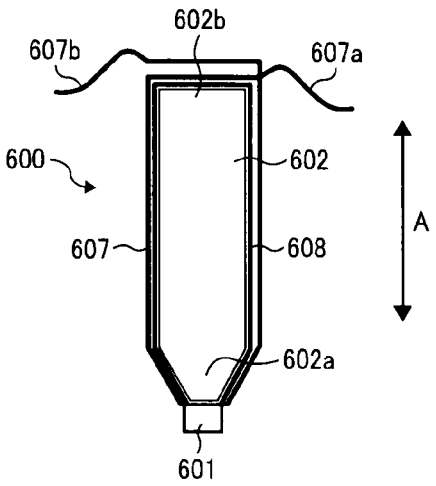
FIG. 35 is a conceptual view illustrating another state in which the medium container is bound by the binding members.

FIG. 35 illustrates a structure of a binding member 607. As illustrated in FIG. 35, the binding member 607 includes one string extending in the longitudinal direction A of the toner container 600 and forms a loop 608 by winding the binding member 607 doubly around a front end 602*a* and a trailing end 602*b* of the container body 602 in the longitudinal direction A of the toner container 600. The operator M can cross a first end 607*a* and a second end 607*b* of the binding member 607 at the trailing end 602*b* to cause the first end 607*a* and the second end 607*b* of the binding member 607 to hang out from the trailing end 602*a* of the container body 602 on the opposite side where they started from.

With this structure, the operator M crosses the first end 607*a* and the second end 607*b* of the binding member 607 at the trailing end 602*b* and pulls from side to side by hands. Consequently, the loop 608 shrinks, and the container body 602 of the deformable toner container 600 is squeezed and deformed in the longitudinal direction A, decreasing in bulk, as illustrated in FIG. 33.

Further, with this structure, even if the operator M pulls either the first end 607*a* or the second end 607*b* of the binding member 607, the loop 608 wound around the container body 602 shrinks, and the container body 602 of the flexible toner container 600 is squeezed and deformed in the longitudinal direction A, decreasing in bulk.

Accordingly, by pulling the binding member (i.e., the binding members 605 and 606 or the binding member 607) over the container body 602 of the toner container 600, the entire volume of the toner container 600 is decreased. In addition, by tying the remaining portions of the pulled binding member, the volume of the squeezed toner container 600 can remain decreased. Therefore, the operator M can keep small space for the toner containers to be discarded and can carry the discarded toner containers easily, thereby reducing a degree of effect on the environmental load in transportation and so forth. Accordingly, the toner container 600 can be compactly collected and enhance recycling efficiency and collection efficiency.

Further, as illustrated in FIG. 32 through FIG. 35, if the toner container 600 is set in the tray (i.e., the tray 1 or the tray 180) with the remaining parts at the second ends 605*b* and 606*b* of the binding members 605 and 606 or the first end 607*a* and the second end 607*b* of the binding member 607 hanging out from the trailing end 602*b* of the container body 602, the operator M can remove the toner container 600 from the tray 1 or 180. Consequently, the operator M can remove the cap fitting 601 serving as a medium transport unit from the toner container 600 without touching the toner container 600, thereby avoiding making the operator's hands dirty.

Next, referring to FIG. 36 through FIG. 39, a description is given of a toner container 610 having a binding member 613 according to another exemplary embodiment of the present invention.

Figure 36:
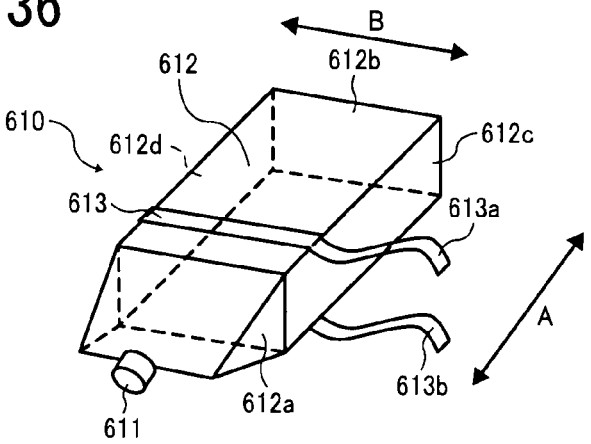
FIG. 36 is a perspective view illustrating another structure of the medium container with binding members.

As illustrated in FIG. 36, the toner container 610 serving as a medium container is removably installable to the main body 100 of the image forming apparatus 1000 illustrated in FIG. 1. Specifically, similar to the toner containers 70 and 701, the toner container 610 can be stored in and removed from the tray 1 or the tray 180.

The toner container 610 includes a cap fitting 611, a container body 612, and the binding member 613.

The cap fitting 611 serves as a medium transport unit that is connected to the medium receiving nozzle 91 or 91A mounted on the tray 1 or the tray 180 so as to convey the toner contained in the toner container 610. At least part of the container body 612 includes deformable material. The binding member 613 is attached to the container body 612 to bind the container body 612 of the toner container 610 to compress the trailing end to the leading end of the toner container 610. Structures and materials for the cap fitting 611 and the container body 612 are same as the valve case, valve and so forth of the toner containers 70 and 701 and the cap fittings 71 and 711.

The container body 612 is a long box-shaped portion extending in the longitudinal direction A of the toner container 610. A front end 612*a* of the container body 612, which is located on a side of the toner container 610 where the toner receiving nozzle 91 or 91A is connected, is tapered vertically toward the cap fitting 611. Specifically, as illustrated in FIG. 36, the height of the front end 612*a* of the container body 612 gradually decreases in a vertical direction. The cap fitting 611 is disposed at the front end 612*a* of the toner container 610.

The binding member 613 includes one string extending in the longitudinal direction A of the toner container 610 and is wound around the outside of the container body 612 of the toner container 610 from the width direction B that intersects with the longitudinal direction A of the toner container 610, and a first end 613*a* and a second end 613*b* of the binding member 603 hang out from a side surface 612*c* of the container body 612. In this case, a part of the binding member 613 is fixedly attached to a side surface 612*d* that is disposed facing the side surface 612*c*.

The direction to which the binding member 613 is seized on the container body 612 is not limited to the width direction B that intersects with the longitudinal direction A but can be a direction intersecting obliquely to the longitudinal direction A.

With this structure, an operator (i.e., the operator M) crosses and pulls the first end 613*a* and the second end 613*b* of the binding member 613 from side to side by hands when the toner container 610 is collected and discarded. Consequently, the container body 612 of the deformable toner container 610 is squeezed and deformed in the width direction B of the toner container 610, decreasing in bulk. Namely, the container body 612 is compressed from outside toward an inner direction and bound by the binding member 613, and the volume of the entire toner container 610 is decreased. While the volume of the squeezed toner container 610 remains decreased, the operator M can tie the knot 604 as illustrated in FIG. 33 in the binding member 613 at the first end 612*a* and the second end 612*b* of the toner container 610 to cause the squeezed toner container 610 to remain compressed and compact.

Figure 37:
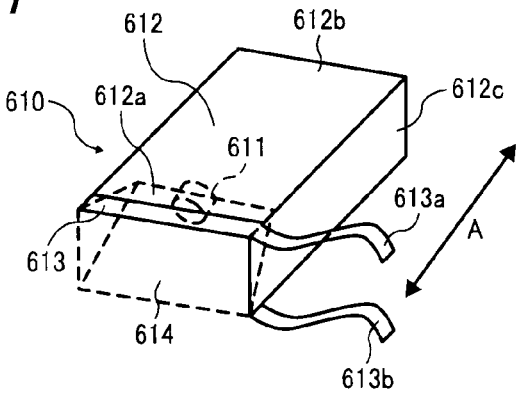
FIG. 37 is a perspective view illustrating a state in which the position of the medium transport unit is changed in the medium container of FIG. 36.

Alternatively, as illustrated in FIG. 37, the first end 612*a* of the container body 612 is deformed to include the first end 612*a* of the container body 612 pressed to the second end 612*b* of the toner container 610 so that the cap fitting 611 is included in the container body 612. Namely, the cap fitting 611 is deformed toward the second end 612*b* of the container body 612 of the toner container 610, and consequently, a space 614 is formed. The space 614 may include a volume sufficient to contain the cap fitting 611. As illustrated in FIG. 37, the space 614 is formed by pressing the first end 612*a* of the container body 612 of the toner container 610 to or in the vicinity of a position where the binding member 613 is located. However, the binding member 613 can be attached to the container body 612 of the toner container 610 to be wound around the cap fitting 611 and the space 614. Namely, the binding member 613 can be disposed at least at a position where the space 614 formed at least by the deformation can be squeezed from outside.

Figure 38:
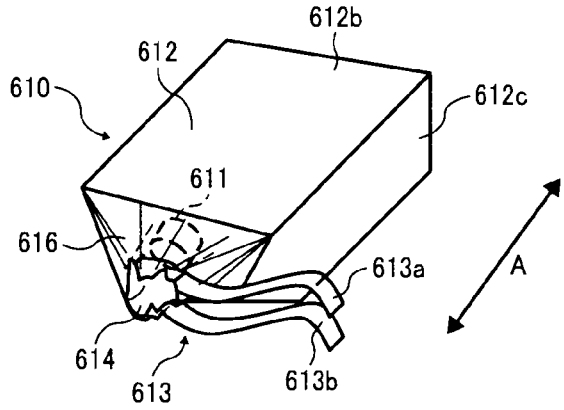
FIG. 38 is a perspective view illustrating a state of the medium container when the binding members are bound around the medium transport unit of FIG. 37.

In this case, an operator (i.e., the operator M) crosses the first end 613*a* and the second end 613*b* of the binding member 613 and pulls from side to side by hands. Consequently, as illustrated in FIG. 38, the space 614 is decreased to form a wrapping portion 616 to cover the cap fitting 611 from around and deform the first end 612*a*. Thus, the cap fitting 611 may not be exposed while the volume of the container body 612 is decreased. Accordingly, the toner container 600 can be compactly collected and enhance recycling efficiency and collection efficiency, thereby avoiding making the operator's hands dirty.

With the compressed container body 612, the operator M further crosses the first end 613*a* and the second end 613*b* of the binding member 613 at the trailing end 612*b* and pulls from side to side by hands. Consequently, the container body 612 of the deformable toner container 610 is squeezed and deformed in the longitudinal direction A, decreasing in bulk. Namely, the container body 612 is compressed from outside toward an inner direction and bound by the binding member 613, and the volume of the toner container 610 is further decreased. While the volume of the squeezed toner container 610 remains decreased, the operator M can tie a knot 615 in the binding member 613 at the trailing end 612*b* of the toner container 610 to cause the squeezed toner container 610 to remain compressed and compact.

Accordingly, by pulling the binding member 623 over the container body 612 of the toner container 610, the entire volume of the toner container 610 is decreased. In addition, by tying the remaining portions of the first end 613*a* and the second end 613*b* of the pulled binding member 613, the volume of the squeezed toner container 610 can remain decreased. Therefore, the operator M can keep small space for the toner containers to be discarded and can carry the discarded toner containers easily, thereby reducing a degree of effect on the environmental load in transportation and so forth. Accordingly, the toner container 610 can be compactly collected and enhance recycling efficiency and collection efficiency.

Next, referring to FIG. 40 through FIG. 43, a description is given of a toner container 620 having a binding member 623 according to yet another exemplary embodiment of the present invention.

Figure 40:
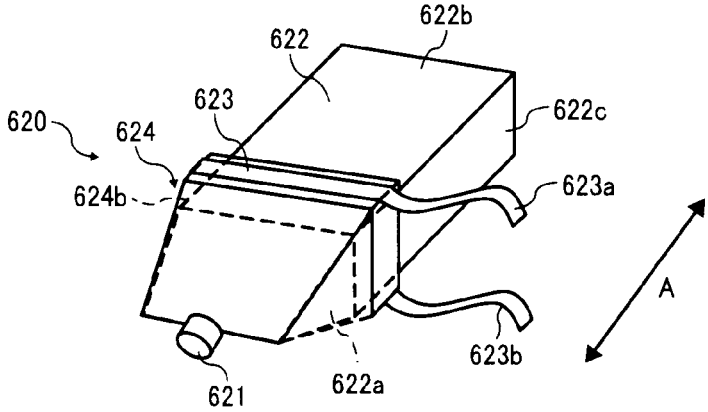
FIG. 40 is a perspective view illustrating yet another structure of the medium container having a cover with binding members.

As illustrated in FIG. 40, the toner container 620 is removably installable to the main body 100 of the image forming apparatus 1000 illustrated in FIG. 1. Specifically, similar to the toner containers 70 and 701, the toner container 620 can be stored in and removed from the tray 1 or the tray 180.

The toner container 620 includes a cap fitting 621, a container body 622, the binding member 623, and a covering member 624.

The cap fitting 621 serves as a medium transport unit that is fitted to the medium receiving nozzle 91 or 91A mounted on the tray 1 or the tray 180 so as to convey the toner in the toner container 620. At least part of the container body 622 includes deformable material. The covering member 624 is movably attached to the container body 622 has a sufficient size to cover the cap fitting 621. In this exemplary embodiment, the binding member 623 is mounted via the covering member 624 on the container body 622 to bind the container body 622 of the toner container 620 to compress a trailing end 622*b* to a leading end 622*a* of the toner container 620. Structures and materials for the cap fitting 621 and the container body 622 are same as the valve case, valve and so forth of the toner containers 70 and 701 and the cap fittings 71 and 711.

The container body 622 is a long box-shaped portion extending in the longitudinal direction A of the toner container 620. A front end 622*a* of the container body 622, which is located on a side of the toner container 620 where the toner receiving nozzle 91 or 91A is connected, is tapered vertically toward the cap fitting 621. Specifically, as illustrated in FIG. 40, the height of the leading end 622*a* of the container body 622 gradually decreases in a vertical direction. The cap fitting 621 is disposed at the leading end 622*a* of the toner container 620.

The covering member 624 has a shape similar to the appearance of the leading end 622*a* of the container body 622, which is a bag-shaped member with a half-opened portion corresponding to the cap fitting 611 to the container body 622 of the toner container 620, and is disposed at the leading end 622*a* of the container body 622 of the toner container 620 to expose the cap fitting 621.

The binding member 623 includes one string extending in the longitudinal direction A of the toner container 620 and is wound around the outside of the covering member 624 of the toner container 620 from the width direction B that intersects with the longitudinal direction A of the toner container 620, and a first end 623*a* and a second end 623*b* of the binding member 623 hang out from a side surface 622*c* of the container body 622. In this case, a part of the binding member 623 is fixedly attached to a side surface 624*b* of the conveying member 624 that is disposed facing the side surface 622*c*.

Figure 41:
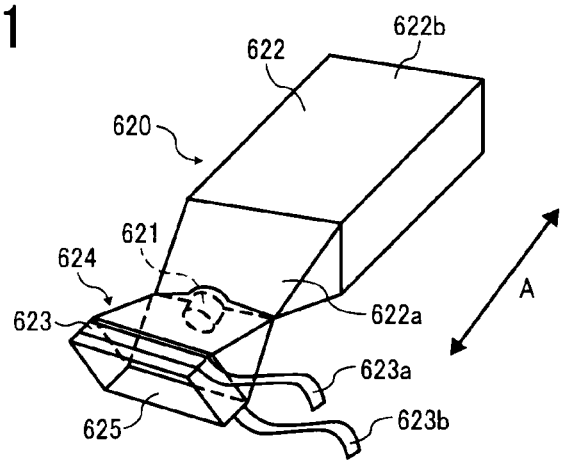
FIG. 41 is a perspective view illustrating a state in which the medium transport unit is covered by the cover illustrated in FIG. 40.

With this structure, when the toner container 620 is collected or discarded, an operator (i.e., the operator M) holds the first end 623*a* and the second end 623*b* of the binding member 623 by hands to move the covering member 624 that covers the front end 622*a* in a direction to which the cap fitting 621 is removed from the front end 622*a*. By so doing, as illustrated in FIG. 41, the covering member 624 is reversed like a hangnail to form a return space 625 to include the cap fitting 621 therein. At this time, the binding member 623 is disposed on the return space 625.

Figure 42:
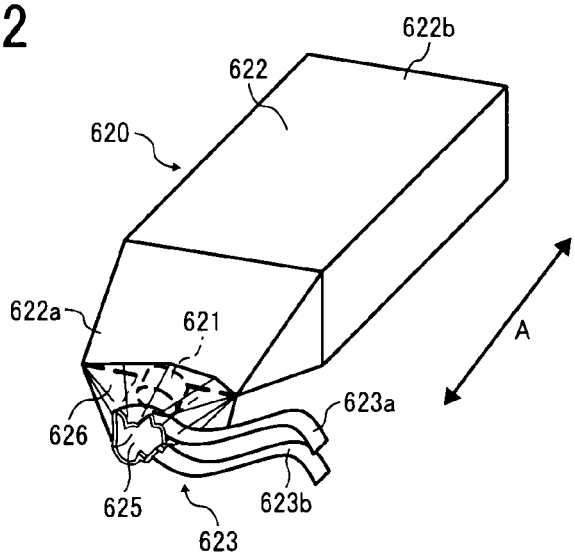
FIG. 42 is a perspective view illustrating a state of the medium container when the binding members are bound around the medium container of FIG. 41.

Under this condition, the operator M crosses the first end 623*a* and the second end 623*b* of the binding member 623 and pulls from side to side by hands. Consequently, as illustrated in FIG. 42, the space 625 is decreased to form a wrapping portion 626 to cover the cap fitting 621 from around and deform the first end 622*a*. Thus, the cap fitting 621 may not be exposed while the volume of the container body 622 is decreased.

The space 625 can include a volume sufficient to contain the cap fitting 621. As illustrated in FIG. 41, it is not necessary to fold the covering member 624 fully. Further, it is also not necessary to store the cap fitting 621 fully.

Figure 43:
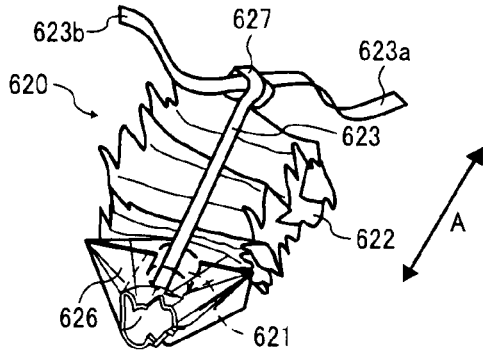
FIG. 43 is a perspective view illustrating a state of the medium container when the binding members are further bound around the medium container of FIG. 43.

With this structure, the operator M crosses the first end 623*a* and the second end 623*b* of the binding member 623 at a second end 622*b* and pulls from side to side by hands. Consequently, the container body 622 of the deformable toner container 620 is squeezed and deformed in the longitudinal direction A, decreasing in bulk, as illustrated in FIG. 43. Namely, the container body 622 is compressed from outside toward an inner direction and bound by the binding member 623, and the volume of the toner container 620 is further decreased. While the volume of the squeezed toner container 620 remains decreased, the operator M can tie a knot 627 in the binding member 623 at the trailing end 622*b* of the toner container 620 to cause the squeezed toner container 620 to remain compressed and compact.

Accordingly, by pulling the binding member 623 over the container body 622 of the toner container 620, the entire volume of the toner container 620 is decreased. In addition, by tying the remaining portions of the first end 623*a* and the second end 623*b* of the pulled binding member 623, and the volume of the squeezed toner container 620 can remain decreased. Therefore, the operator M can keep small space for the toner containers to be discarded and can carry the discarded toner containers easily, thereby reducing a degree of effect on the environmental load in transportation and so forth. Accordingly, the toner container 620 can be compactly collected and enhance recycling efficiency and collection efficiency.

Figure 39:
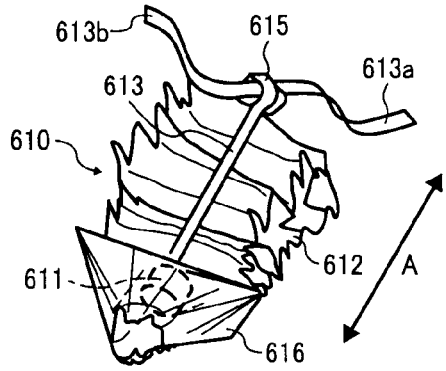
FIG. 39 is a perspective view illustrating a state of the medium container when the binding members are further bound around the medium transport unit of FIG. 38.

Since the container bodies 602, 612, and 622 described above have no crease thereon, when compressed by the binding members 603, 613, and 623 in the longitudinal direction A, respectively, the toner containers 602, 612, and 622 are crushed out of shape depending of application of an external force to the toner containers 600, 610, and 620 as illustrated in FIG. 33, FIG. 39, and FIG. 43, respectively. However, the container bodies 602, 612, and 622 can have creases on the container bodies 602, 612, and 622 thereon, respectively, and include less rigid parts intentionally, so that the toner containers 600, 610, and 620 can remain in a stylizedly folded shape or a roll shape.

The binding members 603, 613, and 623 are not limited to a form of string but can include, for example, an elastic member such as a rubber belt and a resin belt for at least a part of the string. If the elastic member is employed to form a part of the binding member (i.e., the binding member 603, 613, or 623), expansion and contraction of the binding member may increase and the pressing condition of the container body (i.e., the container bodies 602, 612, and 622) by the binding member may not vary. Consequently, this structure can avoid receiving the external force in transportation or recycling of the toner container (i.e., the toner containers 600, 610, and 620) and changing the conditions to decrease the volume of the toner container, and therefore preventing an increase in the volume of the toner container and an exposure of the cap fitting due to coming off of the binding member.

Further, the binding members 603, 613, and 623 described in the above-described exemplary embodiments can be formed using the same material as the container bodies 602, 612, and 622. By so doing, the amount of mechanical changes of the binding member due to environment becomes same as that of the container body (the container bodies 602, 612, and 622). Consequently, it is not necessary to separate recyclables, and therefore is easy to transport and dispose the separated recyclables, which can save energy at the time of manufacture.

By forming the strap 73 on the toner containers 600, 610, and 620 described above in the above-described exemplary embodiments, the toner container (i.e., the toner container 600, 610, or 620) can be compactly collected and enhance recycling efficiency and collection efficiency and can achieve better operability in setting the toner container in the tray 1 or 180.

The structure of the medium transport facilitator is not limited to that of the medium transport facilitator 2.

Referring to FIG. 44 through FIG. 60, descriptions are given of various medium transport facilitators 800, 800A, 800B, 800C, 800D, 800E, and 800F, which have different structures from the medium transport facilitator 2.

As illustrated in FIG. 44 through FIG. 60, the medium transport facilitators 800, 800A, 800B, 800C, 800D, 800E, and 800F are disposed on the tray 180 that is movable horizontally with respect to the main body 100 of the image forming apparatus 1000 illustrated in FIG. 1 between the tray open position at which the tray 180 is pulled out of the main body 100 at a maximum and the tray set position at which the tray 180 is fully inserted to the inward side of the image forming apparatus 1. The medium transport facilitators 800, 800A, 800B, 800C, 800D, 800E, and 800F are used for facilitating transportation of toner that serves as medium or media in the toner container.

Figure 84:
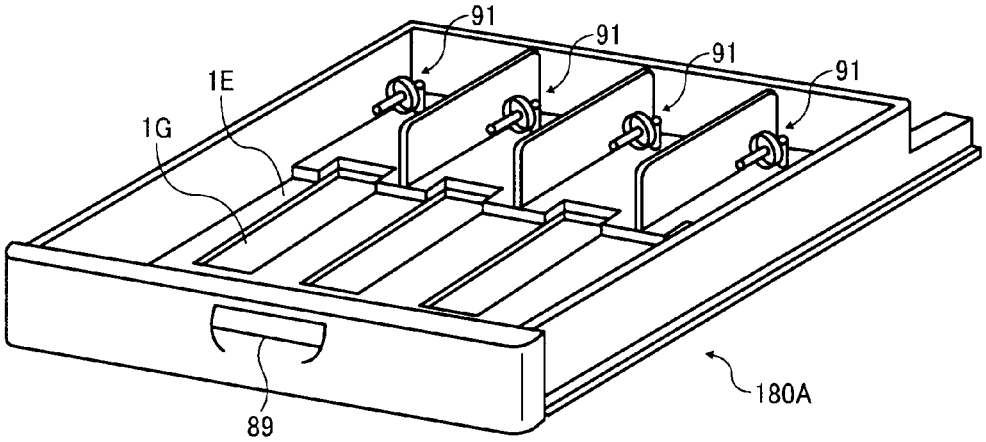
FIG. 84 is a perspective view illustrating another example of the tray for storing the medium container.

In explaining the medium transport facilitators 800, 800A, 800B, 800C, 800D, 800E, and 800F with reference to FIG. 44 through FIG. 60, a tray 180A illustrated in FIG. 84 and the toner container 70 are used. However, the toner containers 701, 600, 610, and 620 as illustrated in FIG. 9, FIG. 32, FIG. 36, and FIG. 40, respectively, can be used instead of the toner container 70.

The tray 180A includes the bottom plate 1E and openings 1G. The openings 1G in FIG. 84 are similar to the openings 1F in FIG. 31, except that the length of each of the openings 1G is longer in the tray depth direction F than the length of each of the openings 1F. With this shape, the medium transport facilitators 800, 800A, 800B, 800C, 800D, 800E, and 800F can widely contact the lower surface of the container body 72 from below through the openings 1G.

The toner container 70 is formed extending the longitudinal direction A thereof and includes the container body 72 and the cap fitting 71. The cap fitting 71 is mounted on the leading end 72*a* of the container body 72 of the toner container 70. The toner container 70 is inserted into the tray 180A from the leading end 72*a* of the container body 72 to be set and stored therein. Therefore, the trailing end of the toner container 70 corresponds to the trailing end 72*b* of the container body 72 and the surface of the toner container 70 corresponds to the surface of the container body 72. In addition, in this exemplary embodiment, a "medium transport direction G" indicates a direction to which toner contained in the container body 72 moves toward the cap fitting 71.

Now, a description is given of the structure and operations of the medium transport facilitator 800, with reference to FIG. 44 through FIG. 48.

The medium transport facilitator 800 contacts the container body 72 in the tray 180A to move the toner contained in the container body 72 in the medium transport direction G toward the cap fitting 71 that serves as a medium transport unit of the container body 72.

The medium transport facilitator 800 includes pressing members 801 and 802 that contact the surface of the toner container 70 to press the trailing end 72*b* of the container body 72, which is disposed opposite to the cap fitting 71, to deform the toner container 70 to the inward direction of the toner container 70.

Figure 45:
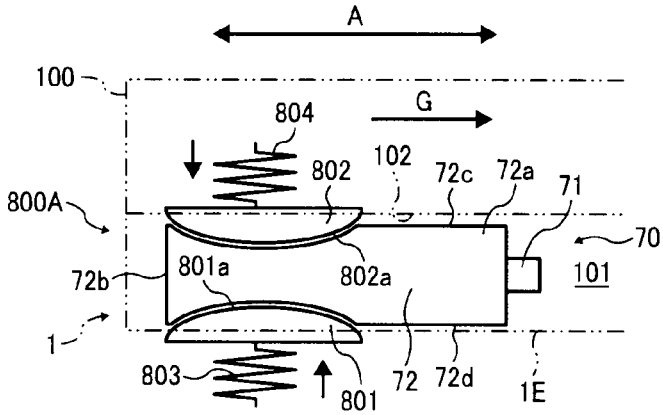
FIG. 45 is a schematic view illustrating the medium transport facilitator in which pressing members are pressed against the medium container.

As illustrated in FIG. 45, a pressing member 801 is set on the bottom plate 1E of the tray 180A to press to deform the lower face 72*d* that is a lower surface of the container body 72 from bottom to the inward direction of the toner container 70. A pressing member 802 is disposed to press to deform the upper face 72*c* that is an upper surface of the container body 72 from above to the inward direction of the toner container 70. Therefore, when the toner container 70 is stored in the tray 180*a*, the trailing end 72*b* of the container body 72 is deformed from below to the inward direction of the toner container 70.

The pressing member 802 is disposed at an upper portion 102 of the tray storage space 101 in the main body 100 to which the tray 180A is set. Therefore, when the tray 180A is set in the tray set position in the tray storage space 101, the trailing end 72*b* of the container body 72 is deformed from above to the inward direction of the toner container 70.

Namely, the medium transport facilitator 800 has the structure in which the pressing members 801 and 802 press the lower face 72*d* and the upper face 72*c* of the container body 72 from a direction different from the medium transport direction G and a pressing force generated by this action transports the toner to the cap fitting 71.

Consequently, when the trailing end 72*b* of the toner container 70 is deformed to the inward direction of the toner container 70 by the pressing members 801 and 802, the transporting force of toner to the cap fitting 71 is transmitted via the external wall of the deformable toner container 70 to the toner contained therein. Therefore, even though the toner container 70 is disposed extending horizontally, the toner can be transported toward the cap fitting 71 without using a transporting unit such as a screw, and the toner can be conveyed reliably.

As illustrated in FIG. 45, the medium transport facilitator 800 further includes compression coil springs 803 and 804 that serve as a pressing unit to bias the pressing members 801 and 802 toward the inward direction of the toner container 70. By disposing the compression coil springs 803 and 804 as above, the pressing members 801 and 802 are elastically pressed against the lower face 72*d* and the upper face 72*c* of the container body 72. Consequently, the container body 72 is deformed due to the pressing by the pressing members 801 and 802, increasing the pressure inside the container body 72. Accordingly, the toner inside the container body 72 moves to a part with lower pressure, and therefore, even the toner container 70 that is formed extending in a horizontal direction can cause the toner to be conveyed reliably. It should be noted that, if pressing members described below have a structure to press the container body 72 to the inward direction of the toner container 70, the same effect as described above can be achieved.

Further, the pressing member 801 is disposed to contact the lower face 72*d* of the container body 72 from below the tray 180A, and therefore, toner accumulating in the lower portion of the container body 72 stored horizontally in the tray 180A is moved by a force of moving the toner from the pressing member 801 to the cap fitting 71 and the force of moving the toner is transmitted via the external wall of the deformable toner container 70. Accordingly, even though the toner container 70 is disposed extending horizontally with respect to the tray 180A, the toner can be conveyed reliably. It should be noted that, if pressing members described below have a structure to press the container body 72 from below the bottom plate 1E of the tray 180A to the inward direction of the toner container 70, the same effect as described above can be achieved.

As one example, the compression coil spring 803 is disposed below the tray 180A and the compression coil spring 804 is disposed on the ceiling surface 102 of the tray storage space 101. The pressing unit is not limited to the compression coil springs 803 and 804 but different member can be applied thereto.

Figure 44:
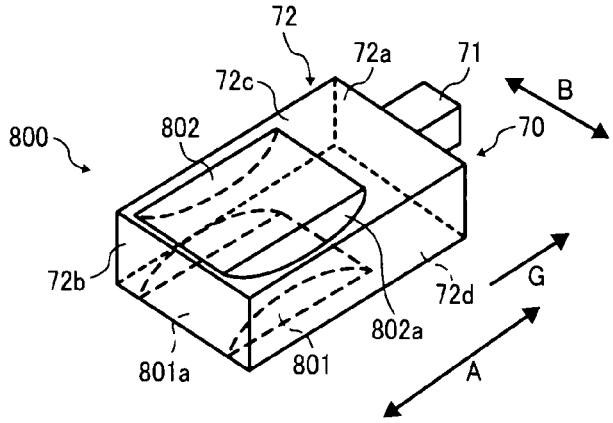
FIG. 44 is a schematic configuration diagram illustrating another configuration of the medium transport facilitator.
Figure 46:
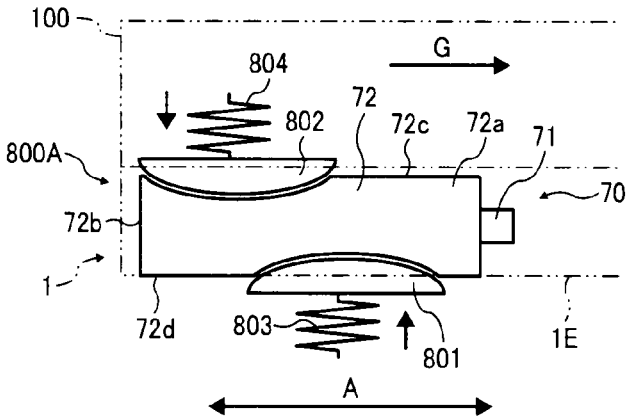
FIG. 46 is a schematic view illustrating the medium transport facilitator in which the positions of the pressing members are shifted in a longitudinal direction of the medium container.

In FIG. 44 and FIG. 45, the pressing members 801 and 802 are positioned facing in a vertical direction with the toner container 70 interposed therebetween with a gap. However, either one of the pressing members 801 and 802 can also be applied. Alternatively, even when the pressing members 801 and 802 are employed, the pressing member 801 can be disposed with appropriate shift toward the cap fitting 71, as illustrated in FIG. 46. By disposing the pressing member 801 and the pressing member 802 with appropriate shift to each other in the longitudinal direction A (i.e., the medium transport direction G), the balance of pressure applied to the inward direction of the container body 72 can be changed and the flowability of toner in the vicinity of the cap fitting 71 can increase, thereby reducing clogging in the cap fitting 71 due to toner aggregation.

The number and position of pressing members can be set and adjusted appropriately according to the characteristics of toner flow and the material of the container body 72 so as to meet the sufficient transportability of toner.

In FIG. 44 through FIG. 46, contact faces 801*a* and 802*a* of the pressing members 801 and 802 are semi-circular-shaped or parabolic-shaped. Alternatively, the contact faces 801*a* and 802*a* may be semispherical. In this case, the frictional resistance caused due to contact of the contact faces 801*a* and 802*a* with the lower face 72*d* and the upper face 72*c*, respectively, can be decreased, thereby reducing leakage of toner due to the end of durability of the toner container 70 and damage or tear of the toner container 70.

Figure 47A:
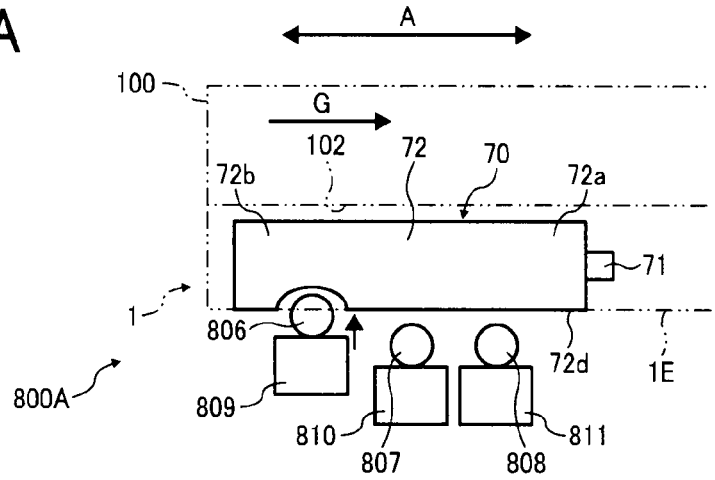
FIG. 47A is a schematic view illustrating a medium transport facilitator in which multiple pressing members are disposed in a longitudinal direction of the medium container and the trailing end of one pressing member presses the medium container.
Figure 47B:
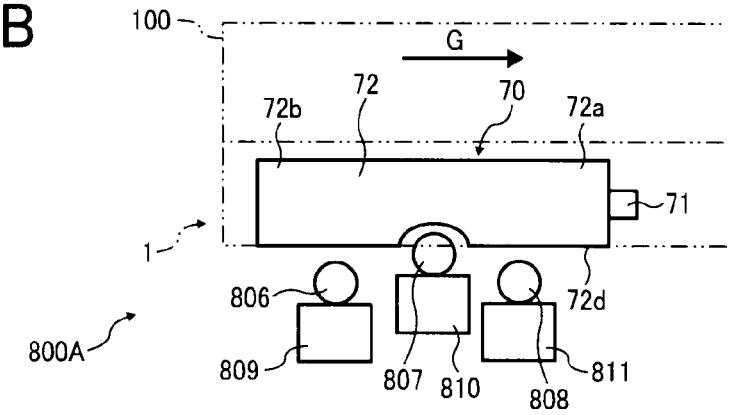
FIG. 47B is a schematic view illustrating the medium transport facilitator of FIG. 47A and the center of one pressing member presses the medium container.
Figure 47C:
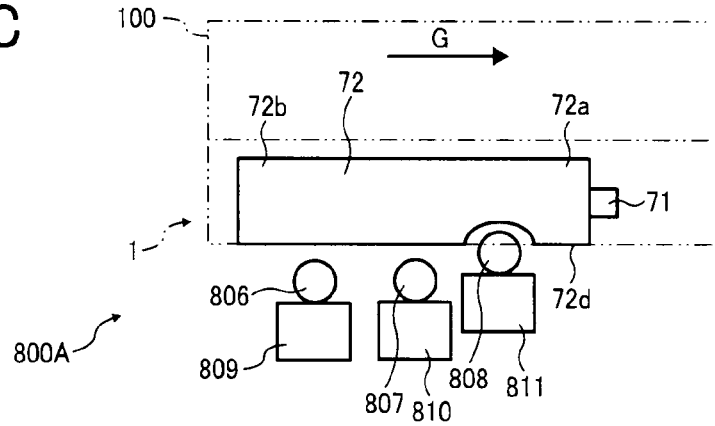
FIG. 47C is a schematic view illustrating the medium transport facilitator of FIG. 47A and the leading end of one pressing member presses the medium container.

FIG. 47A through FIG. 47C illustrate structure and functions of the medium transport facilitator 800A including pressing members 806, 807, and 808. As illustrated in FIG. 47, each of the pressing members 806, 807, and 808 of the medium transport facilitator 800A include a roller that extends in the width direction B of the toner container 70 (refer to FIG. 44). The pressing members 806, 807, and 808 are disposed below the toner container 70 in the longitudinal direction A. The pressing members 806, 807, and 808 are disposed between the leading end 72*a* and the trailing end 72*b* of the container body 72 of the toner container 70.

The pressing members 806, 807, and 808 are pressed by pressing units 809, 810, and 811, respectively, against the lower face 72*d* of the container body 72 to deform the lower face 72*d* of the container body 72 to the inside of the toner container 70.

The pressing units 809, 810, and 811 support the pressing members 806, 807, and 808, respectively, at a position at which the pressing members 806, 807, and 808 are located with a distance from the lower face 72*d* of the container body 72. At a given timing the pressing units 809, 810, and 811 release the pressing members 806, 807, and 808 to move upward to a position at which the pressing members 806, 807, and 808 press the lower face 72*d* of the container body 72. The pressing units 809, 810, and 811 also return the pressing members 806, 807, and 808 to the position separated from the lower face 72*d* of the container body 72.

In the medium transport facilitator 800A having the above-described structure, when the pressing unit 809 is started with the tray 180A being positioned in the tray set position, the pressing member 806 moves upward to push up the trailing end 72*b* of the lower face 72*d* of the container body 72, as illustrated in FIG. 47A. When the pressing unit 810 is started, the pressing member 807 moves upward to push up the center part of the lower face 72*d* of the container body 72, as illustrated in FIG. 47B. When the pressing unit 811 is started, the pressing member 808 moves upward to push up the leading end 72*a* of the lower face 72*d* of the container body 72, as illustrated in FIG. 47C. Further, when the pressing unit 810 is started, the pressing member 806 is returned to the separating position by the pressing unit 809. When the pressing unit 812 is started, the pressing member 807 is returned to the separating position by the pressing unit 810.

According to the sequence of these operations, toner contained in the container body 72 gradually moves toward the cap fitting 71 in the medium transport direction G by the forces receiving from the pressing members 806, 807, and 808.

In the medium transport facilitator 800A illustrated in FIG. 47A through FIG. 47C, the pressing members 806, 807, and 808 moved upward are returned to the separating position. However, the pressing members 806, 807, and 808 of the medium transport facilitator 800A can remain contacted with the container body 72, as illustrated in FIG. 48A and FIG. 48B, for example.

Figure 48A:
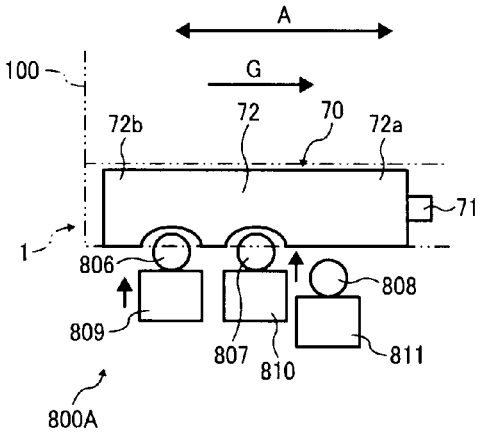
FIG. 48A is a schematic view illustrating a medium transport facilitator in which multiple pressing members are disposed in a longitudinal direction of the medium container and the trailing end of two pressing members press the medium container.

As illustrated in FIG. 48A, the pressing members 806, 807, and 808 that are moved up can remain contacted with the container body 72. Namely, once the pressing member is moved upward, it can remain contacted with the medium contacting portion 72 without being returned and other pressing members can be continuously moved up toward the cap fitting 71. FIG. 48A illustrates a state in which the pressing units 809 and 810 are started and FIG. 48B illustrates a state in which the pressing unit 811 is started.

Figure 48B:
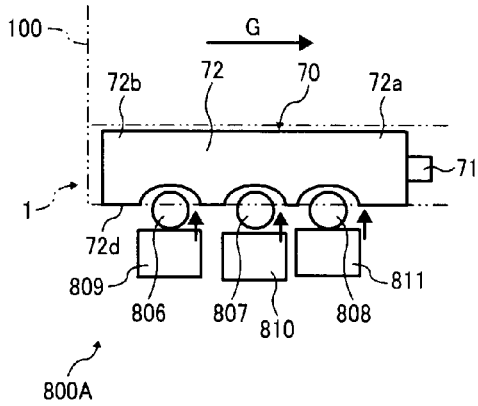
FIG. 48B is a schematic view illustrating the medium transport facilitator of FIG. 48B and each pressing member presses the medium container.

After all of the pressing members 806, 807, and 808 are moved upward to press against the container body 72, as illustrated in FIG. 48B, the pressing members 806, 807, and 808 are returned to an initial state in which none of the pressing members 806, 807, and 808 are pressed against the container body 72. Then, the pressing members 806, 807, and 808 can start the operations illustrated in FIG. 47A again.

In the medium transport facilitator 800A, the pressing members 806, 807, and 808 are roller members. Alternatively, the pressing members 806, 807, and 808 can be a sphere-shaped member, for example.

In addition, the medium transport facilitator 800A illustrated in FIG. 47A through FIG. 48B, three pressing members (i.e., the pressing members 806, 807, and 808) are provided. However, the number of the pressing members can be other than three such as one, two, four or greater. Further, the pressing members 806, 807, and 808 press the lower face 72*d* of the container body 72 from below the tray 180*a*. However, the pressing members 806, 807, and 808 can be disposed above the container body 72 to contact and press against the upper face 72*c* only. Alternatively, the pressing members 806, 807, and 808 can be disposed both above and below the container body 72 to contact and press against the upper face 72*c* and the lower face 72*d*.

With the structure of the medium transport facilitator 800A, when the container body 72 is deformed by the pressing members 806, 807, and 808, the pressure inside the container body 72 increases. Therefore, even though the toner container 70 is disposed extending horizontally on the tray 180A, the toner can be conveyed reliably.

Next, a description is given of structure and functions of medium transport facilitators 800B, 800C, 800D, 800E, and 800F having movable pressing members, with reference to FIG. 49 through FIG. 56.

Figure 49:
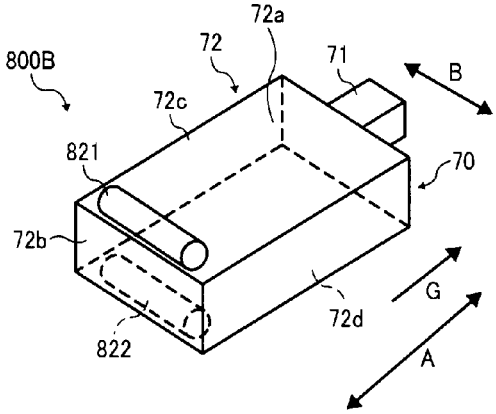
FIG. 49 is a schematic view illustrating a medium transport facilitator in which each pressing member moves in a medium transport direction.
Figure 50:
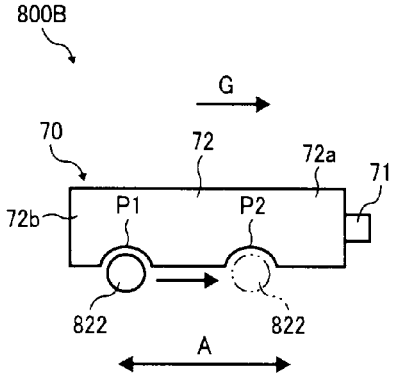
FIG. 50 is a schematic view illustrating movement of the pressing member of FIG. 49.

FIG. 49 and FIG. 50 illustrate conceptual diagrams of a medium transport facilitator 800B. The medium transport facilitator 800B includes at least a pressing member 821 or a pressing member 822 to press against at least the upper face 72*c* or the lower face 72*d*, and move the pressing member 821 or the pressing member 822. Namely, the medium transport facilitator 800B causes the pressing member (i.e., the pressing member 821 or the pressing member 822) to press against to the surface of the toner container 70 from a direction different from the medium transport direction G and slidably moves the pressing member, so as to transport the toner to the cap fitting 71. For example, in FIG. 49, the medium transport facilitator 800B includes a pressing member 821 above the upper face 72*c* of the container body 72 of the toner container 70 and a pressing member 822 below the lower face 72*d* of the container body 72 of the toner container 70, and in FIG. 50, the medium transport facilitator 800B includes only the pressing member 822 below the lower face 72*d* of the container body 72 of the toner container 70.

At this time, for example in FIG. 50, when a frictional resistance between the pressing member 822 and the lower face 72*d* of the toner container 70 is low or when sliding of the pressing member 822 on the lower face 72*d* does not matter, the pressing member 822 can slide without rotating on the lower face 72*d* with friction. By contrast, when the frictional resistance is height or when sliding of the pressing member 822 on the lower face 72*d* matters, the pressing member 822 may be rotatably disposed, for example. Accordingly, the pressing member 822 can be moved without friction. This can also be applied to the pressing member 821 that contacts the upper face 72*c*.

FIG. 50 illustrates a state in which the pressing member 822 has moved from an initial position P1 on the trailing end 72*b* to a position P2 on the leading end 72*a*. The pressing member 822 is pressed against the lower face 72*d* at the initial position P1. While pressing the lower face 72*d*, the pressing member 822 moves to the position P2. After the pressing member 822 has reached the position P2, the pressing member 822 is detached from the lower face 72*d* of the container body 72 of the toner container 70 to return to the initial position P1 without contacting the lower face 72*d*. Then, the pressing member 822 is pressed against the lower face 72*d* at the initial position P1 on the trailing end 72*b* of the toner container 70 again. By repeating the above-described actions, the toner in the container body 72 can be conveyed to the cap fitting 71.

Figure 51:
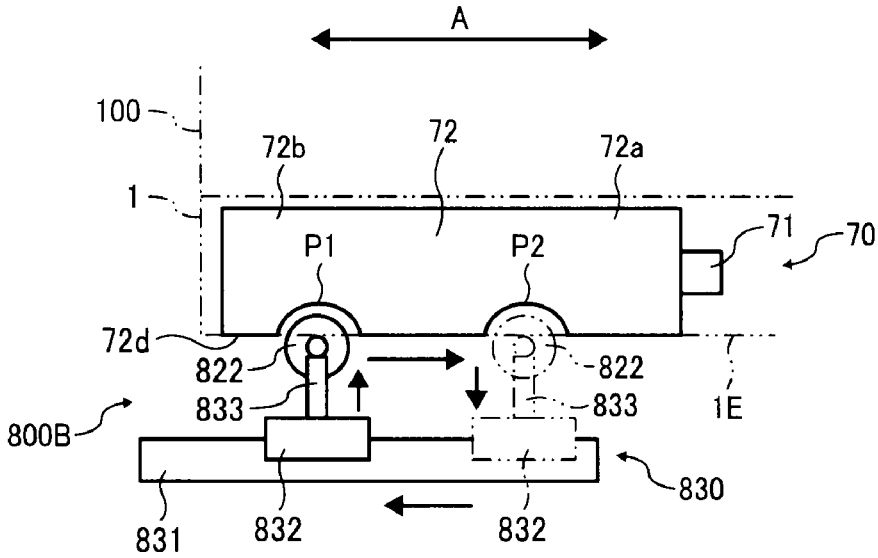
FIG. 51 is a schematic view illustrating another example of a medium transport facilitator in which each pressing member moves in the medium transport direction.
Figure 52:
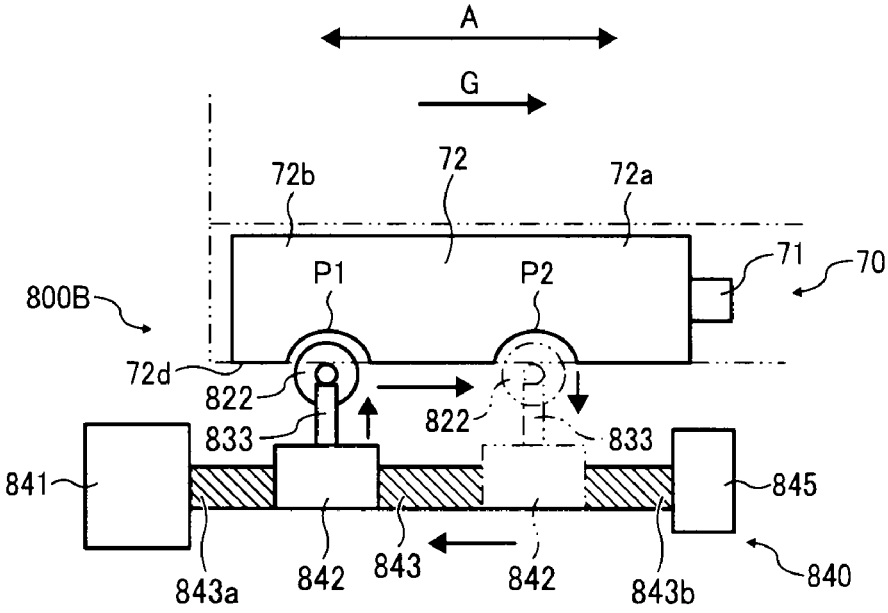
FIG. 52 is a schematic view illustrating another example of a medium transport facilitator in which each pressing member moves in the medium transport direction.

Next, a detailed description is given of the structure of the medium transport facilitator 800B with reference to FIG. 51 and FIG. 52.

As illustrated in FIG. 51, the medium transport facilitator 800B includes the pressing member 822 that presses the lower face 72*d* of the container body 72 from at least one position to the inward direction of the toner container 70, and a moving unit 830 that moves the pressing member 822 being pressed against the lower face 72*d* toward the cap fitting 71 in the medium transport direction G.

The moving unit 830 includes a linear motor 831, a movable member 832, and a supporting member 833. The linear motor 831 serves as a driving unit that extends in the longitudinal direction A of the toner container 70, which substantially corresponds to the medium transport direction G. The movable member 832 is fixedly attached to the linear motor 831. The supporting member 833 is attached to the pressing member 822 on the movable member 832.

The linear motor 831 has a known structure in which the movable member 832 moves on the same plane in the longitudinal direction A of the toner container 70, that is, the medium transport direction G. The pressing member 822 is formed by a roller that extends in the width direction B of the toner container 70 and is rotatably supported by the supporting member 833. The supporting member 833 includes a known contact and separation mechanism to press the pressing member 822 at a given time against the lower face 72*d* of the container body 72 and to detach the pressing member 822 from the lower face 72*d* of the container body 72. In this exemplary embodiment, the pressing member is pressed against the surface of the toner container 70. In this exemplary embodiment, the pressing member 822 presses a surface 822*a* thereof against the lower face 72*d* of the toner container 70.

With this structure of the medium transport facilitator 800B, when the movable member 832 is located at the initial position P1, the supporting member 833 causes the pressing member 822 to be pressed against the lower face 72*d* of the container body 72. Under this state, when the linear motor 831 starts, the movable member 832 moves toward the cap fitting 71 in the medium transport direction G. Along with this movement of the movable member 832, the pressing member 822 moves toward the cap fitting in the medium transport direction G while pressing the lower face 72*d* of the container body 72. At this time, the surface 822*a* of the pressing member 822 rotates on the lower face 72*d* toward the cap fitting 71 with a certain mechanical pressure.

When the pressing member 822 reaches the position P2, the linear motor 831 stops and the supporting member 833 causes the pressing member 822 to separate from the lower face 72*d* of the container body 72. Then, as the linear motor 831 moves toward the trailing end 72*b*, the pressing member 822 that remains detached from the lower face 72*d* moves from the cap fitting 71 to the trailing end 72*d*. When the pressing member 822 arrives at the initial position P1, the linear motor 831 is stopped. To move the pressing member 822 again, the supporting member 833 causes the pressing member 822 to move upward to press the lower face 72*d* of the container body 72 and then the linear motor 831 is started.

FIG. 52 illustrates a structure of a moving unit 840, which is another example of a moving unit for the medium transport facilitator 800B.

As illustrated in FIG. 52, the moving unit 840 includes a driving motor 841, a movable member 842, and a screw shaft 843. The driving motor 841 serves as a driving source that rotates the screw shaft 843 to both forward and backward directions. The movable member 842 moves on the screw shaft 843.

The screw shaft 843 includes a first end 843*a* that is connected to the driving motor 841 and a second end 843*b* that is rotatably supported by a bearing 845. A thread groove is formed around the screw shaft 843. The driving motor 841 and the bearing 845 are attached below the tray 180A, for example. In this exemplary embodiment, the supporting member 833 by which the pressing member 822 is rotatably supported is fixedly attached to the movable member 842.

The movable member 842 includes a thread portion that meshes with the screw shaft 843 and slidably moves on the screw shaft 843 in the longitudinal direction A according to the direction of rotation of the screw shaft 843 as the driving motor 841 rotates the screw shaft 843.

With this structure of the medium transport facilitator 800B, when the movable member 842 is located at the initial position P1, the supporting member 833 causes the pressing member 822 to press against the lower face 72*d* of the container body 72. Under this state, when the driving motor 841 rotates in the forward direction, for example, the screw shaft 843 rotates to move the movable member 842 toward the cap fitting 71 in the medium transport direction G. Along with this movement of the movable member 842, the pressing member 822 moves toward the cap fitting in the medium transport direction G while pressing the lower face 72*d* of the container body 72. At this time, the surface 822*a* of the pressing member 822 rotates on the lower face 72*d* toward the cap fitting 71 with a certain mechanical pressure.

When the pressing member 822 reaches the position P2, the driving motor 841 stops and the supporting member 833 causes the pressing member 822 to detach from the lower face 72*d* of the container body 72. Then, the screw shaft 843 rotates in the backward direction, and the movable member 842 moves from the cap fitting 71 to the trailing end 72*d*. Along with the movement of the movable member 842, the pressing member 822 that remains separated from the lower face 72*d* moves from the cap fitting 71 to the trailing end 72*d*. When the pressing member 822 arrives at the initial position P1, the driving motor 841 is stopped. To move the pressing member 822 again, the supporting member 833 causes the pressing member 822 to move upward to press the lower face 72*d* of the container body 72, and then the driving motor 841 is started.

With the structure of the medium transport facilitator 800B, the container body 72 is pressed by the pressing member 822 to increase the pressure inside the container body 72, and the pressing member 822 is moved. In this exemplary embodiment, the pressing member 822 rotates on the lower face 72*d*, and therefore the pressing member 822 receives less resistance from the lower face 72*d*, thereby providing a good flowability to the toner adhering to the inward direction of the toner container 70. Accordingly, while maintaining good durability, the toner container 70 can convey the toner therein toward the cap fitting 71 reliably.

In the medium transport facilitator 800B illustrated in FIG. 51 and FIG. 52, the pressing member 822 is a roller member. Alternatively, an unrotated pressing member provided in a medium transport facilitator 800C can slidably move on the surface of the toner container 70 with friction, as illustrated in FIG. 53A and FIG. 53B.

Figure 53A:
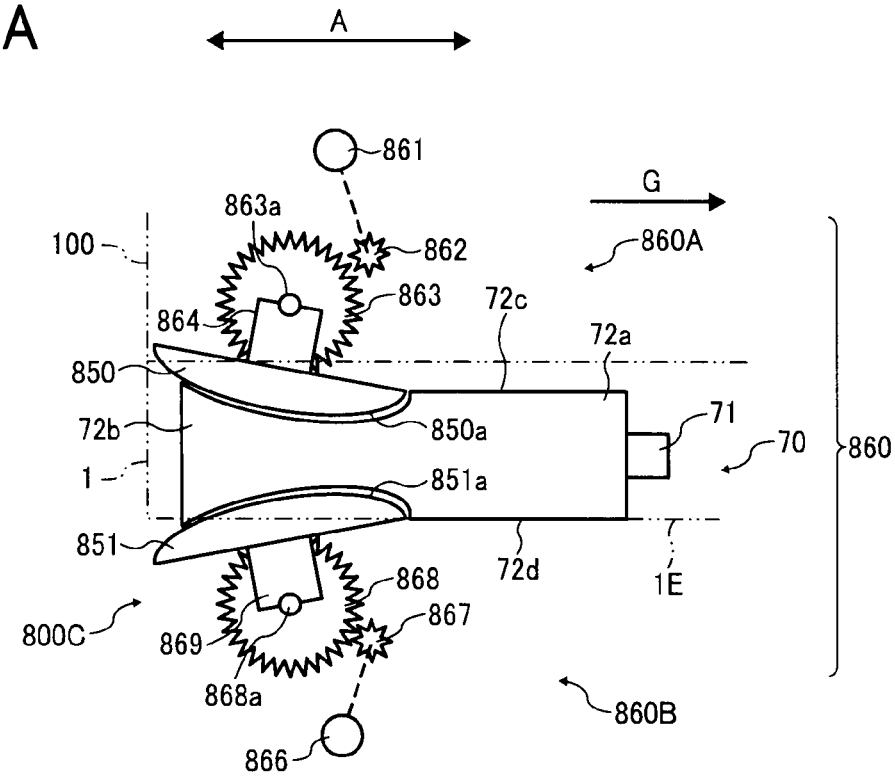
FIG. 53A is a schematic view illustrating another example of a medium transport facilitator before each pressing member moves in the medium transport direction.
Figure 53B:
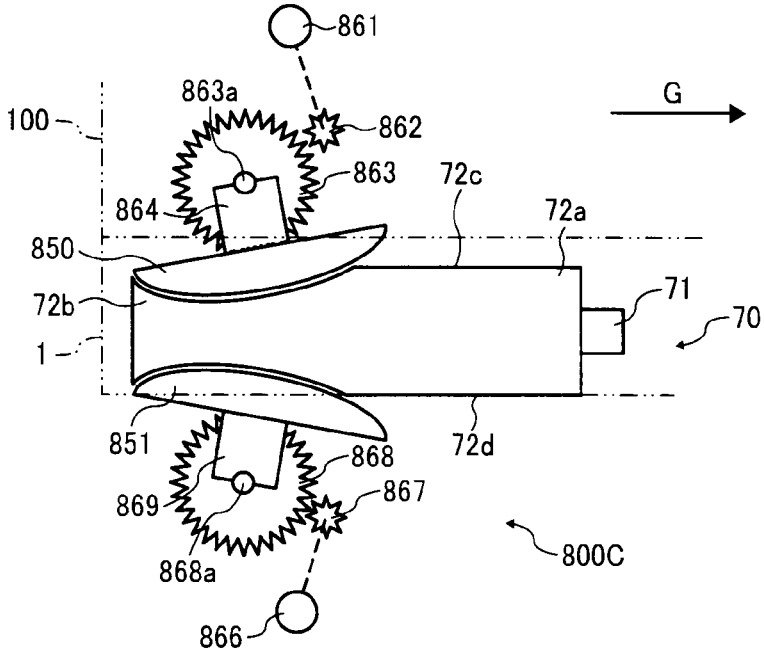
FIG. 53B is a schematic view illustrating another example of a medium transport facilitator after each pressing member moves in the medium transport direction.

Next, a detailed description is given of the structure of the medium transport facilitator 800C, referring to FIGS. 53A and 53B.

As illustrated in FIG. 53A, the medium transport facilitator 800C includes pressing members 850 and 851 and a moving unit 860. The pressing members 850 and 851 press the lower face 72*d* and the upper face 72*c* of the container body 72, respectively, from at least one position to the inward direction of the toner container 70. The moving unit 860 moves the pressing members 850 and 851 being pressed against the upper face 72*c* and the lower face 72*d* toward the cap fitting 71 in the medium transport direction G.

The pressing members 850 and 851 include pressing faces 850*a* and 851*a*, respectively. The pressing faces 850*a* and 851*a* are disposed facing each other, interposed with the toner container 70 therebetween at the trailing end 72*b* of the container body 72. The pressing member 850 is mounted on the ceiling face 102 of the tray storage space 101 and the pressing member 851 is mounted on the tray 180A.

In this exemplary embodiment, the moving unit 860 includes an upper moving unit 860A and a lower moving unit 860B. When only one of the pressing members 850 and 851 is provided to the medium transport facilitator 800C, the moving unit 860 of the medium transport facilitator 800C includes a corresponding one of the upper moving unit 860A and the lower moving unit 860B only.

The upper moving unit 860A includes a driving motor 861, a driving gear 862, a driven gear 863, and a supporting member 864. The driving motor 861 serves as a driving unit that rotates the driving gear 862 to both forward and backward directions. The driven gear 863 is rotated by the driving gear 862. The supporting member 864 is fixedly attached to the driven gear 863 and the pressing member 850.

The lower moving unit 860B includes a driving motor 866, a driving gear 867, a driven gear 868, and a supporting member 869. The driving motor 866 serves as a driving unit that rotates the driving gear 867 to both forward and backward directions. The driven gear 868 is rotated by the driving gear 867. The supporting member 869 is fixedly attached to the driven gear 868 and the pressing member 851.

The drive gears 863 and 868 are supported by shafts 863*a* and 868*a*, respectively, to rotate about the shafts 863*a* and 868*a*. Therefore, the pressing member 850 connected to the driven gear 863 via the supporting member 864 is rotatable about the shaft 863*a*. Similarly, the pressing member 851 connected to the driven gear 868 via the supporting member 869 is rotatable about the shaft 868*a*.

In the structure of the upper moving unit 860A of the medium transport facilitator 800C, the driving motor 861 is started to rotate the driving gear 862 in a clockwise direction in FIG. 53A. The driving gear 862 is meshed with the driven gear 863 to rotate in a counterclockwise direction in FIG. 53A. In synchronization with the rotation of the driven gear 863, the supporting member 864 causes the pressing member 850 to rotate about the shaft 863*a* and move the pressing face 850*a* to the position illustrated in FIG. 53B while contacting the upper face 72*c* of the container body 72 of the toner container 70.

Similarly, in the structure of the lower moving unit 860B of the medium transport facilitator 8000, the driving motor 866 is started to rotate the driving gear 867 in a counterclockwise direction in FIG. 53A. The driving gear 867 is meshed with the driven gear 868 to rotate in a clockwise direction in FIG. 53A. In synchronization with the rotation of the driven gear 868, the supporting member 869 causes the pressing member 851 to rotate about the shaft 868*a* and move the pressing face 851*a* to the position illustrated in FIG. 53B while contacting the upper face 72*c* of the container body 72 of the toner container 70.

With the structure of the medium transport facilitator 800C, the container body 72 is pressed by the pressing member 850 from above and the pressing member 851 from below to increase the pressure inside the container body 72 and the pressing members 850 and 851 are moved. In this exemplary embodiment, the pressing members 850 and 851 rotate on the lower face 72*d*, and therefore, the pressing faces 850*a* and 851*a* of the pressing members 850 and 851 moves while rotating. When the driving motors 861 and 866 are still in operation, the pressing members 850 and 851 perform one rotation to return to the positions illustrated in FIG. 53A. According to this action, the pressing members 850 and 851 keep rotating about the shafts 863*a* and 868*a*, respectively, until the driving motors 861 and 866 stop driving the driving gears 862 and 867. This continuous movement of the pressing members 850 and 851 can provide a good flowability to the toner adhering to the inside of the toner container 70. Accordingly, while maintaining good durability, the toner container 70 can convey the toner therein toward the cap fitting 71 reliably.

In this exemplary embodiment, since the driving motors 861 and 866 keep driving, the drive gears 863 and 867 remain rotating. However, if the supporting members 864 and 869 are extended and compressed, the pressing members 850 and 851 cannot contact the upper face 72*c* and the lower face 72*d* by shrinking the pressing members 850 and 851. In this case, the drive gears 863 and 867 may be reversed and the pressing members 850 and 851 may be moved reciprocally so as to be set in the positions illustrated in FIGS. 53A and 53B.

Figure 54:
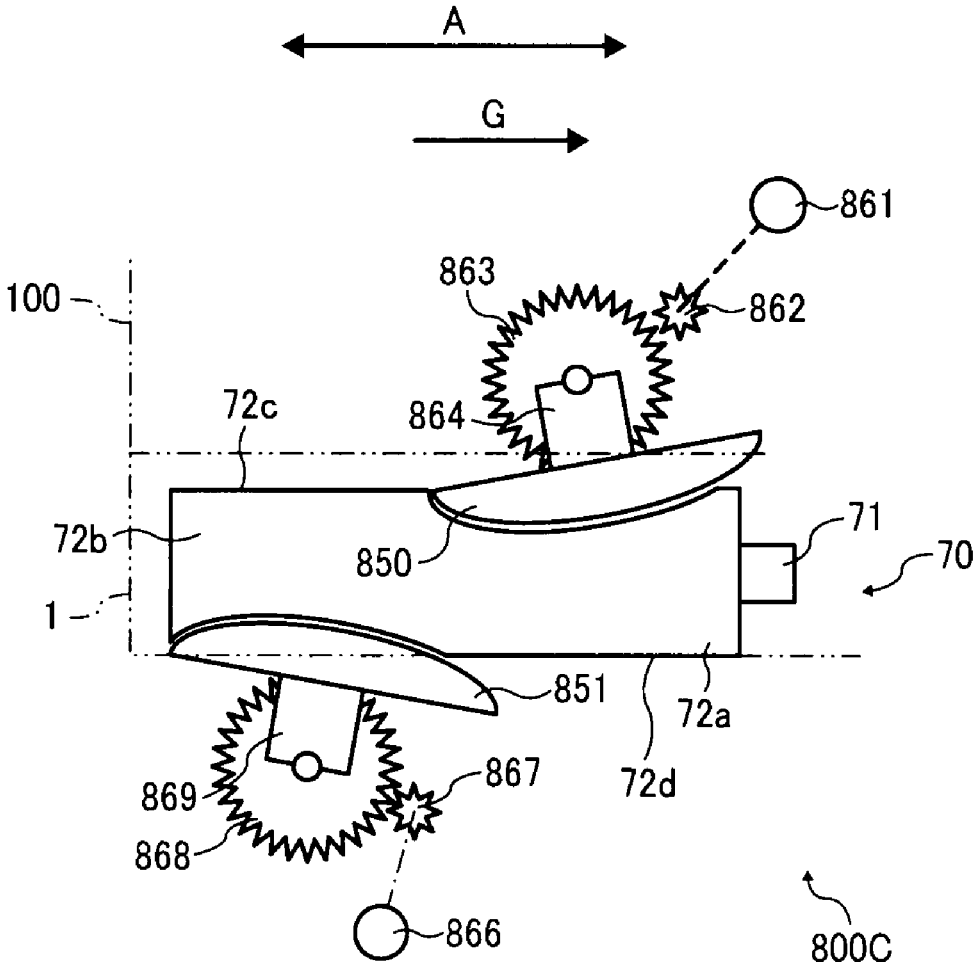
FIG. 54 is a schematic view illustrating an example of a medium transport facilitator in which a movable pressing member is shifted in a longitudinal direction of the medium container.

In FIG. 53, the pressing members 850 and 851 are disposed on the trailing end 72*b* of the container body 72. Alternatively, for the purpose of enhancing the toner transportability, the pressing member 850 may be disposed closer to the cap fitting 71 than the pressing member 851, as illustrated in FIG. 54. Further, when three or more pressing members facing each other are employed, at least one of the pressing members can be disposed with appropriate shift toward the cap fitting 71 in the longitudinal direction A of the toner container 70, which substantially corresponds to the medium transport direction G.

Next, a detailed description is given of the structure of a medium transport facilitator 800D with reference to FIG. 55A through FIG. 56B.

Figure 55A:
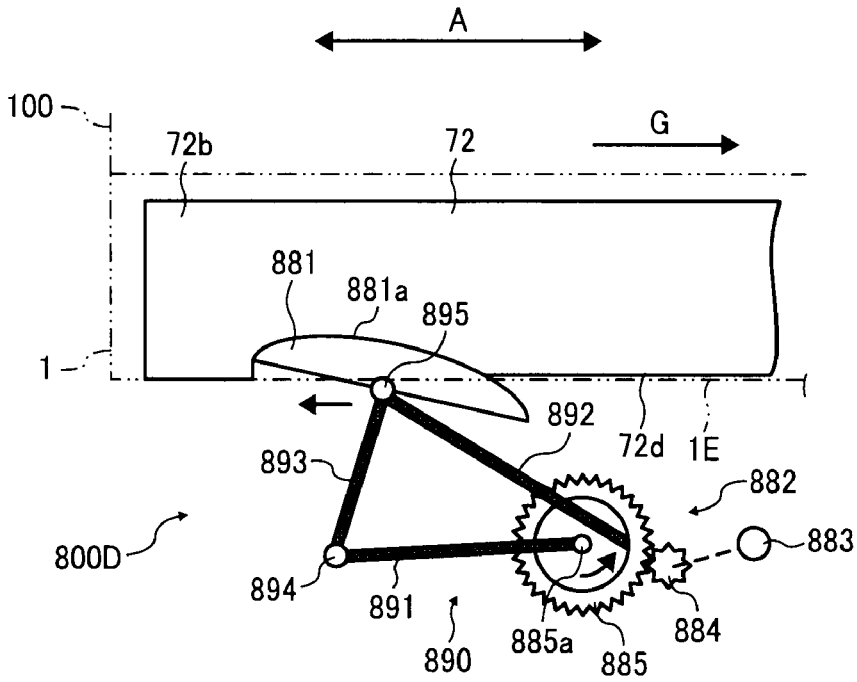
FIG. 55A is a schematic view illustrating another example of a medium transport facilitator before each movable pressing member moves in the medium transport direction.

As illustrated in FIG. 55A, the medium transport facilitator 800D includes a pressing member 881 and a moving unit 882. The pressing member 881 has a curved pressing face 881*a* pressing the lower face 72*d* of the container body 72. The moving unit 882 moves the pressing member 881 being pressed against the lower face 72*d* in the longitudinal direction A.

The moving unit 882 includes a driving motor 883, a driving gear 884, a driven gear 885, and a linking unit 890. The driving motor 883 serves as a driving unit that rotates the driving gear 884. The driven gear 885 is rotated by the driving gear 884. The linking unit 890 connects the driven gear 885 and the pressing member 881.

The linking unit 890 includes supporting members 891, 892, and 893. The supporting member 891 is supported by a rotational center 885*a* of the driven gear 885 and a fixing pin 894. The supporting member 892 is connected by pin between the outer circumference of the driven gear 885 and the pressing member 881 so as not to hinder the rotation of the driven gear 885. The supporting member 893 is connected between the pin 895 that supports the pressing member 881 and the fixing pin 894. The pin 895 is movably provided in a slot, not illustrated, which is formed extending in the longitudinal direction A of the container body 72.

Figure 55B:
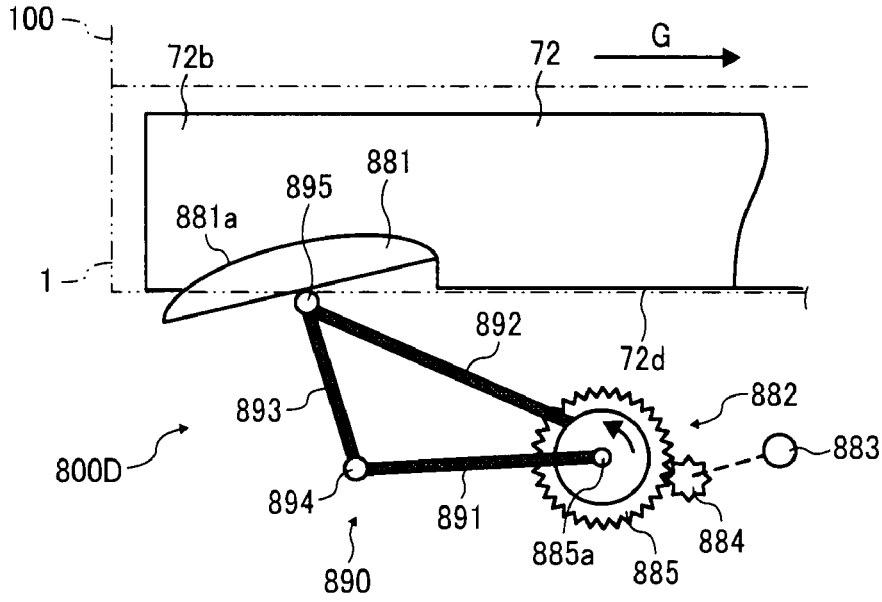
FIG. 55B is a schematic view illustrating another example of a medium transport facilitator after each movable pressing member moves in the medium transport direction.

With this structure, when the driving motor 883 starts to rotate the drive gear 884 in a clockwise direction in FIG. 55A, the driven gear 885 rotates in a counterclockwise direction in FIG. 55B. As the driven gear 885 rotates, the supporting member 892 is pressed to move to the left in the figure, so that the supporting member 893 rotates about the fixing pin 894. Since the distance of movement of the pin 895 is regulated by the slot, the supporting member 892 is pressed to move to the left in FIG. 55B toward the trailing end 72*b* of the container body 72, and consequently, the pressing member 881 is pressed toward the trailing end 72*b*. Then, as the drive gear 884 continues to rotate, the supporting member 893 starts rotating. After the supporting member 893 has gone half around, the supporting member 892 is moved back to the right in the figure, and consequently, the pressing member 881 goes back to the position in the right as illustrated in FIG. 55A.

While the above-described operations is repeatedly performed, the drive gear 884 rotates in a constant direction and the pressing member 881 is repeatedly swung. At this time, in synchronization with the movement of the pressing member 881, the pin 895 and other components are moved. By so doing, the pressing member 881 can be adjusted to press against or separate from the lower face 72*d*. Further, by using the amount of vertical movement of the driven gear 885, the amount of contact or separation of the pressing member 881 with respect to the lower face 72*d* can be adjusted.

As described above, compared to a moving unit with combinations of gears only, the moving unit 882 that includes the linking unit 890 can reduce torque that is required for the driving motor 883. At the same time, this structure can provide a good flowability to the toner adhering to the inside of the toner container 70. Accordingly, the toner container 70 can convey the toner therein toward the cap fitting 71 reliably.

Figure 56A:
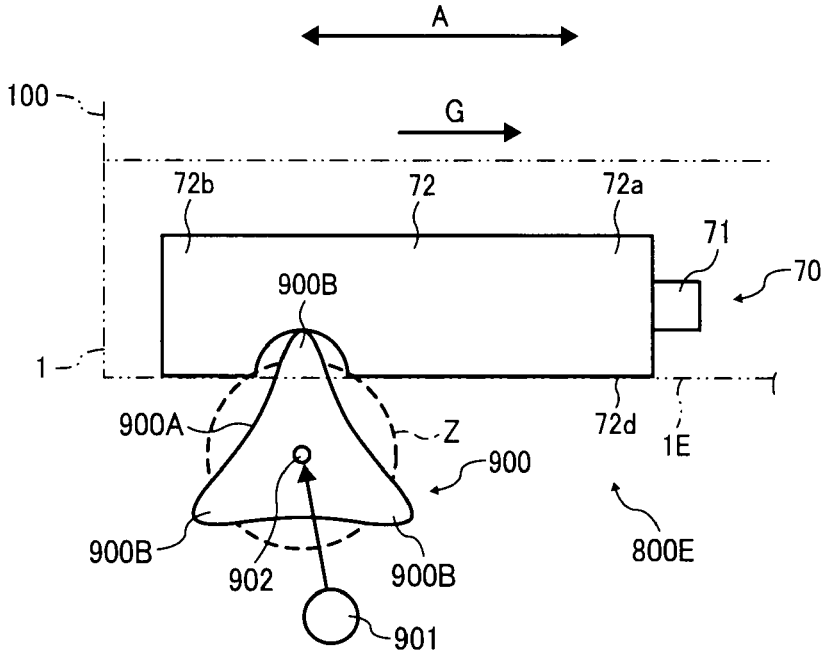
FIG. 56A is a schematic view illustrating an example of a medium transport facilitator in which a pressing member moves in a medium transport direction when the medium transport facilitator is pressed against the medium container.
Figure 56B:
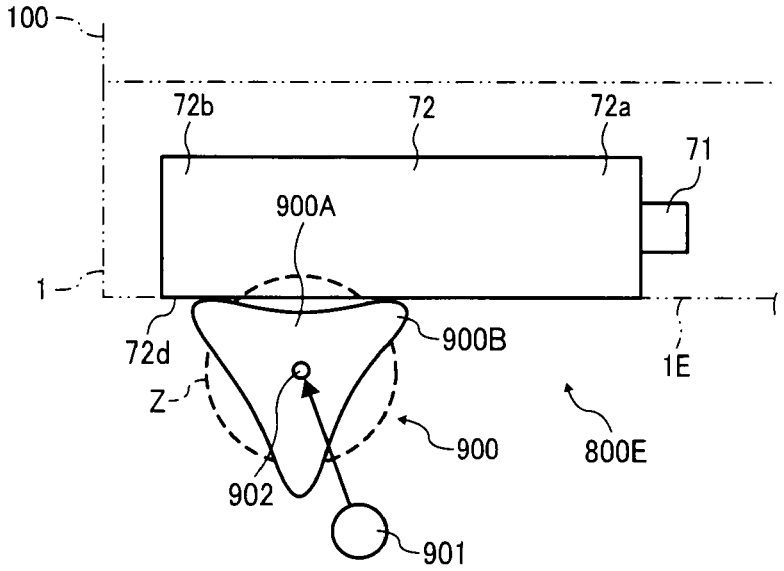
FIG. 56B is a schematic view illustrating an example of a medium transport facilitator in which a pressing member moves in a medium transport direction when the medium transport facilitator is not pressed against the medium container.

Next, a detailed description is given of the structure of the medium transport facilitator 800E, with reference to FIGS. 56A and 56B.

As illustrated in FIG. 56A, the medium transport facilitator 800E includes a pressing member 900, a driving motor 901, and a shaft 902. The pressing member 900 presses the lower face 72*d* and the upper face 72*c* of the container body 72 from at least one position to the inside of the toner container 70. The driving motor 901 serves as a driving source to rotate the pressing member 900. The pressing member 900 is disposed close to the trailing edge 70*b* and is rotatably disposed to rotate about the shaft 902, with respect to the tray 180A.

The pressing member 900 includes a recessed portion 900A and a projection portion 900B. The recessed portion 900A projects inwardly from an outer circumference of a reference circle Z and the projection portion 900B projects outwardly from the outer circumference of the reference circle Z. The projection portion 900B projects from the bottom plate 1E of the tray 180A to the inward direction of the tray 180A as the pressing member 900 rotates about the shaft 902. For the medium transport facilitator 800E illustrated in FIGS. 56A and 56B, three projection portions 900B in a direction of rotation of the pressing member 900. The pressing member 900 is a comb-teeth shaped member having multiple projection portions 900B and the recessed portions 900A alternately in the width direction B of the container body 72.

With the structure of the medium transport facilitator 800E, the driving motor 901 starts to rotate the pressing member 900 in a clockwise direction. As the pressing member 900 rotates, the projection portion 900B projects to the inward direction of the tray 180A through the bottom plate 1E, so that the lower face 72*d* of the container body 72 of the toner container 70 mounted on the bottom plate 1E is pressed by the projection portion 900B toward the inward direction thereof to deform the toner container 70, as illustrated in FIG. 56A. As the pressing member 900 further rotates, the recessed portion 900A comes to face the lower face 72*d* of the container body 72, as illustrated in FIG. 56B. At this time, the recessed portion 900A either contacts or does not contact the lower face 72*d*. In this case, the lower face 72*d* is not pressed into the container body 72 of the toner container 70 by the pressing member 900. The state of whether or not the recessed portion 900A contacts the lower face 72*d* can be set arbitrarily depending on the size of the reference circle Z.

By repeating the above-described operations of the pressing member 900, the toner in the container body 72 is conveyed to the cap fitting 71. Namely, by pressing the container body 72 from below intermittently by the projection portion 900B of the pressing member 900, the internal pressure of the toner container 70 can increase. In this exemplary embodiment, the pressing member 900 rotates about the shaft 902, and the projection portion 900B that presses the lower face 72*d* moves in an arc motion about the shaft 902. Therefore, the movement of the projection portion 900B can provide a good flowability to the toner adhering to the inside of the toner container 70 toward the cap fitting 71 in the medium transport direction G. Accordingly, the toner container 70 can convey the toner therein toward the cap fitting 71 reliably. Here, one or more of the pressing member 901 can be provided in the vicinity of the cap fitting 71 or on the upper face 72*c*.

Figure 57:
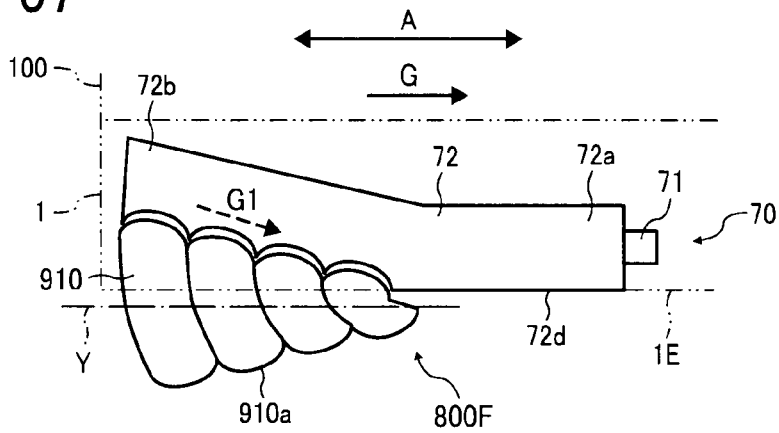
FIG. 57 is a schematic view illustrating a configuration of a medium transport facilitator in which a pressing member rotatably moves in the medium transport direction.
Figure 58:
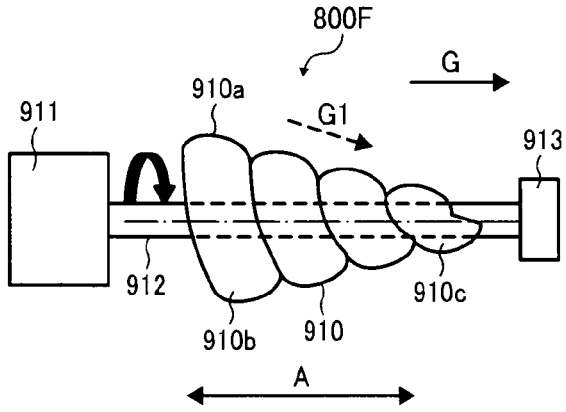
FIG. 58 is a schematic view illustrating a configuration of a medium transport facilitator in which the pressing member further rotationally moves in the medium transport direction.

Next, a detailed description is given of structure and operations of the medium transport facilitator 800F, referring to FIGS. 57 and 58.

As illustrated in FIG. 57, the medium transport facilitator 800F includes a pressing member 910 that presses the lower face 72*d* of the container body 72 from at least one position to the inward direction of the toner container 70. The pressing member 910 rotates about an axis Y to transport toner contained in the container body 72 toward the cap fitting 71 in the medium transport direction G.

Specifically, as illustrated in FIG. 58, the medium transport facilitator 800F includes the pressing member 910, a driving motor 911, a rotation shaft 912, and a bearing 913.

The driving motor 911 serves as a driving unit to rotate the pressing member 910. The pressing member 910 is disposed extending in the medium transport direction G and supported by the rotation shaft 912 disposed extending in the same direction. One end of the rotation shaft 912 is supported by the bearing 913 and the other end thereof is supported by the driving motor 911. The rotation shaft 912 is rotated by the driving motor 911.

The pressing member 910 is attached to the tray 180A such that an outer circumferential surface 910*a* of the pressing member 910 presses the lower face 72*d* of the container body 72 from the trailing end 72*b* thereof to the center part thereof. The pressing member 910 is formed to generate swell on the lower face 72*d* of the container body 72 as the driving motor 911 rotates the rotation shaft 912. Namely, the pressing member 910 has a spiral shape on the outer circumferential surface 910*a* and is tapered from a trailing end 910*b* of the pressing member 910 to a leading end 910*c* thereof. The leading end 910*c* of the pressing member 910 is located close to the cap fitting 71. Therefore, when the pressing member 910 is pressed against the lower face 72*d* through the base plate 1E of the tray 180A, the trailing end 72*b* of the container body 72 is pushed upward as illustrated in FIG. 57.

With the structure of the medium transport facilitator 800F, the driving motor 911 is started to rotate the rotation shaft 912 about its axis in a counterclockwise direction, for example, and then, the pressing member 910 is rotated as illustrated in FIG. 58, and the outer circumferential surface 910*a* is moved to the right or a direction as indicated by arrow "G1" as illustrated in FIG. 57 and FIG. 58 to the leading end 910*c*. Since the pressing member 910 is pressed against the lower face 72*d* of the container body 72, the movement of the outer circumferential surface 910*a* of the pressing member 910 generates a swell, which is transmitted to the lower face 72*d*, so that the swell generated at the lower face 72*d* moves from the lower face 72*d* toward the cap fitting 71 in the medium transport direction G. The toner in the toner container 70 is affected by a force generated due to this action and moved close to the cap fitting 71.

Namely, the lower face 72*d* of the container body 72 is deformed consistently in the medium transport direction G due to the rotation of the pressing member 910, and therefore a force of facilitating the toner in the container body 72 to be conveyed toward the cap fitting 71 in the medium transport direction G. Accordingly, even if the toner container 70 is extended horizontally, the toner container 70 can convey the toner therein toward the cap fitting 71 reliably. Further, since pressing member 910 is tapered toward the leading end 910*c* thereof, the trailing end 72*b* of the container body 72*b* can be pressed upward, thereby effectively transporting the toner by gravity toward the cap fitting 71.

Figure 59:
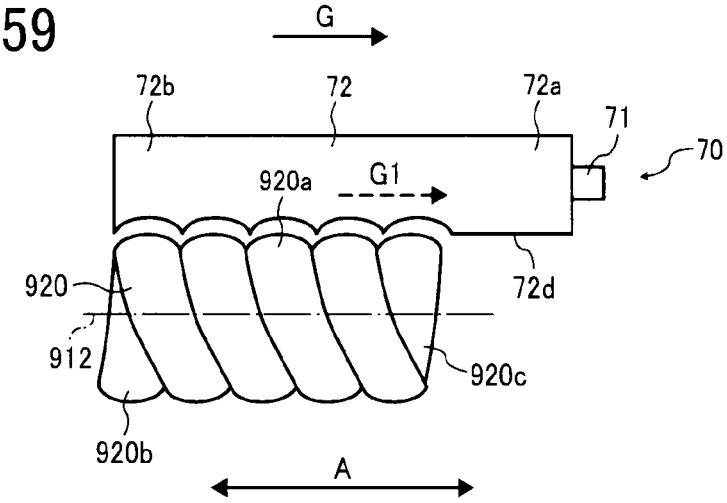
FIG. 59 is a schematic view illustrating another example of a medium transport facilitator in which a pressing member rotationally moves in the medium transport direction.

In FIGS. 57 and 58, the pressing member 910 has a spiral shape with the outer diameter being tapered toward the leading end 910*c*. However, this shape may require complex processes in manufacturing the pressing member 910 and increase cost. As a result, as illustrated in FIG. 59, a pressing member 920 can be employed instead of the pressing member 910. For example, the pressing member 920 is a cylindrical member and includes swell on a surface 920*a* thereof. For example, when the rotation shaft 912 rotates the pressing member 920, a force generated by the swell can convey the toner contained in the container body 72 to the cap fitting 71 in the medium transport direction G.

Figure 60:
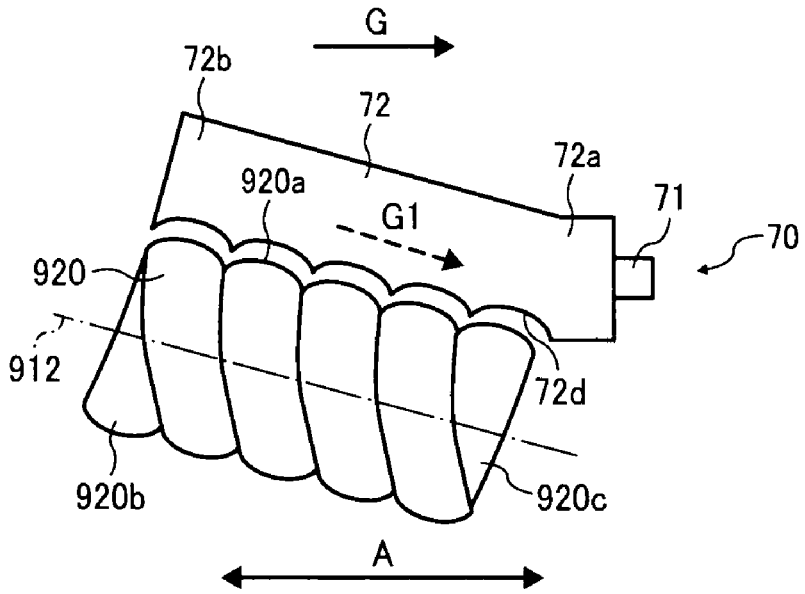
FIG. 60 is a schematic view illustrating an example of a medium transport facilitator in which a pressing member rotationally moves in the medium transport direction.

Further, as illustrated in FIG. 60, by disposing the rotation shaft 912 at an angle to locate the trailing end 920*b* of the pressing member 920 higher than the leading end 920*c* thereof, the trailing end 920*b* is lifted, thereby effectively transporting the toner by gravity toward the cap fitting 71.

Figure 61:
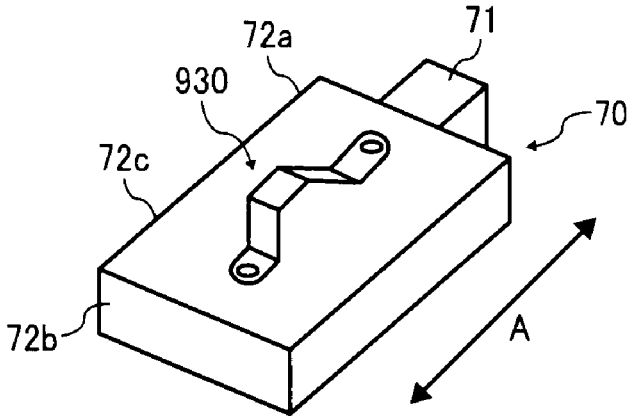
FIG. 61 is a perspective view illustrating a structure of a medium container with a grip portion.

As described above, the toner container 70 or 701 is formed by deformable material, which is difficult to maintain the outer shape. Therefore, instead of the strap 73, a grip portion 930 may be disposed on the toner container 70 or 701. For example, as illustrated in FIG. 61, the grip portion 930 can be provided to the upper face 72*c*, which is a part of the container body 72, so that the operator M can hold and carry the toner container 70. With this structure, the operator M can carry the toner container 70 easily even if the toner container 70 has a deformable shape and heavy weight, thereby storing the toner container 70 in the tray 1 and the tray 180 easily.

Figure 64:
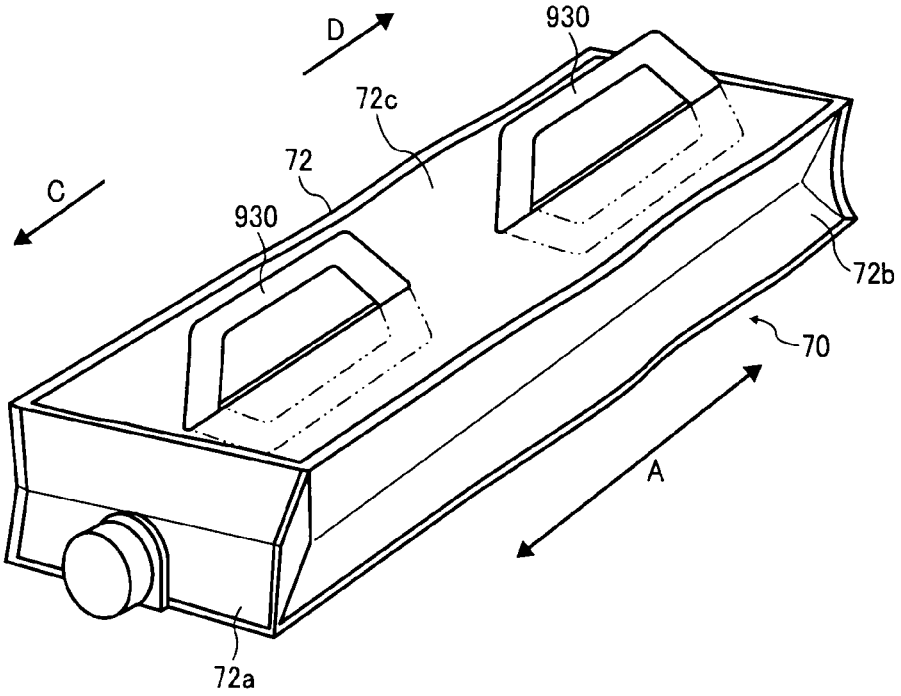
FIG. 64 is a perspective view illustrating a structure of the medium container with a grip portion.
Figure 65:
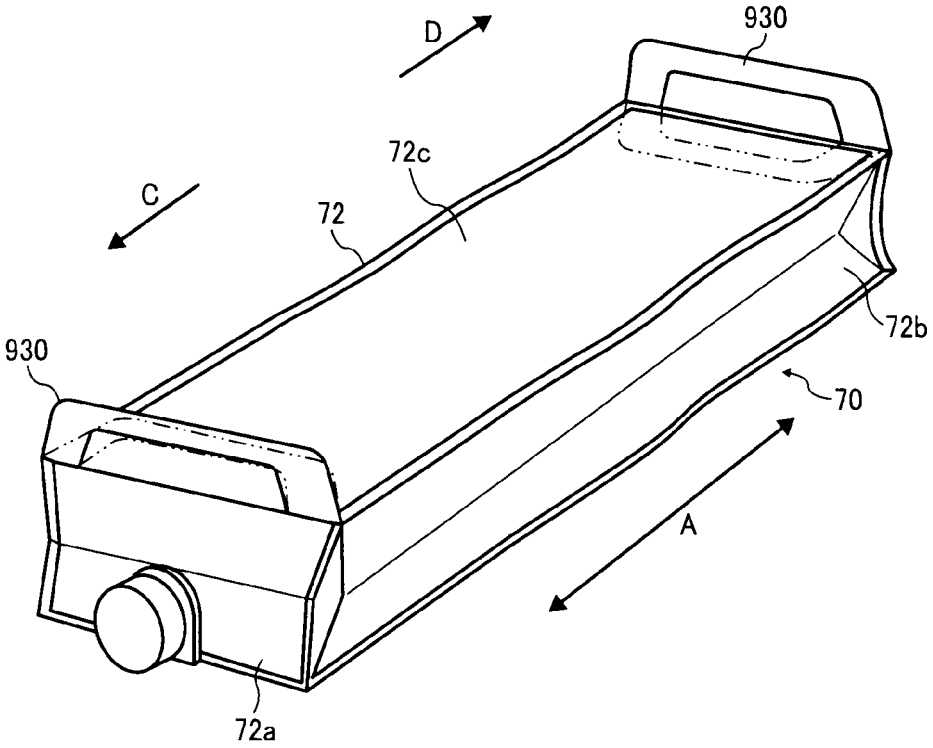
FIG. 65 is a perspective view illustrating another structure of the medium container with a grip portion.

The grip portion 930 can be two or more grip portions 930. As illustrated in FIG. 64, two grip portions 930 may be disposed in parallel along the longitudinal direction A. Alternatively, as illustrated in FIG. 65, the grip portions 930 may be disposed facing each other at the leading end 72*a* and the trailing end 72*b* of the container body 72. The grip portions 930 flexibly lie down on the upper face 72*c* as illustrated with broken lines in FIG. 64 and FIG. 65 when they are not used. By contrast, when the grip portions 930 are used, the operator M can raise them to grab for carrying the toner container 70. Accordingly, the grip portions 930 can provide a good operability by being stored in the tray 1 without avoiding the operation to set the tray 180A in the tray storage space 101.

Figure 66:
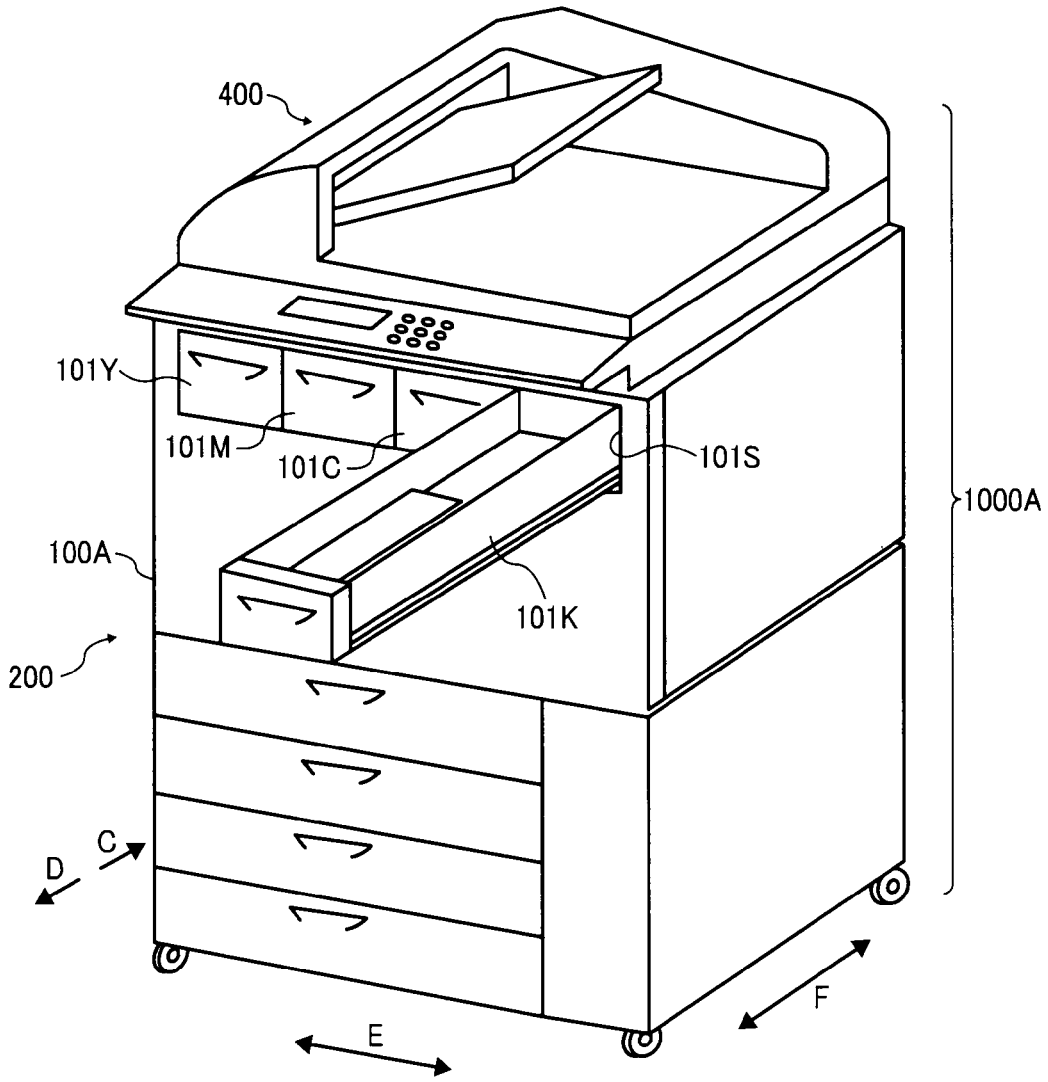
FIG. 66 is a perspective view illustrating another example of an image forming apparatus according to another exemplary embodiment of the present invention, when a tray for holding medium containers is pulled out.
Figure 67:
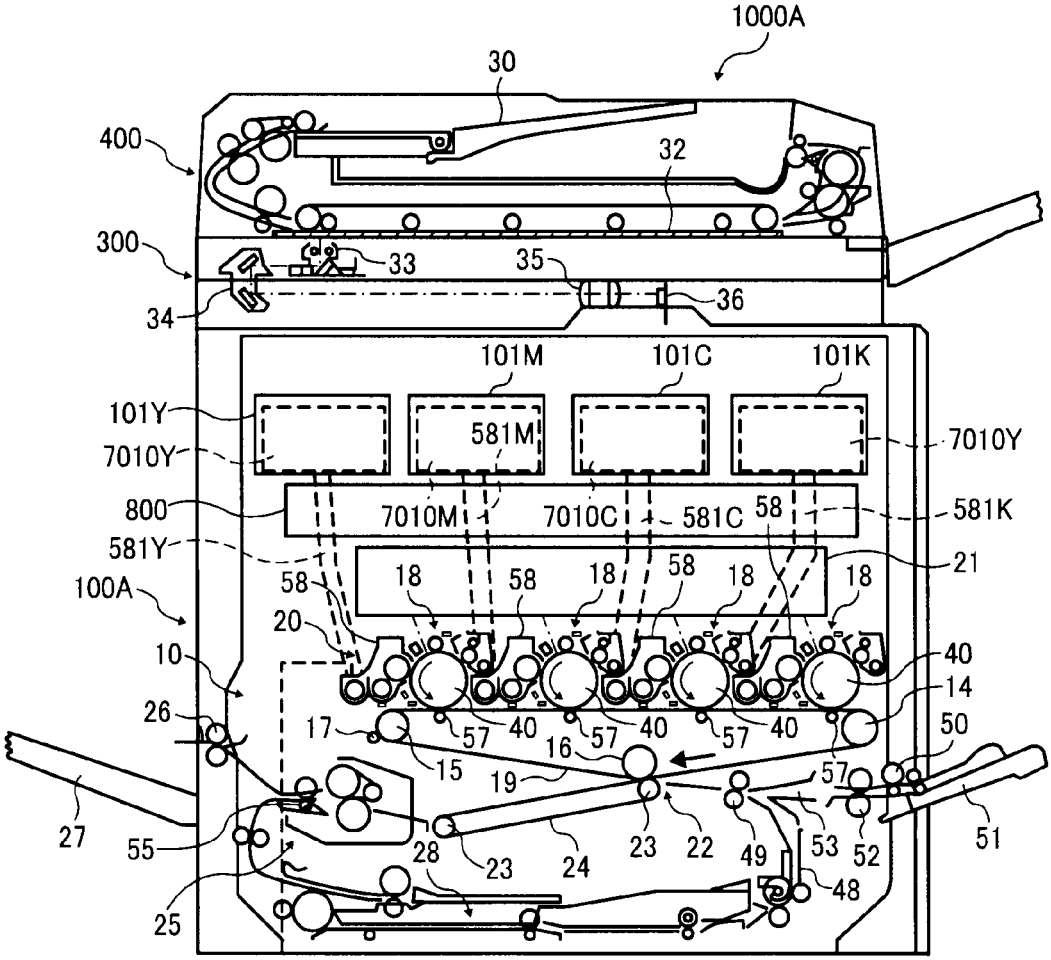
FIG. 67 is a schematic configuration of the image forming apparatus of FIG. 66.

Next, a description is given of a detailed configuration of the image forming apparatus 1000A according to another exemplary embodiment of the present invention, with reference to FIG. 66 and FIG. 67.

Elements or components of the image forming apparatus 1000A of FIG. 66 may be denoted by the same reference numerals as those of the image forming apparatus 1000 of FIG. 1 and the descriptions thereof are omitted or summarized, except the following descriptions that include differences therebetween.

While the image forming apparatus 1000 illustrated in FIG. 1 employs a conveyance method using a screw pump (i.e., the single-shaft eccentric screw pump 80) to convey toner, the image forming apparatus 1000A of FIG. 66 employs a different conveyance method that uses screw members to convey toner. Further, while the image forming apparatus 1000 of FIG. 1 stores four toner containers (i.e., the toner containers 70Y, 70M, 70C, and 70K) in one tray (i.e., the tray 1), the image forming apparatus 1000A of FIG. 66 includes individual trays for each toner color, which are trays 101Y, 101M, 101C, and 101K.

The image forming apparatus 1000A according to this exemplary embodiment of the present invention includes a main body 100A, the trays 101Y, 101M, 101C, and 101K, and a medium transport facilitator.

The trays 101Y, 101M, 101C, and 101K are removably installable to the image forming apparatus 1000A and include toner containers 7010Y, 7010M, 7010C, and 7010K. The medium transport facilitator is disposed below the trays 101Y, 101M, 101C, and 101K.

The trays 101Y, 101M, 101C, and 101K are removably inserted to a toner storage space 1015 in a horizontal direction. The toner storage space 101S is formed at an upper portion of the tandem-type image forming mechanism 20. In FIG. 66, arrow C indicates the tray closing direction and arrow D indicates the tray opening direction. The trays 101Y, 101M, 101C, and 101K are rectangular-shaped boxes with their upper portions are open. The toner containers 7010Y, 7010M, 7010C, and 7010K are stored in the trays 101Y, 101M, 101C, and 101K, respectively, as illustrated in FIG. 67. A recessed drawer pull is formed on a front side of each of the trays 101Y, 101M, 101C, and 101K for the operator M to pull and push the trays 101Y, 101M, 1010, and 101K.

The trays 101Y, 101M, 101C, and 101K are connected to the developing units 58 included in the respective image forming units 18 at the inward side of the toner storage space 101S (i.e., the inward side of the main body 100A of the image forming apparatus 1000A) via conveyance paths 581Y, 581M, 581C, and 581K, each of which includes a screw therein. A driving force generated by a driving source, not illustrated, rotates the screw provided in each of the conveyance paths 581Y, 581M, 581C, and 581K. This enables toner contained in each of the toner containers 7010Y, 7010M, 7010C, and 7010K to be supplied to the developing unit 58.

The toner containers 7010Y, 7010M, 7010C, and 7010K are set in the trays 101Y, 101M, 101C, and 101K of the main body 100A, respectively. In this exemplary embodiment, the structures of the trays 101Y, 101M, 101C, and 101K are identical to each other except for toner color, and the structures of the toner containers 7010Y, 7010M, 7010C, and 7010K are also identical to each other except for toner color. Therefore, the suffixes "Y, "M", "C", and "K" used to distinguish the colors of toners are omitted.

Figure 68:
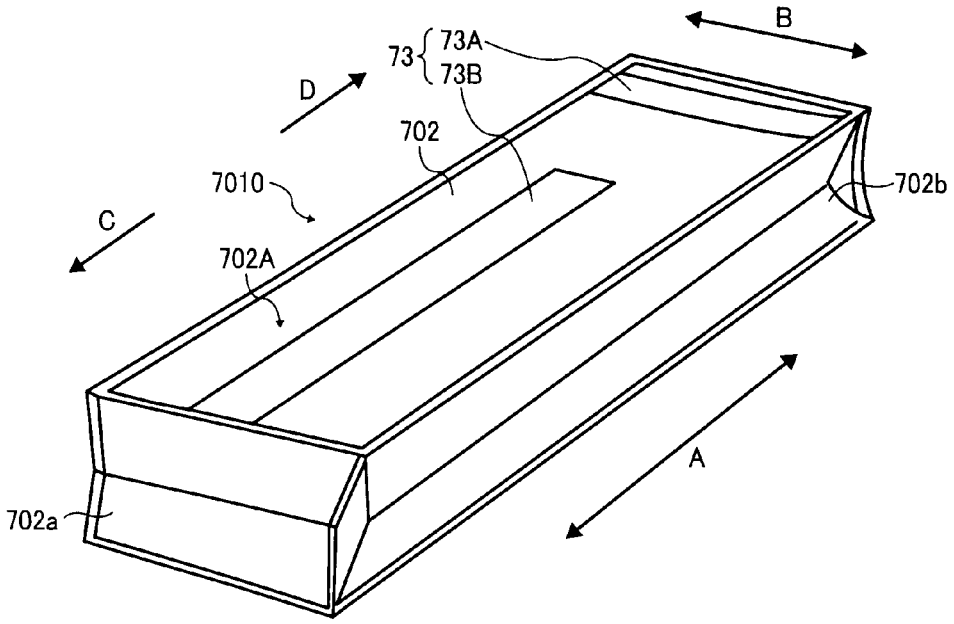
FIG. 68 is a perspective view of another example of a medium container.

As illustrated in FIG. 68, the toner container 7010 includes a container body 702, a cap fitting 703, and the strap 73.

At least a part of the container body 702 includes a bag-shaped deformable material so that the container body 72 can be a rectangular-shaped member when the toner is contained.

The cap fitting 703 is connected to a medium receiving nozzle 901 disposed on the image forming mechanism 100A.

The strap 73 serves as a grip portion that is mounted on an upper face 702A of the container body 702 and held by the operator M as illustrated in FIG. 6 through FIG. 8.

The straps 73 illustrated in FIG. 68 include the first strap 73A and the second belt 73B. The first strap 73A is attached to a trailing end 702*b* of the container body 702 of the toner container 7010, which is opposite the leading end 702*a* in a longitudinal direction A of the toner container 7010. The second belt 73B is attached to the container body 702 from the leading end 702*a* toward the trailing end 702*b* of the container body 702 along the longitudinal direction A of the toner container 7010.

The first strap 73A is a short strap that extends in the width direction B of the toner container 7010, and both ends of the first strap 73A are fixed to the container body 702. The second belt 73B is a long strap that extends in the longitudinal direction A of the toner container 7010, and one end thereof is fixed to the leading end 702*a* of the container body 702 and the other end thereof is fixed in the vicinity of the trailing end 702*b* thereof. The one end of the second belt 73B is detachable from the container body 702 by the operator M.

The container body 702 can be formed with a same material as that of the container body 72 described above.

As described above, the container body 702 has at least the straps 73 mounted on the upper face 702A of the container body 702. By so doing, when the toner container 7010 is collected or discarded, the operator M can detach the one end of the second belt 73B from the container body 702, so that the second belt 73B can be used as a binding member such as the binding member 603 as illustrated in FIG. 32 or the binding member 613 as illustrated in FIG. 36.

Figure 69:
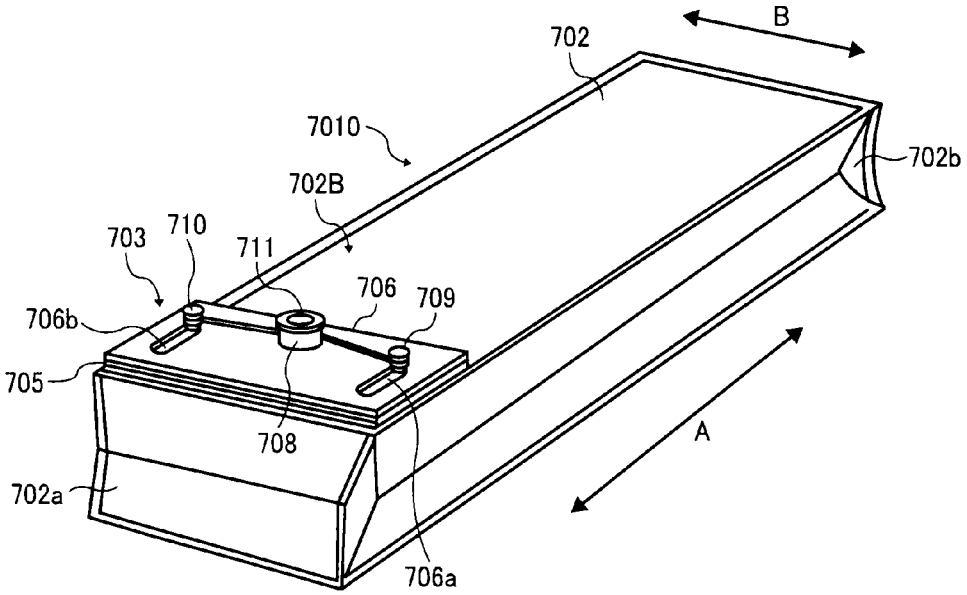
FIG. 69 is a perspective view illustrating a structure of a medium container with a medium transport unit closed.
Figure 70:
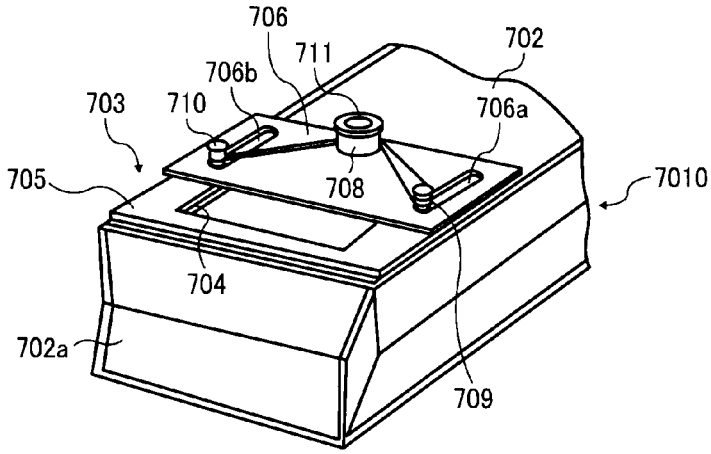
FIG. 70 is an enlarged view of the medium container with the medium transport unit open.

As illustrated in FIGS. 69 and 70, the cap fitting 703 is located at the leading end 702*a* on a lower face 702B of the container body 702. The cap fitting 703 includes an opening 704, a first rigid member 705, a shutter 706, a projection 707, a rubber band 708, and pin-shaped projection parts 709 and 710.

The first rigid member 705 has the opening 704 for transporting toner. The shutter 706 serves as a second rigid member to slide on the first rigid member 705 in the longitudinal direction A and opens and closes the opening 704. The rubber band 708 serves as a biasing member. A center part 708*c* of the rubber band 708 is wound around the projection 707 formed at the center of the shutter 706 and both ends 708*a* and 708*b* of the rubber band 708 are engaged with the pin-shaped projection parts 709 and 710 mounted on the first rigid member 705, respectively. The first rigid member 705 having the opening 704 is fixedly attached to the container body 702 so as to be aligned with a toner outlet portion 702C that is formed on the leading end 702*a* of the container body 702.

Figure 71A:
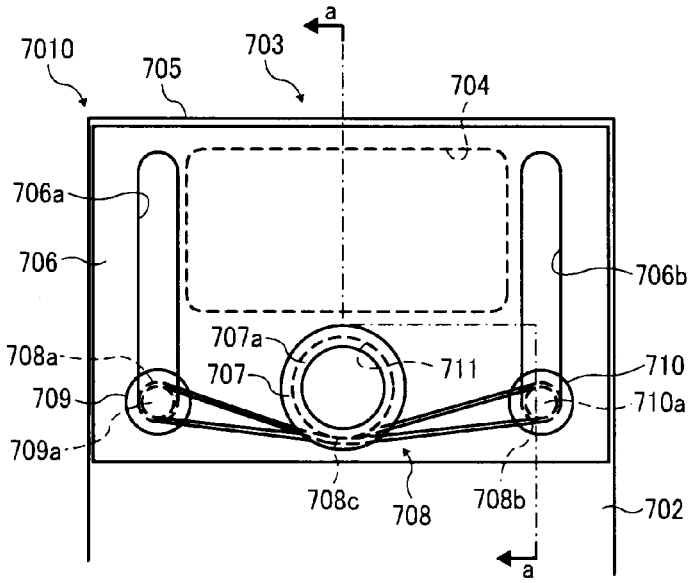
FIG. 71A is a plane view illustrating the medium transport unit mounted on the medium container closed.
Figure 71B:
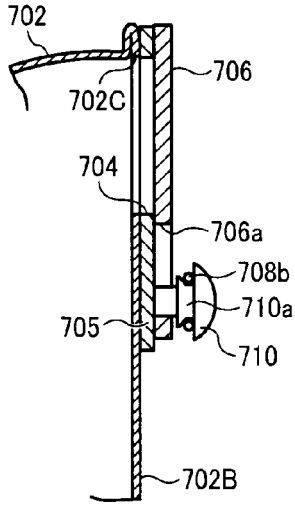
FIG. 71B is a cross-sectional view of the medium transport unit, taking along the line a-a in FIG. 71A.
Figure 72A:
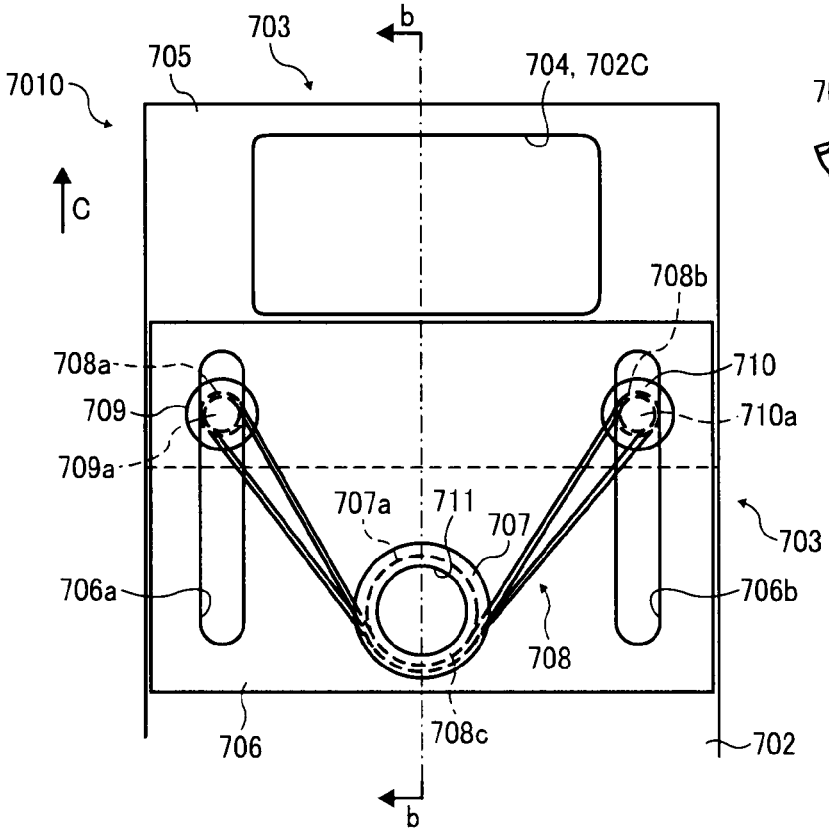
FIG. 72A is a plane view illustrating the medium transport unit mounted on the medium container open.
Figure 72B:
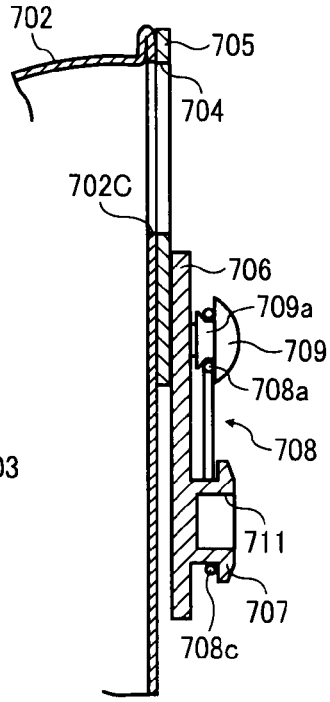
FIG. 72B is a cross-sectional view of the medium transport unit, taking along the line b-b in FIG. 72A.

A description is given of the structure of the shutter 706, with reference to FIGS. 71A through 72B. FIG. 71A illustrates the cap fitting 703 mounted on the toner container 7010 when the cap fitting 703 is closed. FIG. 71B illustrates a cross-sectional view of the cap fitting 703, taking along the line a-a in FIG. 71A. FIG. 72A illustrates the cap fitting 703 mounted on the toner container 7010 when the cap fitting 703 is open. FIG. 72B illustrates a cross-sectional view of the cap fitting 703, taking along the line b-b in FIG. 72A.

As illustrated in FIGS. 71A, 71B, 72A, and 72B, the shutter 706 includes slots 706*a* and 706*b*. The slots 706*a* and 706*b* extend in the longitudinal direction A of the toner container 7010 and are disposed at both lateral side ends in the width direction B of the toner container 7010 with the projection 707 as the center thereof. The projection parts 709 and 710 are disposed along the width direction B with the projection 707 as the center of a symmetrical arrangement and run through the slots 706*a* and 706*b*, respectively. The shutter 706 is supported by the slots 706*a* and 706*b* and the projection parts 709 and 710, respectively, to enable parallel shift on the first rigid member 705. Flanges 709*a* and 710*a* are formed on the projection parts 709 and 710, respectively. The flanges 709*a* and 710*a* contact the tray base portion 101*a*, and therefore have a curved face to set the toner container 7010 thereupon without being caught by the tray base portion 101*a*.

The projection 707 is a cylindrical member having a flange wall 707*a* at an end, and includes a hole 711 at the center. The hole 711 serves as an engaging unit to engage with a positioning boss 722, described later, that serves as an engaged unit mounted on the tray base portion 101*a*.

In this exemplary embodiment, as illustrated in FIGS. 71A and 71B, the rubber band 708 that serves as a biasing member contacts the center part 708*c* to an outer circumference of the flange wall 707*a* of the projection 707 from an opening direction of the shutter 706 with light tension. The both ends 708*a* and 708*b* are wound around the outer circumference of the projection parts 709 and 710, respectively. In this condition, the rubber band 708 presses the flange wall 707*a* of the outside edge of the projection 707 with the internal force of the rubber band 708. Therefore, force must be applied to open the shutter 706. Accordingly, the shutter 706 (i.e., the cap fitting 703) is closed.

FIGS. 72A and 72B illustrate the toner container 7010 with the shutter 706 (i.e., the cap fitting 703) open. In this condition, when the toner container 7010 moves to the tray closing direction C, the positioning boss 722 of the tray engages the hole 711 of the projection 707. When the toner container 7010 moves to the tray closing direction C with this condition, the shutter 706 moves in a direction that exposes the opening 705. This movement extends the rubber band 708, and therefore, the rubber band 708 exerts internal countervailing force in the direction of closing the shutter 706.

Figure 73A:
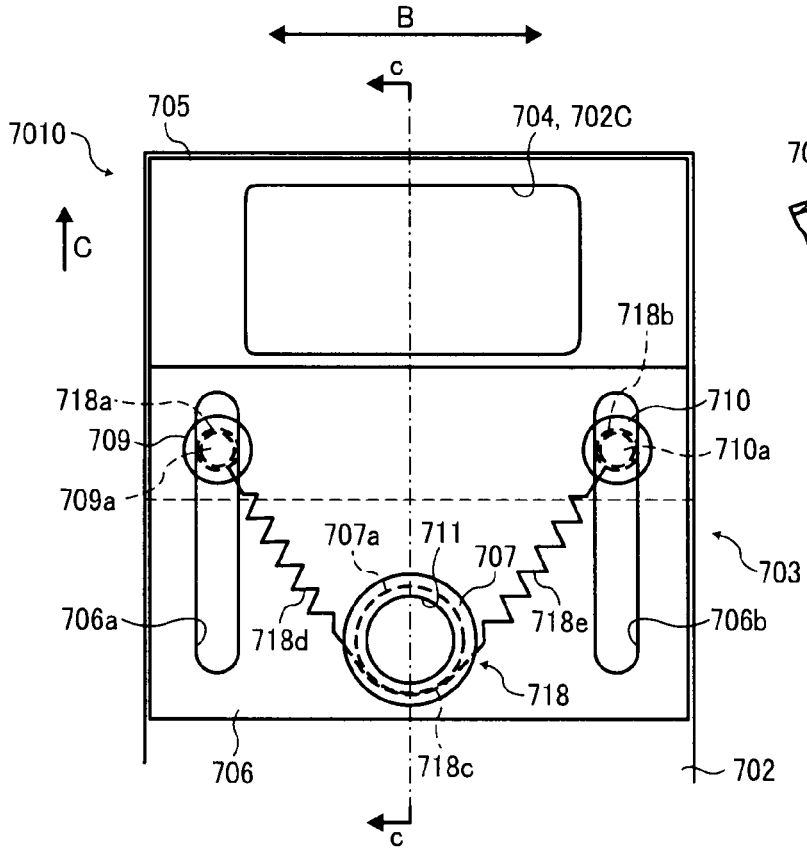
FIG. 73A is a plane view of the medium container having a biasing member that urges a second rigid member to a close direction.
Figure 73B:
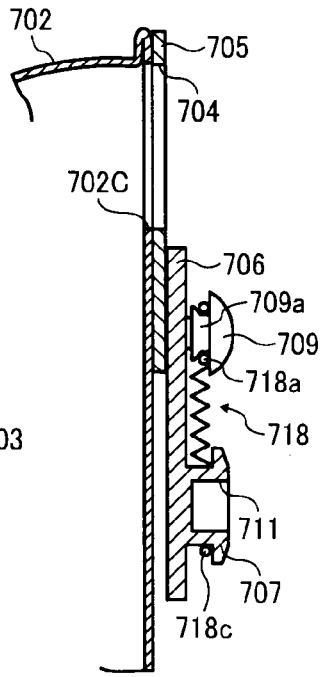
FIG. 73B is a cross-sectional view of the medium container, taking along the line c-c in FIG. 73A.
Figure 74:
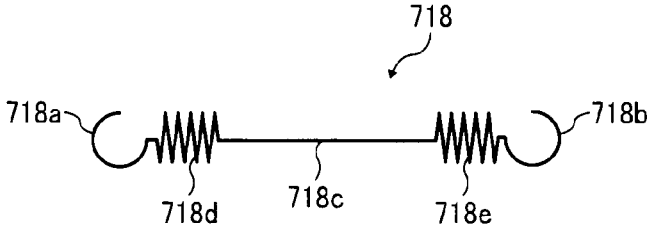
FIG. 74 is an enlarged view of another example of a biasing member.

It is to be noted that the biasing member is not limited to the rubber band 708 but can be a tension spring 718 as illustrated in FIGS. 73 and 74, for example.

FIG. 73A illustrates the toner container 7010 having another biasing member that urges the shutter 706 to a direction to close the cap fitting 703. FIG. 73B illustrates the toner container 7010 having the tension spring 718 as another biasing member, taking along the line c-c in FIG. 73A. FIG. 74 is an enlarged view of an example of the tension spring 718.

The tension spring 718 includes a straight portion 718*c* at the center part thereof, both ends 718*a* and 718*b* each having a hook, and coils 718*d* and 718*e* between the straight portion 718*c* and each hook. The straight portion 718*c*, which is the center part of the tension spring 718, is wound around the outer circumference of the projection 707 from the direction to open the shutter 706, so that the hooks of the both ends 718*a* and 718*b* can be hooked at the projection parts 709 and 710, respectively.

With this structure, the shutter 706 is urged by the tension spring 718 to the direction of closing the opening 704, and therefore, the opening 704 is usually blocked by the shutter 706. Further, since the wound portion is formed with the straight portion 718*c*, the tension spring 718 can slide easily, thereby opening and closing the shutter 706 smoothly.

Figure 83:
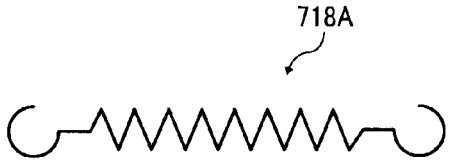
FIG. 83 is an enlarged view illustrating another example of the biasing member.

Tension spring is not limited to the tension spring 718 as long as the frictional load at the wound portion caused when opening and closing the shutter 706 is tolerable. Alternatively, for example, a tension coil spring 718A without the straight portion 718*c* as illustrated in FIG. 83 can be used.

By using the rubber band 708 as a biasing member as described above, the rubber band 708 is a less expensive way to bias the shutter 706, and has the further advantage that it can be used as a binding member for disposal or collection. However, although the rubber band 708 is advantageous in cost, it is likely that the elasticity will be lost over time. Therefore, the tension spring 718 or 718A can be used as a biasing member to suppress an increase in cost and provide good durability, thereby achieving good biasing of the shutter 706 using inexpensive parts.

Figure 75:
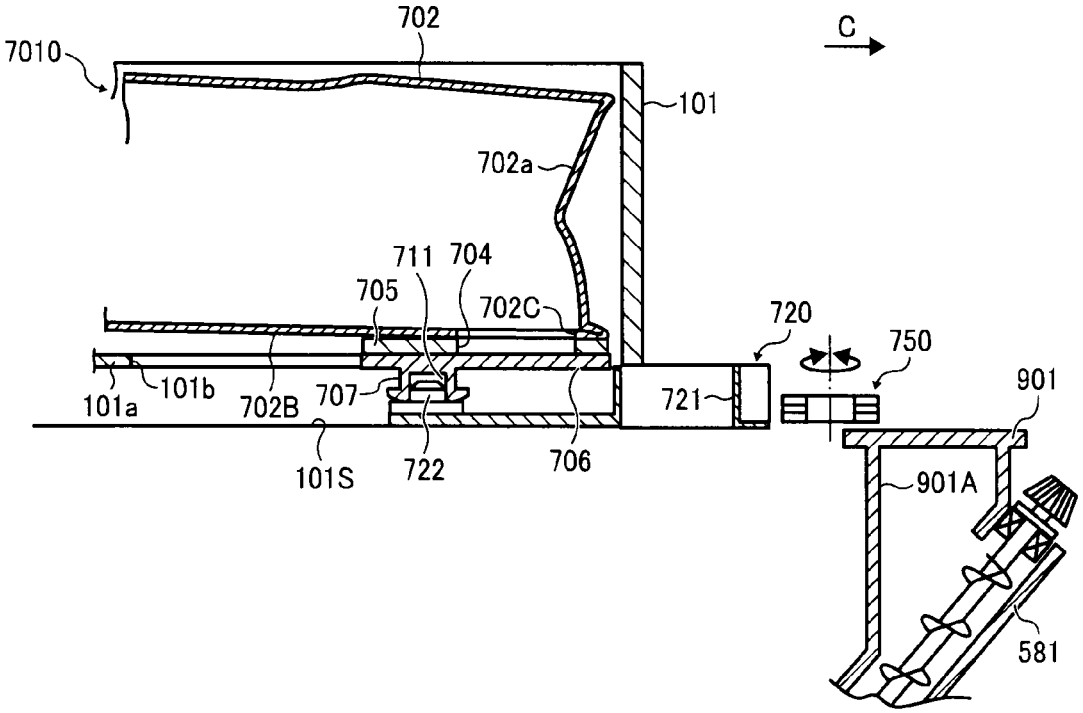
FIG. 75 is an enlarged cross-sectional view illustrating a configuration of a shutter member and a regulating member on the tray side in the tray and a mounting condition of the medium container.

As illustrated in FIG. 75, the medium inlet portion 901 is disposed on the inward side of the tray storage space 101S, facing each tray 101. (In FIG. 75, only one of the trays 101Y, 101M, 101C, and 101K is illustrated.) The medium inlet portion 901 works as a toner hopper on the main body 100A side to communicate with one end of the conveyance path 581 that includes a screw therein and temporarily accommodate toner supplied from the toner container 7010 when it is set at the tray set position.

Figure 76:
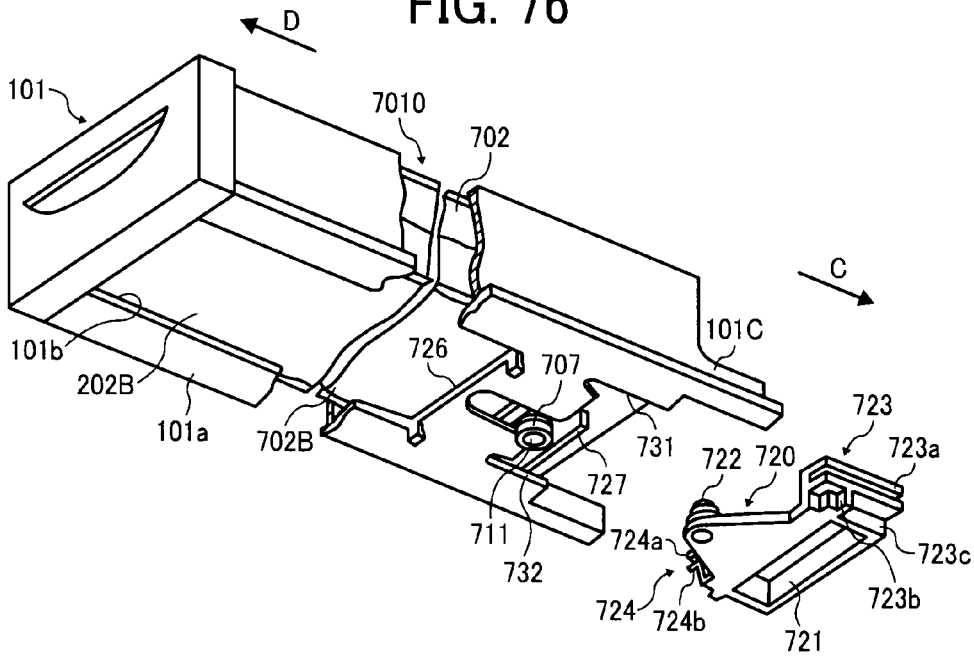
FIG. 76 is an exploded perspective view illustrating a structure of the shutter and the tray.
Figure 77:
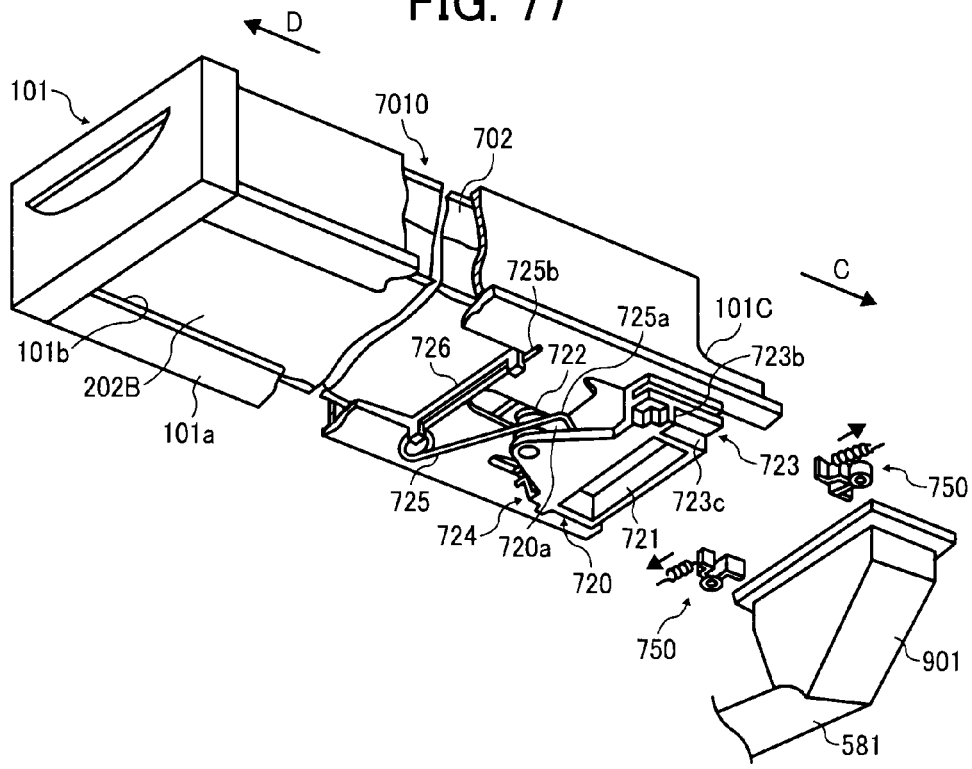
FIG. 77 is a perspective view of the tray mounting the regulating member and the medium container, viewed from below.

As illustrated in FIG. 76 and FIG. 77, the base portion 101*a* of the tray 101 includes an opening 101*b* so as to contact the lower face 702B of the container body 702 (the base plate of the toner container 7010). The tray 101 is located between the opening 901*a* of the medium inlet portion 901 disposed on the tray storage space 101S (main body 100A) and the opening 704 of the first rigid member 705. The tray 101 includes a tray shutter member 720 on the leading end 101*c* of the tray 101 to communicate with the opening 901*a* of the medium inlet portion 901 and the opening 704 of the first rigid member 705 via the opening 721 when the tray 101 is set to the main body 100A.

To be integrally mounted on the shutter 706 on the container body 702, the tray shutter member 720 includes the positioning boss 722 that engages a hole 711 of the shutter 706, guide members 723 and 724, and a torsion coil spring 725 serving as an elastic member to bias the tray shutter member 720 to the inward side of the main body 100A (the tray set position).

One end 725*a* of the torsion coil spring 725 that biases the tray shutter member 720 to the inward side of the main body 100A is hooked to a jaw 720*a* under the positioning boss 722 of the tray shutter member 720. The other end 725*b* of the torsion coil spring 725 is fixed to an L-shaped hook portion 726 formed on the lower portion of the tray 101. Therefore, the tray shutter member 720 is biased from the outward side to the inward side. As illustrated in FIG. 76, a tray stopper 727 is used to hold the tray shutter member 720 and keep it from coming out from the tray 101.

Guide rails 731 and 732 are formed extending along the longitudinal direction A at the leading end 101*c* of the tray 101. The guide rails 731 and 732 are inserted to grooves 723*a* and 724*a* formed on the guide members 723 and 724 of the tray shutter member 720, respectively. The tray shutter member 720 is slidably supported by the tray 101 in the longitudinal direction A by inserting the guide rails 730 and 731 to the guide grooves 723*a* and 724*a*.

As illustrated in FIG. 77 and FIG. 78, a pair of shutter regulating members 750 that serve as a regulating member is disposed on the inward side of the tray storage space 101S. When the tray 101 is set in the tray storage space 101S, the pair of shutter regulating members 750 engage projections 723*b* and 724*b* formed on guide members 723 and 724 that are part of the shutter 706 and accelerate the speed of opening and closing the shutter 706.

The pair of shutter regulating members 750 is disposed symmetrically about a central axis and each center portion of the shutter regulating members 750 is rotatably supported by pin on the main body 100A of the image forming apparatus 1000A. Each of the pair of shutter regulating members 750 is fixedly attached to one end of the tension coil spring 751 and includes a first arm 750*a* and a second arm 750*b* biased by the tension coil spring 751. The second arm 750*b* is wider than the first arm 750*a*. The first arm 750*a* and the second arm 750*b* are rotatably disposed against the action of the tension coil spring 751 to sandwich the guide members 723 and 724 of the tray shutter member 720 from both sides.

Figure 79:
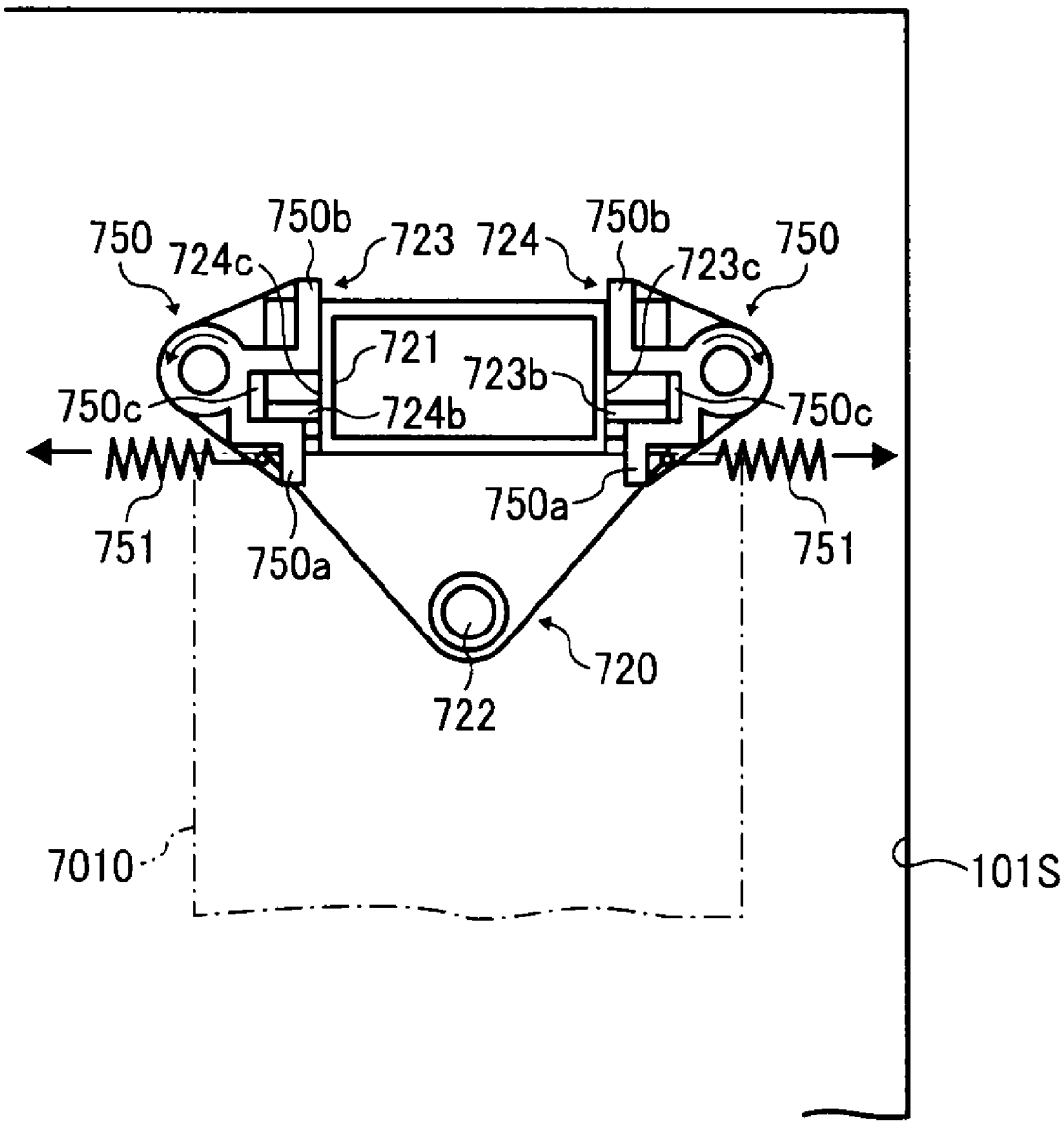
FIG. 79 is a bottom view illustrating a relation of the shutter on the tray side and the regulating member when the tray is located at the tray set position.

Specifically, the shutter regulating unit 750 has a rotating portion at the center part thereof, and include the first arm 750 that is biased to one side by the tension coil spring 751, and the second arm 750*b* to slidably contact the both sides 723*c* and 724*c* of the guide members 723 and 724 in the process of opening and closing the tray 101. At which the tray 101 is completely set, as illustrated in FIG. 79, the second arm 750*b* contacts both sides 723*c* and 724*c* of the guide members 723 and 724 and the posture can be maintained by contacting with the both sides 723*c* and 724*c* of the guide members 723 and 724.

Each of the shutter regulating units 750 is disposed along a path of opening and closing the tray 101 so as not to interfere with the action of the tray 101. However, the second arm 750*b* is biased by the tension coil spring 751 in the closing direction to project into the entry path of the tray shutter member 720. In entering the tray set position of the tray 101, the second arm 750*b* is pressed by the corner and both side faces of the leading end of the tray shutter member 720. By so doing, the tray 101 is allowed to enter while rotating outwardly against the tension coil spring 751. After completion of setting the tray 101, the second arms 750*b* pass by the tray shutter member 720 and contact both sides 723*c* and 724*c* of the guide members 723 and 724.

The tension coil spring 751, one end of which is fixedly attached in place, biases the shutter regulating unit 750. When the tray 101 is not inserted to the tray set position, as illustrated in plan view shown in FIG. 78B, the second arm 750*b* of the shutter regulating unit 750 protrudes into the moving range of the tray shutter member 720. It is to be noted that any other suitable elastic member can be used for this structure instead of the tension coil spring 751.

Next, a description is given of operations of the shutter regulating unit 750 and the tray shutter members 720 when setting the tray 101.

Figure 78A:
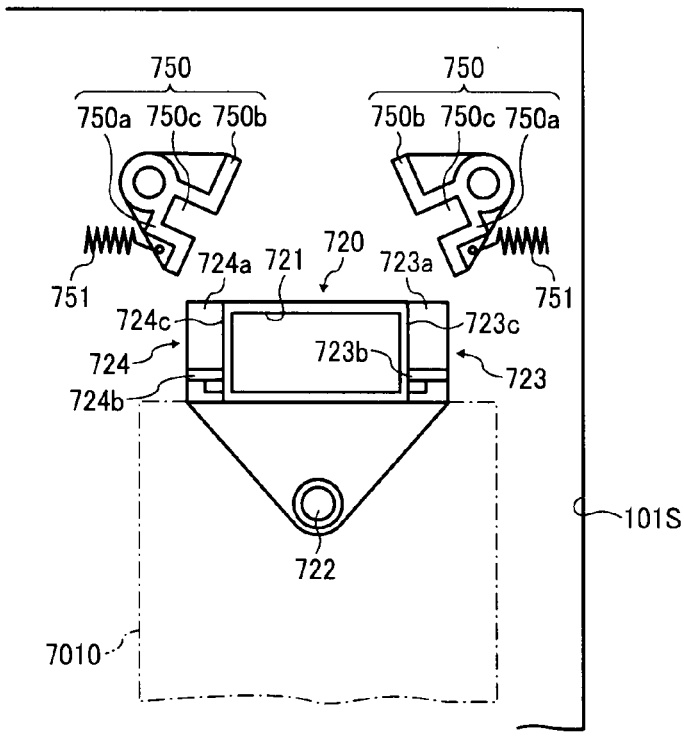
FIG. 78A is a bottom view illustrating of a schematic structure of the regulating member and the shutter on the tray side.
Figure 78B:
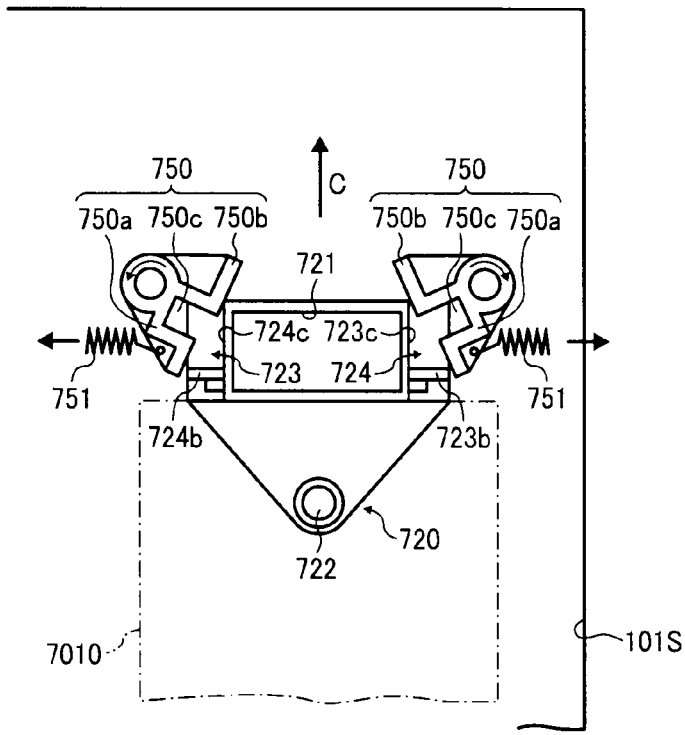
FIG. 78B is a bottom view illustrating an initial engaging condition of the shutter on the tray side and the regulating member.

As illustrated in FIG. 78A, as the operator M pushes the tray 101 to insert into the tray storage space 101S (the main body 100A), the leading ends of the second arms 750*b* contact the both sides 723*c* and 724*c* of the tray shutter member 720 that is fixed to the lower face 702B of the container body 702 (the base plate of the medium container 7010), as illustrated in FIG. 78B. As the operator M further inserts the tray 101 into the tray storage space 101S, the shutter regulating unit 750 rotates against the force of the tension coil spring 751, followed by the first arm 750*a*. At this time, the second arm 750*b* is pressed by tray shutter member 720 to rotate outwardly while the first arm 750*a* rotates inwardly.

As the tray 101 is further inserted into the tray storage space 101S toward the tray closing direction C, the end wall surface of the second arm 750*b* of the shutter regulating unit 750 follows the both sides 723*c* and 724*c* to stop the rotation as illustrated in FIG. 79, and the projections 723*b* and 724*b* are sandwiched with a slight clearance in the regulation member recessed portions 750*c* formed between the first arm 750*a* and the second arm 750*b* having a greater width than the first arm 750*a*.

This configuration is designed so that the tray shutter member 720 contacts part of the main body 100A when the rotation of the shutter regulating unit 750 is stopped and the projections 723*b* and 724*b* of the guide members 723 and 724 are sandwiched in the regulation member recessed portion 750*c*. At this time, the second arm 750*b* contacts both sides 723*c* and 724*c* to regulate the rotation thereof.

Namely, when setting the tray 101 to the inward side of the tray storage space 101S, which is a medium supplying position, a force to insert the tray 101 in the tray closing direction C is exerted. Against this insertion force, the shutter regulating unit 750 applies a force generated by the force of the tension coil spring 751 via the projections 750*b* to prevent the insertion of the tray 101. At this time, the operator M tries to further push the tray 101 in the tray closing direction C by generating a force exceeding the reaction force (biasing force).

Figure 80:
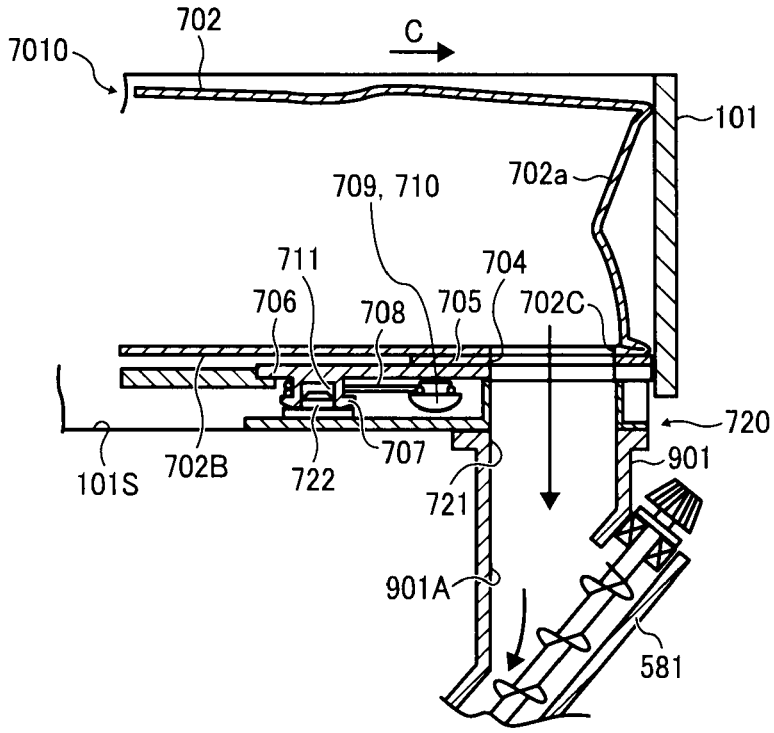
FIG. 80 is an enlarged cross-sectional view illustrating a state in which the medium transport unit is open and the medium container is set to the main body of the image forming apparatus.

Consequently, the tray 101 is accelerated in the tray closing direction C toward the tray set position, compared to a structure without the shutter regulating unit 750. At that time, as illustrated in FIG. 80, the shutter 706 integrally attached to the tray shutter member 720 is also opened swiftly. As a result, the opening 901*a* of the medium inlet portion 901, the opening 704 of the container body 702, and the opening 721 of the tray shutter member 720 may fit together with only a momentary displacement, thereby effectively preventing toner scattering.

Further, when the tray 101 is pulled out in the tray opening direction D, the shutter regulating unit 750 applies the force of the tension coil spring 751 in the direction of preventing the detachment of the tray 101 from the tray storage space 101S via the projections 723*b* and 724*b* engaging therewith. At this time, the operator M tries to further pull out the tray 101 from the tray storage space 1015 in the tray opening direction D by generating a force exceeding the reaction force (biasing force).

Consequently, the tray 101 is accelerated in the tray opening direction D toward the tray open position. At that time, as illustrated in FIG. 75, the shutter 706 integrally attached to the tray shutter member 720 is also shut swiftly. As a result, the opening 901*a* of the medium inlet portion 901, the opening 704 of the container body 702, and the opening 721 of the tray shutter member 720 may be detached substantially correctly again with only a momentary displacement, thereby again effectively preventing toner scattering.

As a medium transport facilitator, for example, the pressing member 801 of the medium transport facilitator 800 illustrated in FIG. 44, the pressing member 822 of the medium transport facilitator 800B illustrated in FIG. 49 through FIG. 52, the lower moving unit 860B of the medium transport facilitator 800C illustrated in FIG. 53 and FIG. 54, the medium transport facilitator 800D, the medium transport facilitator 800E, and the medium transport facilitator 800F illustrated in FIG. 55 through FIG. 58 is disposed, below the tray 101 in the image forming apparatus 1000A so that any of the above-described medium transport facilitators 800, 800B, 800C, 800D, 800E, and 800F can contact the lower face 702B of the container body 702 of the toner container 7010 via the opening 101*b* of the tray base portion 101*a*. Accordingly, the toner contained in the toner container 7010 can be conveyed toward the cap fitting 703.

In FIG. 32 through FIG. 43, the binding members 603, 605, 606, 613, and 623 are attached to the toner containers 600, 610, and 620 for squeezing the container bodies 602, 612, and 622 including part of deformable material for disposal. However, the structure of a toner container is not limited thereto.

Figure 81:
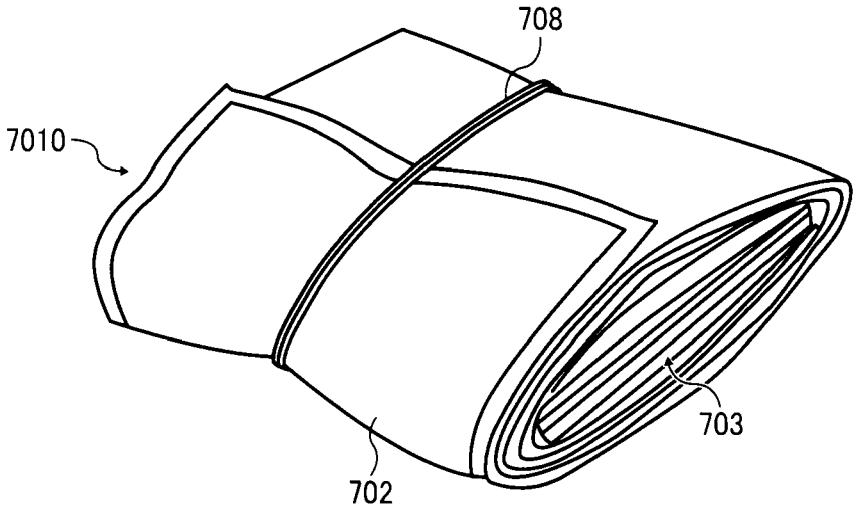
FIG. 81 is a perspective view illustrating a state in which the medium container is rolled and bound by the biasing member.

Further, the rubber band 708 can be used as a binding member. For example, the rubber band 708 that serves as a biasing member illustrated in FIG. 71 is taken out when disposing the used toner container 7010. After the toner container 7010 is crushed flat, the operator M may roll or fold the container body 702 with the cap fitting 703 held inside, as illustrated in FIG. 81, and wind the rubber band 708 around the squeezed toner container 7010. In this case, no additional binding member is required, thereby simplifying operations in collection and disposal. The rubber band 708 may be provided as an additional binding member. However, it is convenient and preferable that the rubber band 708 used for biasing the shutter 706 is taken out to serve as a retaining ring.

Figure 82A:
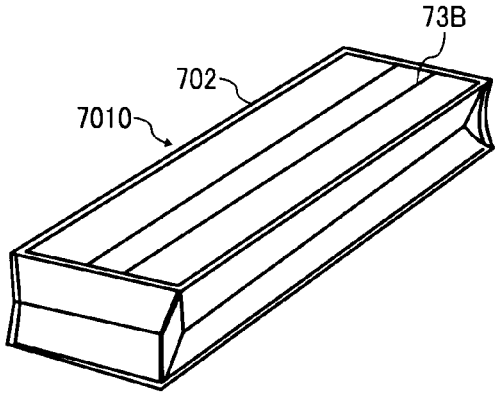
FIG. 82A is a perspective view illustrating a structure of the medium container having a strap.
Figure 82B:
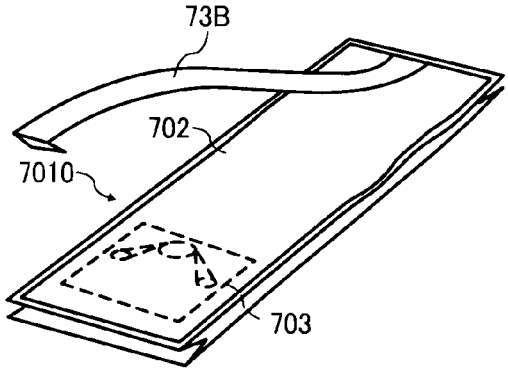
FIG. 82B is a perspective view illustrating a state in which one end of the strap of the medium container is detached from the medium container and the medium container is folded.
Figure 82C:
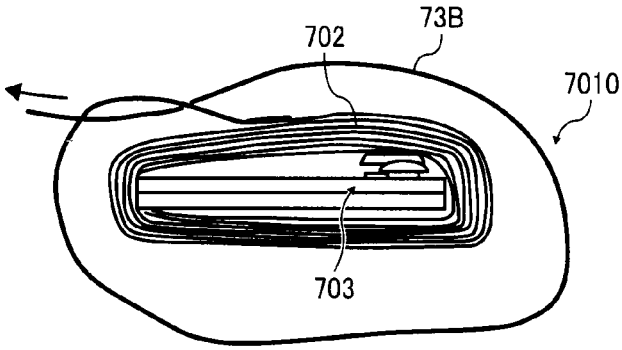
FIG. 82C is a side view illustrating a state in which the medium container is folded by the detached strap.

Alternatively, for the toner container 7010 having the second belt 73B mounted thereon as one of the belt-shaped grip portions as illustrated in FIG. 82A, one end of the second belt 73B, preferably one end that is closer to the cap fitting 703, is removed or cut from the container body 702 when disposing the used toner container 7010, so as to make it a free end. After the toner container 7010 is crushed flat, the operator M may roll or fold the container body 702 with the cap fitting 703 held inside, as illustrated in FIG. 82C, and wind the second belt 73B around the squeezed toner container 7010. In this case, no additional binding member is required, thereby simplifying operations in collection and disposal.

Such a reduction in volume of the toner container 7010 for disposal can achieve compact storage and transport of the squeezed toner container 7010 until disposal, thereby reducing costs for disposal and collection (of transportation and storage) significantly.

In the exemplary embodiments described above, the image forming apparatuses 1000 and 1000A correspond to a color copier. However, the image forming apparatuses 1000 and 1000A are not limited thereto but can correspond to any of a laser printer, facsimile machine, multi-functional machine including functions of the laser printer, facsimile machine, and so forth, and inkjet-type image forming apparatus. Further, the medium for image forming includes powder toner, liquid toner, ink contained in a cartridge, and so forth. For image forming apparatuses using ink as the image forming medium, a cartridge containing ink therein corresponds to a medium container.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

a main body;

an image forming unit disposed in the main body to form a visible image;

a medium container including a container body at least partially formed of a deformable material and containing a medium for image forming by the image forming unit;

a drawer that holds the medium container thereon and that is movable between a first position at which the drawer is pulled out fully to an outward side of the main body of the image forming apparatus and a second position at which the drawer is inserted and set to an inward side of the main body of the image forming apparatus;

a medium transport unit including a medium outlet port provided on a distal end of the medium container;

a medium receiving unit disposed on an inward side of the drawer and connected to the medium transport unit provided on the medium container; and a medium transport facilitator mounted on the drawer that presses the medium container set in the drawer from below such that the medium container is deformed in a vertical direction, thereby moving the medium contained in the medium container toward the medium transport unit at the inward side of the drawer.

2. The image forming apparatus according to claim 1, wherein the medium transport facilitator causes the medium container to be disposed at a downward sloping angle to the medium outlet port.

3. The image forming apparatus according to claim 1, wherein the medium transport facilitator lifts a lower face of the medium container upward and inward toward an interior of the image forming apparatus and moves toward the medium outlet port while repeatedly lifting the lower face of the medium container.

4. The image forming apparatus according to claim 1, wherein the medium transport facilitator comprises a pressing member to lift a lower face of the medium container toward an interior of the image forming apparatus, and a moving unit to move the pressing member toward the medium outlet port while lifting the lower face of the medium container by the pressing member.

5. The image forming apparatus according to claim 1, wherein the medium transport facilitator comprises multiple pressing members disposed in a longitudinal direction of the medium container to lift a lower face of the medium container toward an interior of the image forming apparatus, and a pressing mechanism to cause the multiple pressing members to contact and separate from the lower face of the medium container.

6. The image forming apparatus according to claim 1, wherein the medium transport facilitator comprises a pressing member having a pressing surface formed in a curved shape to press a lower face of the medium container toward an interior of the image forming apparatus, and a moving unit to rotate the pressing member with the pressing surface of the pressing member contacting the lower face of the medium container.

7. The image forming apparatus according to claim 1, wherein the medium transport facilitator comprises a pressing member having a pressing surface formed in a curved shape to press a lower face of the medium container toward an interior of the image forming apparatus, and a moving unit to move the pressing member in a medium transport direction with the pressing surface of the pressing member contacting the lower face of the medium container when the drawer is set in the second position.

8. The image forming apparatus according to claim 1, wherein the medium transport facilitator comprises a screw-shaped pressing member on the surface thereof to lift a lower face of the medium container toward an interior of the image forming apparatus, and a moving unit to rotate the pressing member, when the drawer is set in the second position, wherein the pressing member is disposed at the medium outlet port and is rotatable around an axis extending in a medium transport direction.

9. The image forming apparatus according to claim 8, wherein the screw-shaped pressing member is tapered with a reduced outer diameter from a trailing end of the medium container toward a leading end of the medium container.

10. The image forming apparatus according to claim 1, wherein the medium transport facilitator comprises:

a push-up member to push up the container body disposed opposite the medium transport unit in synchronization with insertion of the drawer in the image forming apparatus toward the second position;

a biasing member to apply a biasing force to the push-up member; and a drawer push-up control mechanism to cause a push-up operation of the push-up member to remain stopped when the drawer moves from the first position to the second position and to push up the drawer in cooperation with cam rails disposed in the main body of the image forming apparatus when the drawer stays at the second position.

11. The image forming apparatus according to claim 10, further comprising a compression part disposed in the main body of the image forming apparatus, above the drawer when the drawer is at the second position, to compress the container body, which is pushed up by the push-up member, by sandwiching the container body between the push-up member and the compression part.

12. The image forming apparatus according to claim 10, wherein the push-up member pushes up a rear portion of the container body disposed opposite the medium transport unit to bend the container body in a vertical direction when the drawer is inserted to the second position.

13. The image forming apparatus according to claim 1, wherein the medium receiving unit comprises an engaging unit projecting at an angle to a medium transport direction at a connection between a medium contacting portion and the medium transport unit.

14. The image forming apparatus according to claim 1, wherein the medium transport unit communicates with a developing unit in the main body of the image forming apparatus and the medium receiving unit, the medium transport unit further including a flexible tubular member having a having a first end connected to an end of the medium receiving unit, a length of a slack portion of the tubular member being greater than a distance through which the drawer is pulled out from the main body of the image forming apparatus, and a medium transport pump connected to a second end of the tubular member.

15. The image forming apparatus according to claim 14, further comprising a tubular member storing unit in which the slack portion of the tubular member is stored when the drawer is at the second position.

16. The image forming apparatus according to claim 15, further comprising:

a joint portion located at a side opposite an engaging unit of the medium receiving unit for connecting the tubular member and the engaging unit, the joint portion being rotatably supported with respect to the medium receiving unit;

a restorative force application member to apply a restorative force to the joint portion to cause the tubular member to rotate in a tube storing direction; and a regulating member to regulate rotation of the joint portion in a tube pulling-out direction when the drawer is at the first position.

17. A medium container stored in an image forming apparatus and containing medium for image forming therein, the medium container comprising:

a container body at least partially formed of a deformable material;

a medium transport unit that connects to a medium receiving unit provided in a main body of the image forming apparatus; and a grip portion mounted on the container body, wherein the grip portion is disposed at both ends thereof in a longitudinal direction of the container body.

18. The medium container according to claim 17, wherein the grip portion is fixedly attached at both ends thereof in the longitudinal direction of the container body.

19. The medium container according to claim 17, wherein the grip portion comprises a first grip portion disposed at a first end of the container body in the longitudinal direction thereof, and a second grip portion disposed at an opposite second end of the container body extending toward the first end along the longitudinal direction of the container body.

* * * * *